US011813840B2

(12) United States Patent
Flemming et al.

(10) Patent No.: US 11,813,840 B2
(45) Date of Patent: Nov. 14, 2023

(54) PRINT CONTROL STRIP, SUBSTRATE, AND METHOD FOR CONTROLLING BY OPEN-LOOP CONTROL AND/OR CLOSED-LOOP CONTROL AT LEAST ONE COMPONENT OF A PROCESSING MACHINE

(71) Applicant: KOENIG & BAUER AG, Würzburg (DE)

(72) Inventors: Steven Flemming, Berlin (DE); Ulrich Köhler, Radebeul (DE); Christian Pilz, Diera-Zehren (DE); Carsten Reinsch, Radebeul (DE); Martin Riese, Dresden (DE)

(73) Assignee: KOENIG & BAUER AG, Würzburg (DE)

( * ) Notice: Subject to any disclaimer, the term of this patent is extended or adjusted under 35 U.S.C. 154(b) by 0 days.

(21) Appl. No.: 17/926,687

(22) PCT Filed: Oct. 5, 2021

(86) PCT No.: PCT/EP2021/077426
§ 371 (c)(1),
(2) Date: Nov. 21, 2022

(87) PCT Pub. No.: WO2022/078818
PCT Pub. Date: Apr. 21, 2022

(65) Prior Publication Data

US 2023/0191774 A1 Jun. 22, 2023

(30) Foreign Application Priority Data

Oct. 15, 2020 (DE) ..... 10 2020 127 154.9
Jan. 20, 2021 (DE) ..... 10 2021 101 122.1

(51) Int. Cl.
*B41F 33/00* (2006.01)

(52) U.S. Cl.
CPC ..... *B41F 33/0036* (2013.01); *B41F 33/0081* (2013.01)

(58) Field of Classification Search
CPC ..... B41F 33/0081; B41F 33/0036
See application file for complete search history.

(56) References Cited

U.S. PATENT DOCUMENTS 8,727,346 B2 5/2014 Chiari et al.
2003/0214675 A1* 11/2003 Hatayama ..... B41F 33/0045 358/1.18

(Continued)

FOREIGN PATENT DOCUMENTS

CN 103764398 A 4/2014
CN 107548358 A 1/2018

(Continued)

OTHER PUBLICATIONS

International Search Report of PCT/EP2021/077426 dated Dec. 22, 2021.

(Continued)

*Primary Examiner* — David H Banh
(74) *Attorney, Agent, or Firm* — Mattingly & Malur, PC

(57) ABSTRACT

In some examples, a print control strip includes at least one control patch configured as an element for color management. The element for color management may be configured to measure a color density and/or at least one spectral value and/or an area of coverage of individual printed printing colors. The print control strip further includes at least one control patch configured as a printing mark. The printing mark is configured for aligning a substrate in a transport direction and/or in a transverse direction. Additionally, the print control strip includes at least one control patch configured as a plate recognition patch. The plate recognition patch is configured to assign at least one printing color used (Continued)

to a printing plate and/or to an application mechanism and/or is configured for such assignment.

12 Claims, 21 Drawing Sheets

(56) References Cited

U.S. PATENT DOCUMENTS

| | | | | |
|---|---|---|---|---|
| 2003/0217662 | A1* | 11/2003 | Koifman | B41C 1/1075 101/484 |
| 2004/0177784 | A1* | 9/2004 | Yamamoto | B41F 33/0045 101/484 |
| 2006/0285181 | A1* | 12/2006 | Fukui | B41F 33/0045 358/504 |
| 2007/0079717 | A1* | 4/2007 | De Vries | B41F 33/0036 101/484 |
| 2009/0294540 | A1* | 12/2009 | Johnson | B41C 1/00 101/463.1 |
| 2012/0105533 | A1* | 5/2012 | Wozniak | B41J 2/18 347/19 |
| 2018/0373967 | A1* | 12/2018 | Yamamoto | G06F 3/1208 |
| 2021/0283898 | A1* | 9/2021 | Kluepfel | B41F 27/1206 |

FOREIGN PATENT DOCUMENTS

| | | | |
|---|---|---|---|
| CN | 109476152 | A | 3/2019 |
| DE | 4232434 | A1 | 4/1994 |
| DE | 4338976 | A1 | 5/1995 |
| DE | 10111070 | A1 | 10/2001 |
| DE | 10258271 | A1 | 7/2003 |
| DE | 69625809 | T2 | 9/2003 |
| DE | 102008031275 | A1 | 1/2010 |
| DE | 102011001920 | A1 | 8/2011 |
| DE | 102011001920 | B4 | 8/2013 |
| DE | 102015208596 | A1 | 11/2015 |
| DE | 102014223579 | A1 | 5/2016 |
| DE | 10317187 | B4 | 5/2017 |
| DE | 102009041230 | B4 | 1/2018 |
| DE | 102017201009 | A1 | 7/2018 |
| DE | 102017212134 | B4 | 3/2019 |
| DE | 102018216442 | A1 | 3/2020 |
| DE | 102019129645 | A1 | 5/2021 |
| EP | 0590282 | A1 | 4/1994 |
| EP | 0825022 | A1 | 2/1998 |
| EP | 2481585 | A1 | 8/2012 |
| JP | 07-125870 | A | 5/1995 |
| WO | 2012/076671 | A1 | 6/2012 |
| WO | 2018206588 | A1 | 11/2018 |

OTHER PUBLICATIONS

Chinese Office Action received in corresponding Chinese Application No. 202180036811.5 dated Mar. 30, 2023 w/ partial translation.

* cited by examiner

PRINT CONTROL STRIP, SUBSTRATE, AND METHOD FOR CONTROLLING BY OPEN-LOOP CONTROL AND/OR CLOSED-LOOP CONTROL AT LEAST ONE COMPONENT OF A PROCESSING MACHINE

CROSS-REFERENCES TO RELATED APPLICATIONS

This application is the US national phase, under 35 USC § 371, of PCT/EP2021/077426, filed on Oct. 5, 2021, published as WO 2022/078818 A1 on Apr. 21, 2022, and claiming priority to DE 10 2020 127 154.9, filed Oct. 15, 2020, and DE 10 2021 101 122.1, filed Jan. 20, 2021, and all of which are expressly incorporated by reference herein in their entireties.

TECHNICAL FIELD

Examples herein relate to a print control strip, to a substrate, and to a method for controlling by open-loop control and/or closed-loop control at least one component of a processing machine in which the print control strip includes at least one control patch configured as an element for color management. The element for color management may be configured to measure a color density and/or at least one spectral value and/or an area of coverage of individual printed printing colors. The print control strip further includes at least one control patch configured as a printing mark. The printing mark is configured for aligning a substrate in a transport direction and/or in a transverse direction. Examples herein further relate to a substrate including such a print control strip.

Examples herein further relate to a method for controlling by open-loop control and/or closed-loop control at least one component of a processing machine. For example, an infeed unit of the processing machine includes a sensor device comprising at least two sensors. The sensor device detects at least one printing mark that is integrated into at least one print control strip of at least one substrate. The at least one substrate may be adjusted in a transport direction and/or in a transverse direction as a function of the detection by the sensor device.

BACKGROUND

Web-like or sheet-like materials are used in the production of packaging. For example, sheets are imprinted, embossed, creased, perforated, die-cut, cut, stitched, glued and, for example, folded into packaging in multiple processing steps. To optimally utilize the surface area of a sheet, in general multiple identical or different copies, for example of a poster, a folding box or a packaging, are printed on a common sheet and then die-cut. These copies are referred to as blanks.

A sheet processing machine can comprise different processing steps, such as imprinting, cutting, embossing, creasing, die cutting, perforating, gluing and/or stitching. Such sheet processing machines frequently also comprise inspection devices. Sheets are typically processed and cut to size in processing machines using tool-dependent die cutting and cutting devices.

Such a processing machine is configured as a die cutting, cutting, perforating, embossing and/or creasing machine, for example. When such a processing machine is referred to hereafter as a die cutter and/or a die-cutting machine, in particular also a cutting, perforating, embossing and/or creasing machine is meant. In addition to rotary die cutters, tool-dependent systems also encompass flat die cutters, in particular flat-bed die cutters. In these, multiple sheets are processed consecutively by a cyclically recurring movement. The sheets are preferably moved substantially horizontally through the processing machine by way of a transport system, preferably a chain gripper system. In addition to a die-cutting unit, such a machine usually also comprises other units, such as a sheet infeed unit, a sheet delivery unit, a stripping unit, a sheet insert unit, a blank separating unit, and an offcut piece delivery unit. The sheet infeed unit is preferably configured to transfer sheets to the transport system. Additionally, sheets are, for example, aligned in the sheet infeed unit. The alignment of the sheets in the processing machine is crucial for the processing quality, for example to ensure a color register, a perfecting register and/or a correct position of a die-cut pattern in relation to a print image.

A device for positioning plate-shaped elements in an infeed unit of a processing machine is known from U.S. Pat. No. 8,727,346 B2, which grips the element in a predefined position and transports it to a successive processing station.

DE 101 11 070 A1 discloses a sheet printing press comprising an infeed system for feeding sheets from a sheet feeder to the sheet printing press, wherein the infeed system comprises at least one oscillatingly moving pregripper and a driving device for the infeed system. The pregripper can be uncoupled from the driving device. The pregripper can be driven with the aid of a lever mechanism. The driving device is configured as a cam drive, wherein a cam disk that is connected to a drive shaft so as to be fixed against rotation cooperates with a first pivoting lever of the lever mechanism which can be pivoted about a fixed axis. A sheet is aligned by way of a pivotable front lay mark and is then accepted by the pre-gripper and transported onwards.

DE 102 58 271 A1 discloses a device for preventing a spring-loaded control roller from being lifted off the control cam in gripper control units in sheet-processing machines. A support mechanism is provided, which is arranged separately from the gripper control unit and acts on the control roller with an additional force in critical regions. The support mechanism comprises two pivotably mounted levers, which are subject to the force of a spring element.

The teaching of DE 10 2008 031 275 A1 relates to a device for laterally aligning printing substrate sheets comprising a gripper system. Pincer gripper fingers are arranged on a gripper finger shaft, and pincer gripper pads are arranged on a gripper pad shaft at the periphery of the sheet transporting device. One of the two shafts is configured as a hollow shaft and coaxially encloses the respective other shaft. At least the gripper finger shaft is rotatably mounted and drivable in an oscillating manner. In particular, the gripper finger shaft and gripper pad shaft are synchronously adjustable in the axial direction. The gripper pad shaft can be pivoted so as to change the gripper closing position. The pivoting movement is induced by means of a drive by displacing a support point of a sliding bearing of a torque support arm.

DE 10 2009 041 230 B4 teaches a method and a device for laterally aligning a sheet in a processing machine. The device comprises at least one sensor for detecting the actual position of the sheet. Before the sheet is picked up by the gripper device, a prealignment of the gripper device is carried out. The gripper device is prealigned to a predefined position in accordance with the actual position of the sheet with respect to its lateral position.

A sheet-processing machine is known from WO 2018/206588 A1, which comprises at least one measuring device for detecting a lateral sheet edge of the sheet and a sensor, which is assigned to the lateral region of the transport web, for detecting a mark.

The teaching of DE 42 32 434 A1 discloses a print control strip for managing and monitoring the printing process of printing presses. The print control strip has a multiplicity of photoelectrically scannable measurement patches for each ink to be printed. Control patches are embodied as solid-color measurement patches for directly managing the inking process, and diagnostic patches are embodied as measurement patches having a certain halftone value for additional monitoring of the printing process.

DE 43 38 976 A1 teaches a control strip including an arrangement of multiple control patches for controlling and/or managing multicolor printing. Depending on the application, the following types of control patches are provided: slurring and doubling control patch, highlight dot screen patch, shadow dot screen patch, unicolor solid-tone patch, multi-color patch, solid-color patch, overprinting patch, gray balance patch, halftone patch, copying control patch, microline patch, and dot screen patch. The control patch includes at least two regions having different numbers of printing inks overprinted on one another, wherein the regions include a core region, provided for the metrological evaluation, and at least one edge region.

DE 103 17 187 B4 discloses a sheet onto which, in addition to elements configured as ink strips and register marks that are separated from one another, data are printed in an edge region of the sheet in the form of an informational block, which, for example, are read out in a further paper-processing machine, arranged downstream from the printing press, by means of a reader and are transmitted to the control unit.

DE 10 2015 208 596 A1 teaches a measuring strip system for a substrate that can be coated on both sides, wherein at least a partial region of the measuring strip of one substrate side overlaps with at least one partial region of the measuring strip of the other substrate side. The measuring strip includes color measurement patches. Solid-color patches for each ink zone, free patches, paper white patches and coded register marks are provided. In addition, side recognition marks are provided, by which the measured sheet side is assigned to the printing mechanism.

The teaching of DE 10 2011 001 920 A1 discloses a control bar for a finish coating forme for print post-processing. The control bar includes a plurality of different control elements. A control element in the form of a surface area including lettering can be used to monitor the even application of the finish coating and the contact pressure of the forme rollers. A control element in the form of positive or negative lines is used to monitor slurring or doubling of the printing forme or the pressure setting and roller setting. A control element in the form of positive or negative circles allows slurring or doubling as well as the open printout of the finish coating forme to be monitored. A control element in the form of screen dot patches allows the printing plate dimensions to be monitored.

The teaching of DE 696 25 809 T2 discloses a digital control strip for the quality control of printing devices and imaged media, which can be applied to an imageable medium such as a printing plate by way of a raster output device. The control strip encompasses groups of related control patches referred to as a patch set. The groups are a checkerboard field set, a pixel line field set, a screen dot field set as well as text.

DE 10 2018 216 442 A1 teaches a method for the automated register measurement of color separations in a printing process. A test pattern embodied as a color control strip is detected and evaluated with respect to a register offset. The circumferential register, lateral register and diagonal register are evaluated. The control strip includes color measurement patches having an adapted sequence. No additional register measurement patches are provided. The teaching of this document does not disclose a control patch designed as a printing mark, which is configured to align a substrate in the transport direction and/or in the transverse direction.

A print control strip including split marks is known from EP 10 2014 223 579 A1. A printing substrate-processing machine comprises at least three sensors, these being two sensors for detecting the circumferential register and one sensor for detecting the lateral position. In a print control strip of the sheet, three color measurement patches form a color zone of a circumferential mark. The sheet additionally has a side lay mark. With the aid of the collected data, the lateral sensor ascertains the one of the two sensors for detecting the circumferential register, the evaluation range of which is within a circumferential mark. The position of the sheet in the machine is ascertained from the data thus ascertained by means of the three sensors.

SUMMARY

It is an object herein to devise a print control strip, a substrate, and a method for controlling by open-loop control and/or closed-loop control at least one component of a processing machine.

This object is achieved in some examples by a print control strip and a substrate including a print control strip in which the print control strip includes at least one control patch configured as a plate recognition patch. The plate recognition patch is configured to assign at least one printing color used to a printing plate and/or to an application mechanism and/or is configured for such assignment Additionally, in some examples, this object is achieved by a method for controlling by open-loop control and/or closed-loop control at least one component of a processing machine in which at least one print control strip includes at least one control patch configured as a plate recognition patch. The plate recognition patch includes at least two elements for plate recognition. A respective element for plate recognition is assigned in each case to a printing color and/or a respective element for plate recognition is printed in each case by a printing color. The dependent claims show advantageous refinements and/or embodiments of the identified solution.

The advantages to be achieved with the invention are, in particular, to create a processing machine, which is preferably configured as a die-cutting machine, comprising at least one sensor device. Advantageously, at least one infeed unit of the die-cutting machine comprises the at least one sensor device. The at least one sensor device comprises at least two sensors. The at least two sensors are advantageously configured as cameras. In this way, advantageously an optical detection of at least one mark and/or of at least one print control strip is ensured, wherein it is advantageously possible to distinguish between the printing colors used for printing. The infeed unit advantageously comprises at least one infeed system. The at least one sensor device is advantageously configured to control by open-loop control and/or closed-loop control at least one servo drive of the infeed system, as a function of the detection of at least one sheet of sheets by the at least two sensors. This advantageously results in individual closed-loop control and/or open-loop control of the at least one servo drive for each individual sheet. The at least two sensors are advantageously configured to detect at least one printing mark of the at least one sheet of the sheets. Advantageously, at least one sensor of the at least two sensors is configured to detect at least one print control strip of the at least one sheet. In this way, advantageously components of the print control strip are detected and used to control the die-cutting machine by open-loop control and/or closed-loop control. At least one sensor of the at least two sensors is advantageously configured to detect the at least one printing mark, the at least one printing mark being integrated into the at least one print control strip of the at least one sheet. Advantageously, the at least one printing mark and the at least one print control strip are detected by the same sensor device, whereby advantageously costs, for example for a further sensor device and/or working hours, due to the print control strip being evaluated by an operator, can be saved.

A print control strip is created. The at least one print control strip preferably includes at least one control patch configured as an element for color management. The at least one print control strip includes at least one printing mark. The at least one print control strip includes at least one control patch configured as a printing mark, that is, preferably a patch, configured as an alignment patch, including a printing mark. The at least one printing mark is configured so as to align a substrate in the transport direction and/or in the transverse direction. The at least one print control strip preferably includes at least one control patch configured as a side recognition mark and/or the at least one print control strip includes at least one control patch configured as a plate recognition patch.

At least one substrate, which is preferably configured as a sheet, includes the at least one print control strip. The at least one print control strip advantageously includes at least eight control patches, wherein the at least one print control strip includes at least one control patch configured as an element for color management and/or at least one control patch configured as a print register element and/or at least one control patch configured as a printing mark and/or at least one control patch configured as a side recognition mark and/or at least one control patch configured as a plate recognition patch and/or at least one control patch configured as an information mark and/or at least one control patch configured as a reference patch. Advantageously, the at least one sheet includes information in the at least one print control strip about its production and/or post-press processing. Advantageously, the control patches of the at least one sheet can be detected easily and quickly and/or their information can be used for controlling the processing process by closed-loop control and/or open-loop control. Advantageously, the integration of the at least one printing mark in the at least one print control strip achieves space savings on the sheet surface, whereby a larger surface area of the sheet is available for multiple-up copies and for post-press processing into an end product.

A method for controlling by open-loop control and/or closed-loop control at least one component of a processing machine, preferably a processing machine configured as a die-cutting machine, is created. At least one infeed unit of the processing machine, preferably the die-cutting machine, comprises at least one sensor device. The at least one sensor device comprises at least two sensors. The at least two sensors are advantageously configured as cameras. The at least one sensor device, preferably at least one sensor of the at least two sensors, detects at least one printing mark, integrated into at least one print control strip, of at least one substrate, preferably of at least one sheet of sheets. The at least one sensor device preferably controls by open-loop control and/or closed-loop control at least one servo drive of at least one infeed system of the at least one infeed unit as a function of the detection of the at least one substrate. The at least one substrate is adjusted in the transport direction and/or transverse direction as a function of the detection by the at least one sensor device. The at least one print control strip preferably includes at least one control patch configured as a side recognition mark and/or the at least one print control strip includes at least one control patch configured as a plate recognition patch. The at least one print control strip preferably includes the at least one plate recognition patch and/or the at least one side recognition mark, in addition to the at least one printing mark. At least one sensor of the at least two sensors advantageously detects at least one printing mark, integrated into at least one print control strip, of at least one sheet of sheets. Advantageously, the at least one printing mark and the at least one print control strip are detected by the same sensor device, whereby advantageously costs, for example for a further sensor device and/or working hours, due to the print control strip being evaluated by an operator, can be saved. Advantageously, the at least one print control strip is evaluated at least with respect to a control patch having at least one function. At least one component of the die-cutting machine is advantageously controlled by closed-loop control as a function of the evaluation of the at least one print control strip. Advantageously, the at least one print control strip includes control patches having differing functions. Advantageously, in this way multiple evaluations with respect to the various control patches having differing functions take place quickly and easily, advantageously by a one-time detection of the at least one print control strip.

Additionally or alternatively, the advantages to be achieved are that feeding of a respective, preferably at least one, sheet in a positionally accurate manner from an infeed unit to at least one unit processing the sheet by at least one infeed system is ensured. Advantageously, a sheet, preferably the at least one sheet, is aligned upstream from a transfer position, and is transferred in the transfer position by the at least one infeed system in an aligned manner to at least one downstream transport system Preferably, the at least one sheet is, more preferably at least twenty, more preferably at least fifty, more preferably a multiplicity of sheets are preferably consecutively aligned in the infeed system, and preferably consecutively transferred to the downstream transport system.

Positioning the, preferably at least one, sheet in an alignment position, in particular on at least two front lay marks, advantageously reduces and/or minimizes a position error of the sheet. The, preferably at least one, sheet is thus rough aligned, in particular with respect to its position relative to at least one transport means, preferably at least one gripper, of the at least one infeed system. In this way, the respective, preferably the at least one, sheet is advantageously held by the at least one transport means in a print-free region of the sheet, in particular subsequent to having been positioned, whereby the impact on a potentially present print image and/or the surface of the sheet is minimized while the sheet is being held and/or transported by the at least one transport means.

The, preferably at least one, sheet is advantageously finely aligned while it is transported from the alignment position to the transfer position The fine alignment is advantageously carried out at least with respect to a position error of the sheet, preferably at least with respect to a position error of the sheet in a transport direction of sheets and/or with respect to a skewed position of the sheet and/or with respect to a lateral position error, in particular in the event of a displacement of the sheet orthogonal to the transport direction of sheets. In particular, the infeed system is configured to finely align the at least one sheet. Advantageously, the at least one sheet is transported in an aligned manner to the processing units and is processed therein in its position which has preferably been aligned by the infeed system.

The sheet processing machine advantageously comprises at least one transport means of an infeed system. The infeed system preferably comprises at least one cam mechanism, each comprising at least one cam disk and an axis of rotation of the at least one cam disk. At least one scanning element is preferably arranged to rest against the at least one cam disk. The at least one scanning element is preferably connected to the at least one transport means via at least one drive lever. Each of the at least one drive lever preferably has at least one mounting point. The mounting point and the axis of rotation are preferably configured to be adjustable and/or to be adjusted and/or to adjust and/or are adjusted relative to one another. A position displacement of the mounting point relative to the axis of rotation is preferably configured to compensate for at least one position error of at least one sheet. Preferably, the relative position of the transport means of the infeed system of the sheet processing machine is changed. In this way, optimal feeding of the at least one sheet to a unit that processes the sheet is advantageously ensured.

The preferably at least one sheet is advantageously transported from the alignment position to a transfer position by at least one movement of the at least one transport means, preferably of the at least one gripper of the infeed system, along a transport path of sheets, in particular by at least one cam mechanism of the infeed system, more preferably by at least one dual cam mechanism of the infeed system. The at least one cam mechanism is advantageously connected to at least one drive shaft, which is driven by an in particular central drive of the sheet processing machine.

Advantageously, the at least one cam mechanism is configured as a dual cam mechanism, comprising at least two cam disks in each case, for the transport movement of the, preferably at least one, sheet. When a respective scanning element rests in each case against one of the cam disks of the dual cam mechanism, and at least two scanning elements are arranged on a preferably shared drive lever, preferably all scanning elements advantageously rest, preferably permanently, without clearance against the respective one, preferably the at least one, cam disk. The respective at least one further scanning element is preferably configured as a pressing element of the respective at least one scanning element.

The infeed system advantageously comprises at least two cam mechanisms, which are arranged parallel to one another in the transport direction, on at least one, preferably joint, drive shaft. This advantageously allows the driving torque to be simultaneously picked up from the at least one drive shaft. At least one servo drive is preferably assigned to each cam mechanism of the infeed system. The at least one servo drive advantageously intervenes in the at least one cam mechanism. The at least one servo drive advantageously intervenes in a conversion of the torque of the drive shaft into a preferably linear movement of the at least one transport means of the infeed system by the at least one cam mechanism. Advantageously, at least one servo drive is activated and/or controlled by closed-loop control at least for compensating for a skewed position of the sheet. Advantageously, at least two servo drives are additionally activated and/or controlled by closed-loop control at least for compensating for a position error in the transport direction. In addition to a movement of the cam mechanism as a result of the drive of the processing machine, the at least one servo drive is preferably configured to drive, preferably move, the at least one transport means of the infeed system.

Advantageously, the at least one drive shaft and at least one holding element of a transport system downstream from the at least one transport means are preferably driven by way of the in particular central drive of the sheet processing machine and/or are mechanically or electronically connected to one another, whereby the at least one transport means and the at least one holding element, downstream therefrom, of the transport system are in particular synchronized and/or can be synchronized in terms of time. As a result of the at least one transport means and the at least one holding element, downstream therefrom, of the transport system being in particular synchronized in terms of time, a collision of the relevant components during a movement of the at least one transport means and/or of the at least one holding element of the transport system, in particular due to, for example, electrical malfunctions, with one another is prevented.

The sheet processing machine advantageously comprises at least one sensor device. Preferably, at least one infeed unit of the sheet processing machine comprises the at least one sensor device. The at least one sensor device preferably comprises at least two sensors. The at least two sensors are preferably configured as a camera, whereby preferably both an edge and a printing mark can be detected. Advantageously, the respective, preferably the at least one, sheet is detected in the alignment position by at least one sensor, preferably at least two sensors, in particular at least three sensors. The at least two sensors are preferably configured to detect, and/or detect, at least one edge and/or printing mark of the at least one sheet of the sheets. Advantageously, at least two sensors are arranged parallel to one another and orthogonally to the transport direction, and detect at least one leading edge of the sheet in the alignment position. For example as an alternative or in addition, the at least two sensors detect at least one printing mark of the at least one sheet. The at least two sensors preferably selectively detect, and/or are configured to detect, an edge, preferably a leading edge, and/or at least one printing mark of the at least one sheet. The sheet processing machine, preferably the at least one infeed unit, preferably comprises the at least one infeed system. The at least one sensor device is preferably configured to control by open-loop control and/or closed-loop control at least one servo motor of the infeed system, preferably as a function of the detection of at least one sheet of sheets by the at least two sensors. The ascertained measurement value is advantageously fed to a control system, which controls by closed-loop control and/or open-loop control at least one component of the sheet processing machine, in particular at least one servo drive, as a function of the detected sheet. Advantageously, at least one servo drive is actuated as a function of the preferably selective detection. Advantageously, at least one component of the sheet processing machine is controlled by open-loop control and/or closed-loop control.

A detection of the sheet by the at least two sensors in the alignment position advantageously takes place so that the detection zone of the respective, preferably the at least one, sensor has an edge of the sheet and, additionally or alternatively, a printing mark of the sheet. In this way, advantageously both an edge of the sheet and a printing mark of the sheet are detected and/or detectable by the respective, preferably the at least one, sensor. In this way, advantageously both an edge of the sheet and a printing mark of the sheet are detected and/or detectable by the respective, preferably the at least one, sensor, without changing a position of the sensor and/or without changing a position of the detection zone. Advantageously, at least one sensor, for example a third sensor, is arranged so as to detect at least one side edge of the sheet in the alignment position. Advantageously, at least one sensor of the at least two sensors is configured in each case to detect and/or determine the position in the transport direction of the at least one sheet and the position in the transverse direction of the at least one sheet. In this way, the position of the sheet in the transport direction and in the transverse direction and a skewed position of the sheet can preferably be ascertained and/or are ascertained by the at least two sensors. This advantageously allows further sensors and/or a lateral stop, intended to align the sheet in the transverse direction, to be dispensed with. At least one sensor of the at least two sensors is advantageously configured to detect at least one printing mark, the at least one printing mark being integrated into at least one print control strip. This is preferably a space-saving configuration since a larger surface area of the sheet is available for multiple-up copies.

The sheet processing machine advantageously comprises the at least one infeed system, wherein the at least one infeed system comprises the at least one transport means including, in each case, at least one upper holder and, in each case, at least one lower holder. Preferably, the at least one transport means in each case can be arranged and/or is arranged in at least three states. Preferably, a maximally closed state corresponds to a minimal distance, and a minimally closed state corresponds to a maximal distance, and an at least one mean state corresponds to at least one mean distance between at least one upper holding surface at least of the respective upper holder of the at least one transport means and at least one lower holding surface of the lower holder of the at least one transport means which is assigned to the respective upper holder. The at least one transport means preferably has the minimally closed state at least once, and the maximally closed state at least once, and the at least one mean state at least once, during a machine cycle. The at least one transport means is preferably arranged in the minimally closed state at least once, and in the maximally closed state at least once, and in the at least one mean state at least once, during a machine cycle.

Advantageously, the at least one transport means, preferably the at least one gripper of the infeed system, comprises in each case at least one pivoting and/or pivotable holder. Advantageously, the at least one transport means, preferably the at least one gripper of the infeed system, comprises in each case at least one pivoting and/or pivotable holder so that a distance between at least one upper holder and at least one lower holder of the at least one transport means is preferably settable and/or set, in particular via at least one cam mechanism. The at least one upper holder advantageously has at least a mean distance with respect to the at least one lower holder of the at least one transport means while the sheet is being positioned in the alignment position. At a mean distance between the at least one upper holder and the at least one lower holder, the sheet is advantageously at least partially fixed at least in one spatial direction, in particular at least in the vertical direction. This advantageously enables positioning and/or a rough alignment within the transport path in the alignment position, preferably at least in the transverse direction and/or in the transport direction, wherein the sheet is at least partially, preferably completely, fixed with respect to its vertical position. The at least one mean distance is advantageously set and/or settable to a maximum thickness of the sheets to be transported. The mean distance is preferably settable for each sheet so that, in each case, at least partial fixation in the vertical direction exists while the respective, preferably the at least one, sheet is being positioned in the alignment position, and the respective, preferably the at least one, sheet at least partially has freedom of movement in the transport direction and/or orthogonal to the transport direction.

The distance between the at least one upper holder and the at least one lower holder is advantageously varied by at least one cam disk being scanned by at least one scanning element. Using a transmission shaft, which is advantageously eccentrically mounted in an adjusting shaft, the mean distance between the at least one upper holder and the at least one lower holder is advantageously set. The axis of rotation of the transmission shaft is advantageously adjusted relative to the axis of rotation of the adjusting shaft, preferably prompted by at least one servo drive, whereby the preferably upper holder and/or the lower holder are advantageously raised and/or lowered. Advantageously, the position of a scanning element at the at least one cam disk is preferably almost not influenced by an adjustment of the axis of rotation of the transmission shaft relative to the axis of rotation of the adjusting shaft.

Further advantages are apparent from the following description.

BRIEF DESCRIPTION OF THE DRAWINGS

Exemplary embodiments of the invention are illustrated in the drawings and will be described in greater detail below. The drawings show.

DETAILED DESCRIPTION

Figure 1:
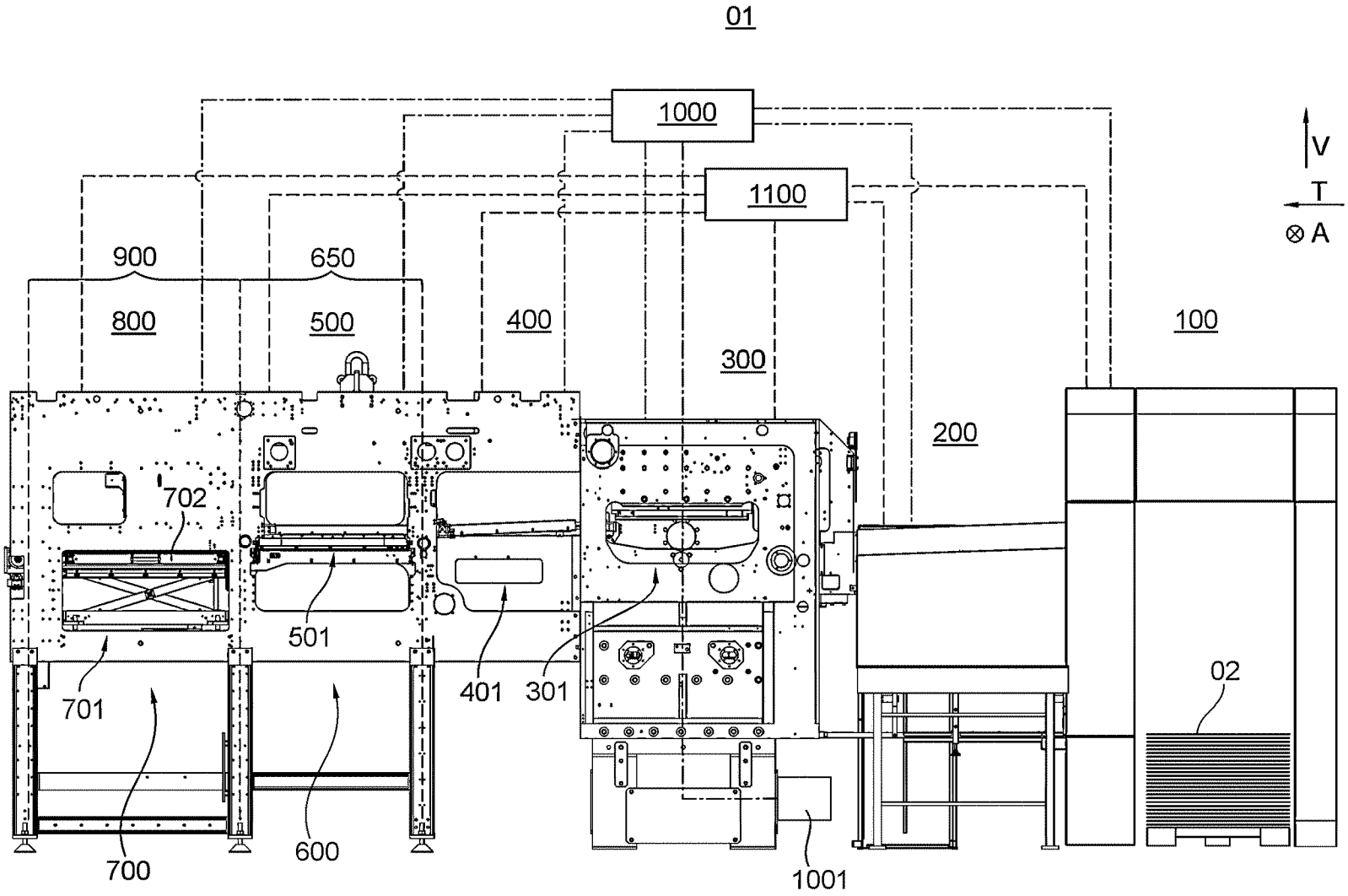
FIG. 1 a schematic representation of a sheet processing machine.
Figure 2:
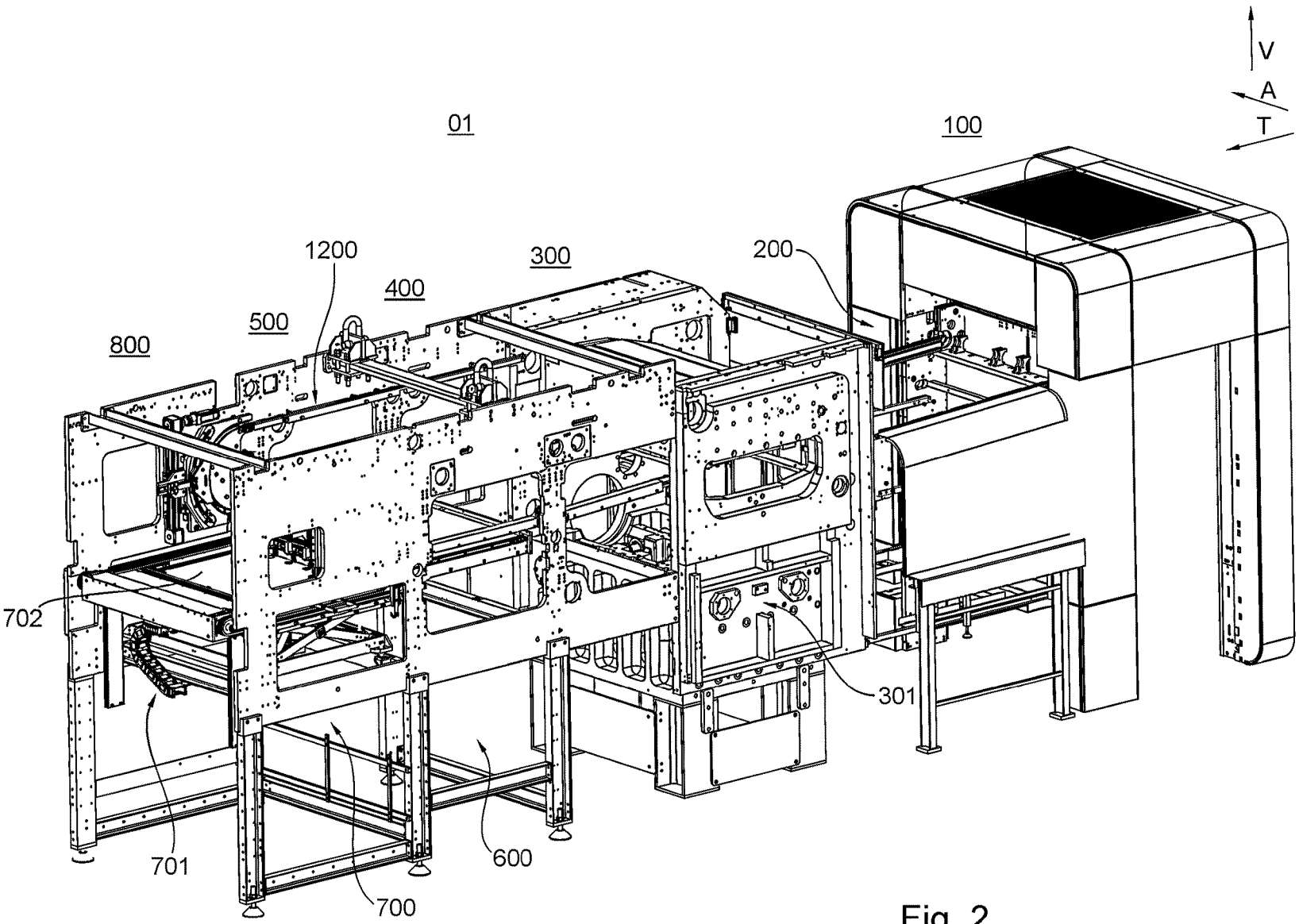
FIG. 2 a schematic perspective illustration of a sheet processing machine.
Figure 3:
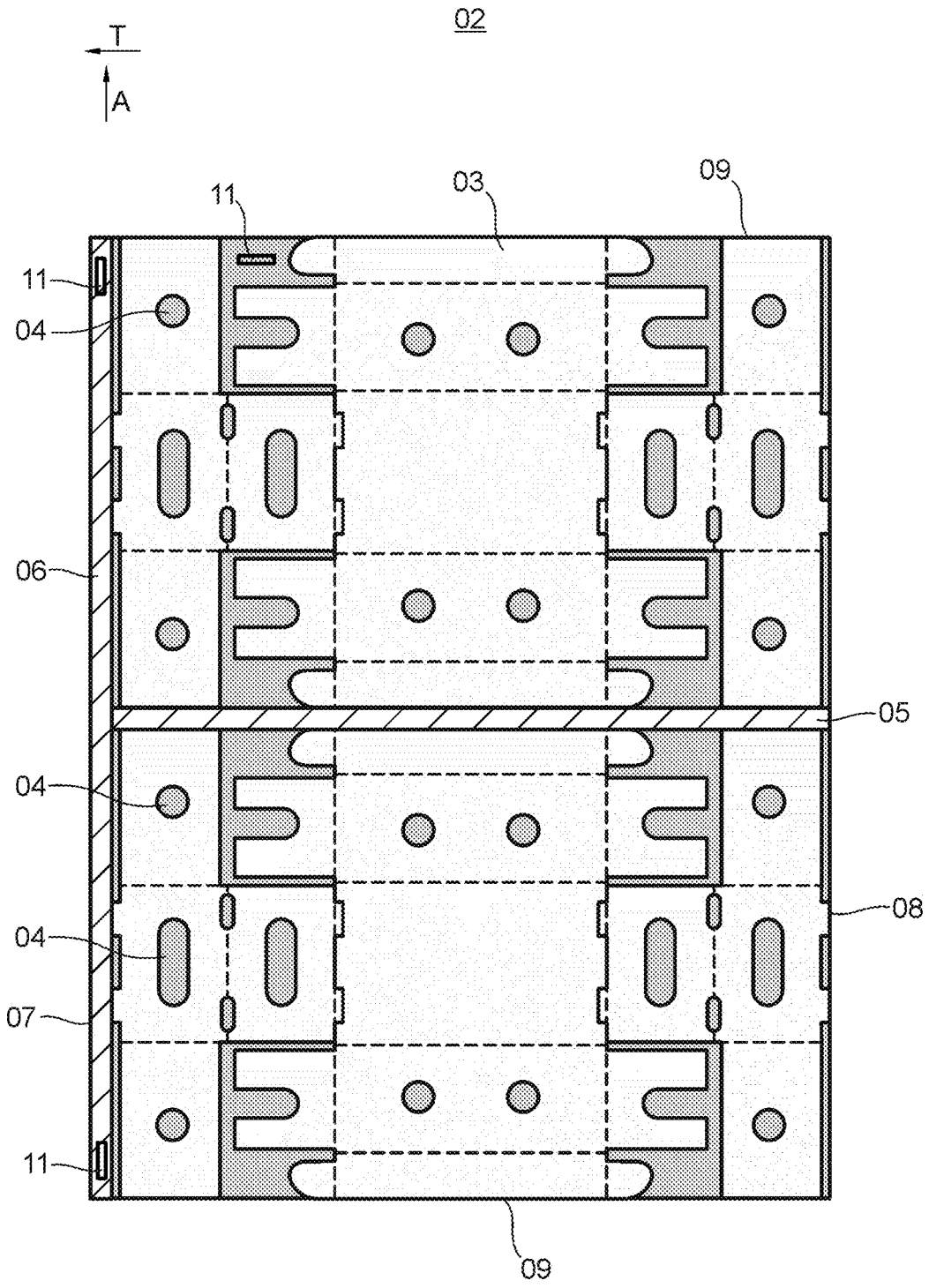
FIG. 3 a schematic illustration of a sheet including several multiple-up copies.
Figure 4:
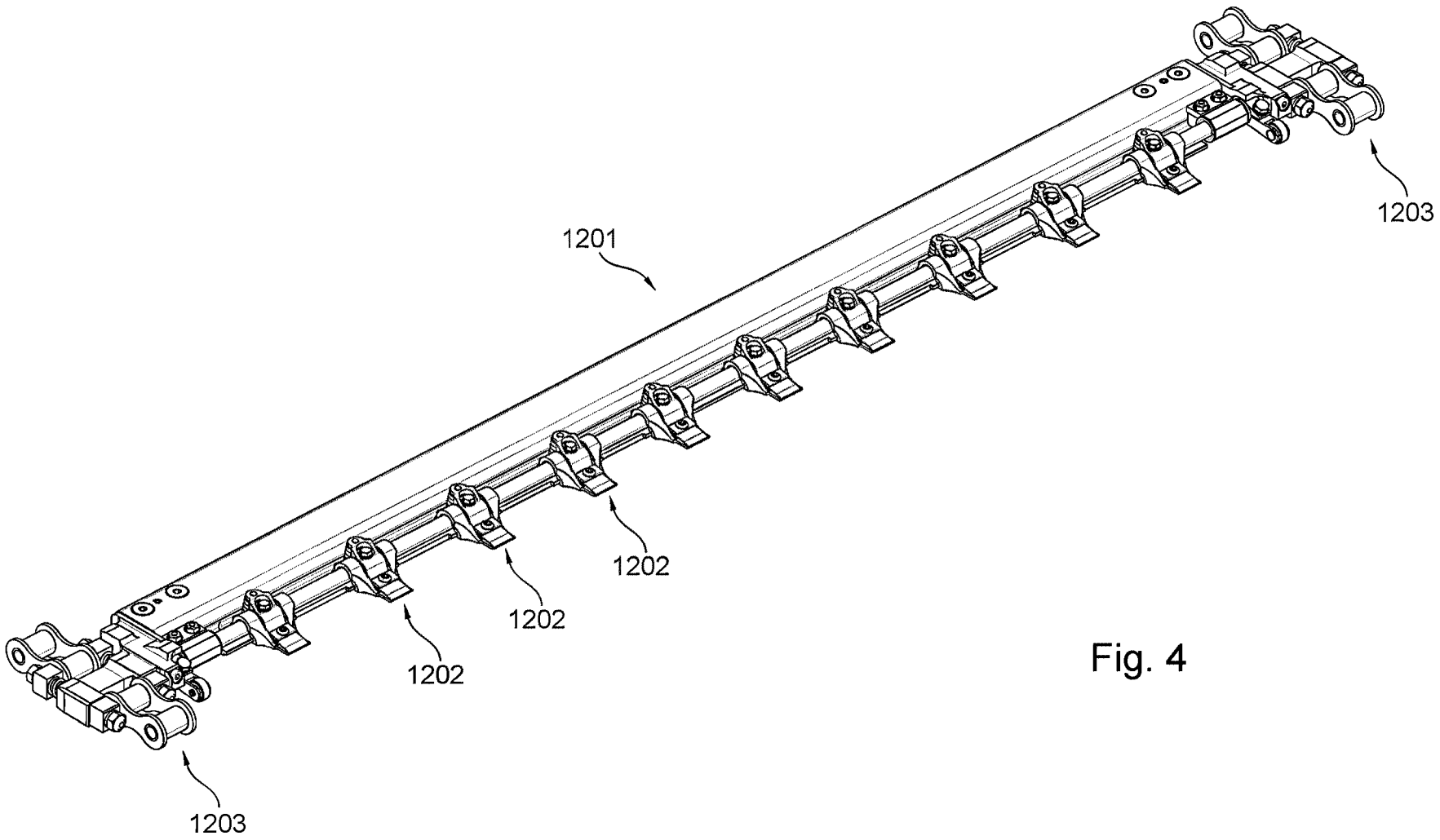
FIG. 4 a perspective illustration of an exemplary gripper carriage of a chain transport system.
Figure 5:
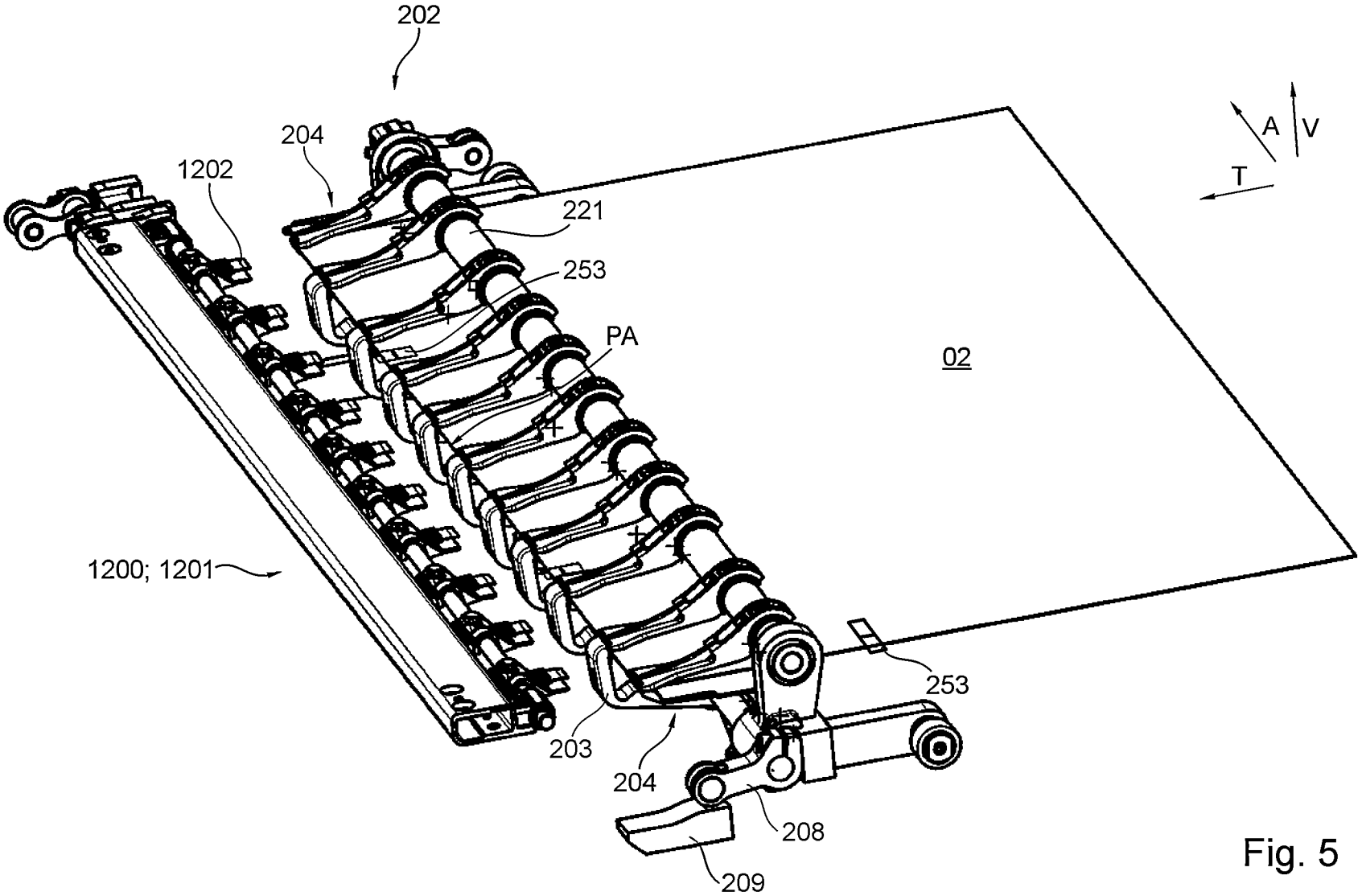
FIG. 5 a perspective illustration of a possible embodiment of a portion of the infeed system and of a portion of the downstream transport system in the transport direction, including a sheet arranged in the alignment position.
Figure 6:
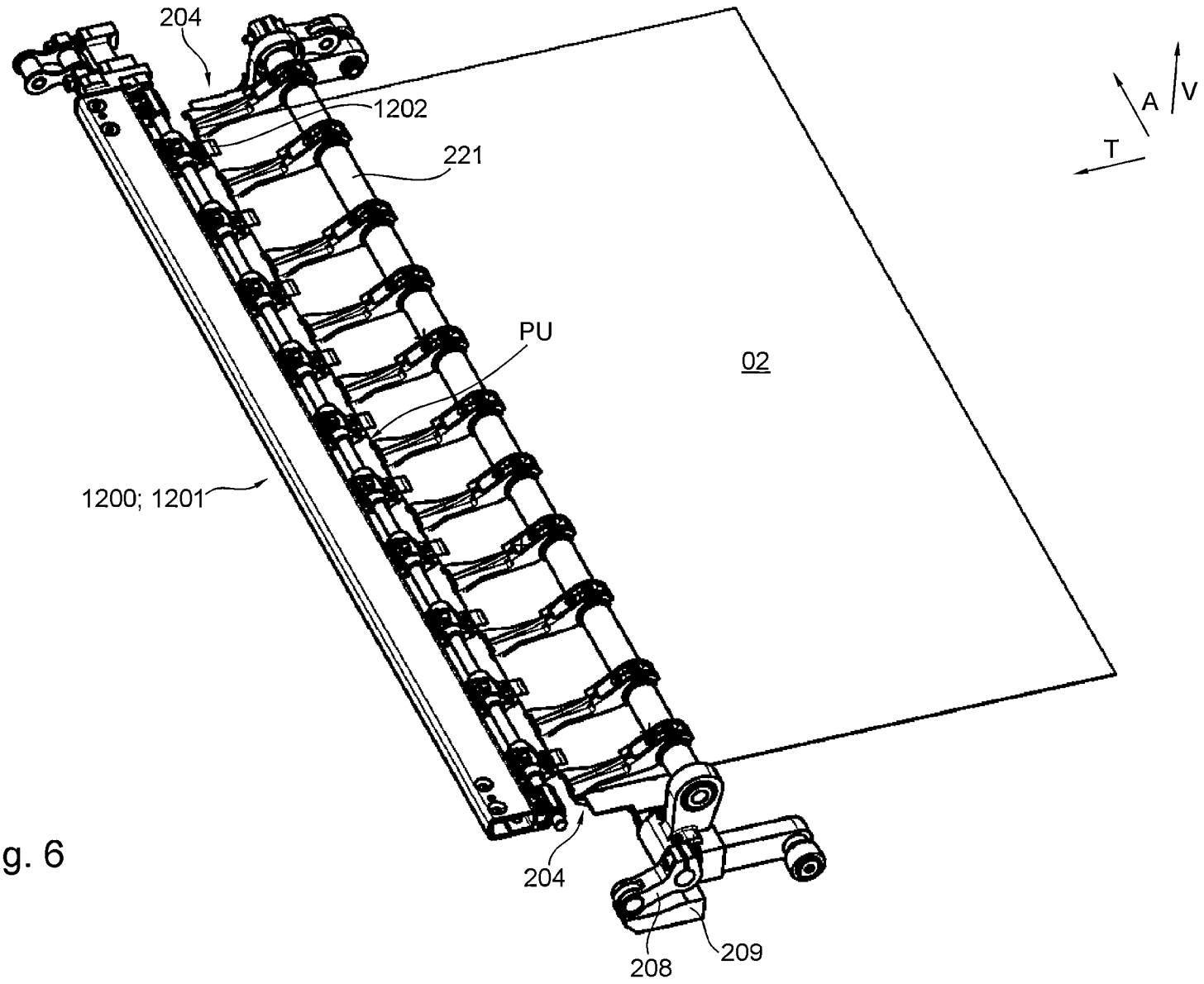
FIG. 6 a perspective illustration of a possible embodiment of a portion of the infeed system and of a portion of the downstream transport system in the transport direction, including a sheet arranged in the transfer position.
Figure 7:
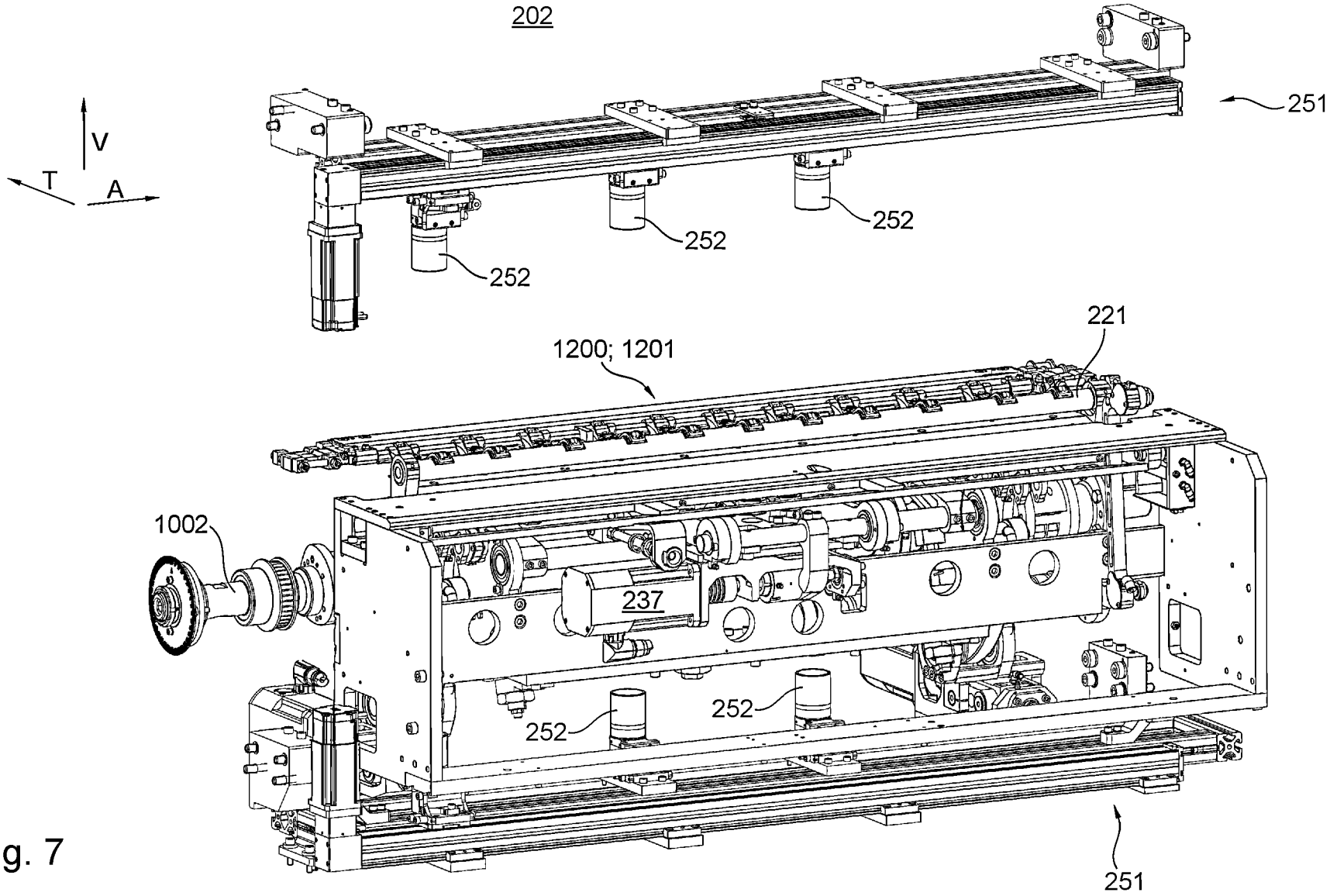
FIG. 7 a perspective illustration of a possible embodiment of the infeed system comprising two sensor devices.
Figure 8:
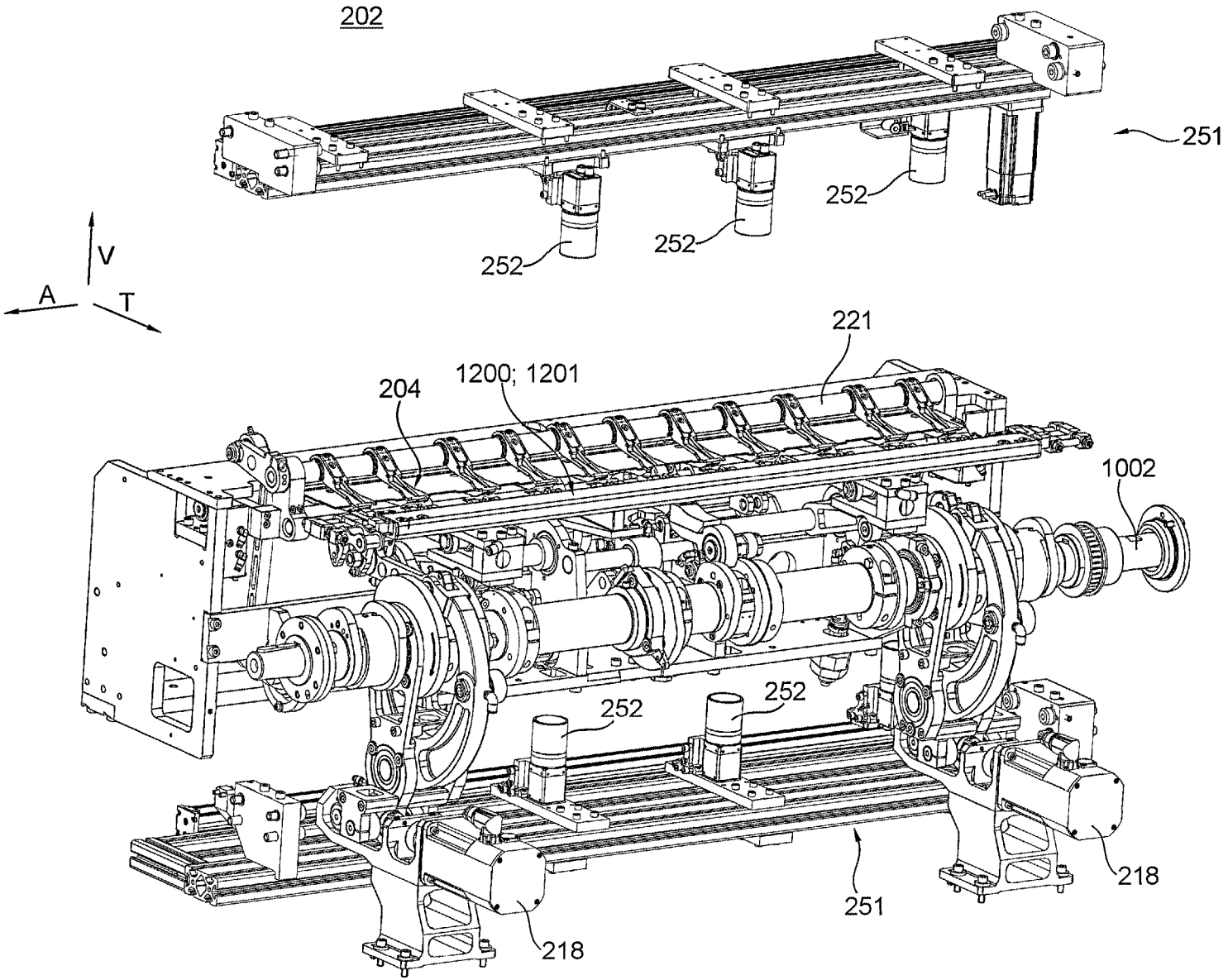
FIG. 8 another perspective illustration of the embodiment from FIG. 7.
Figure 9:
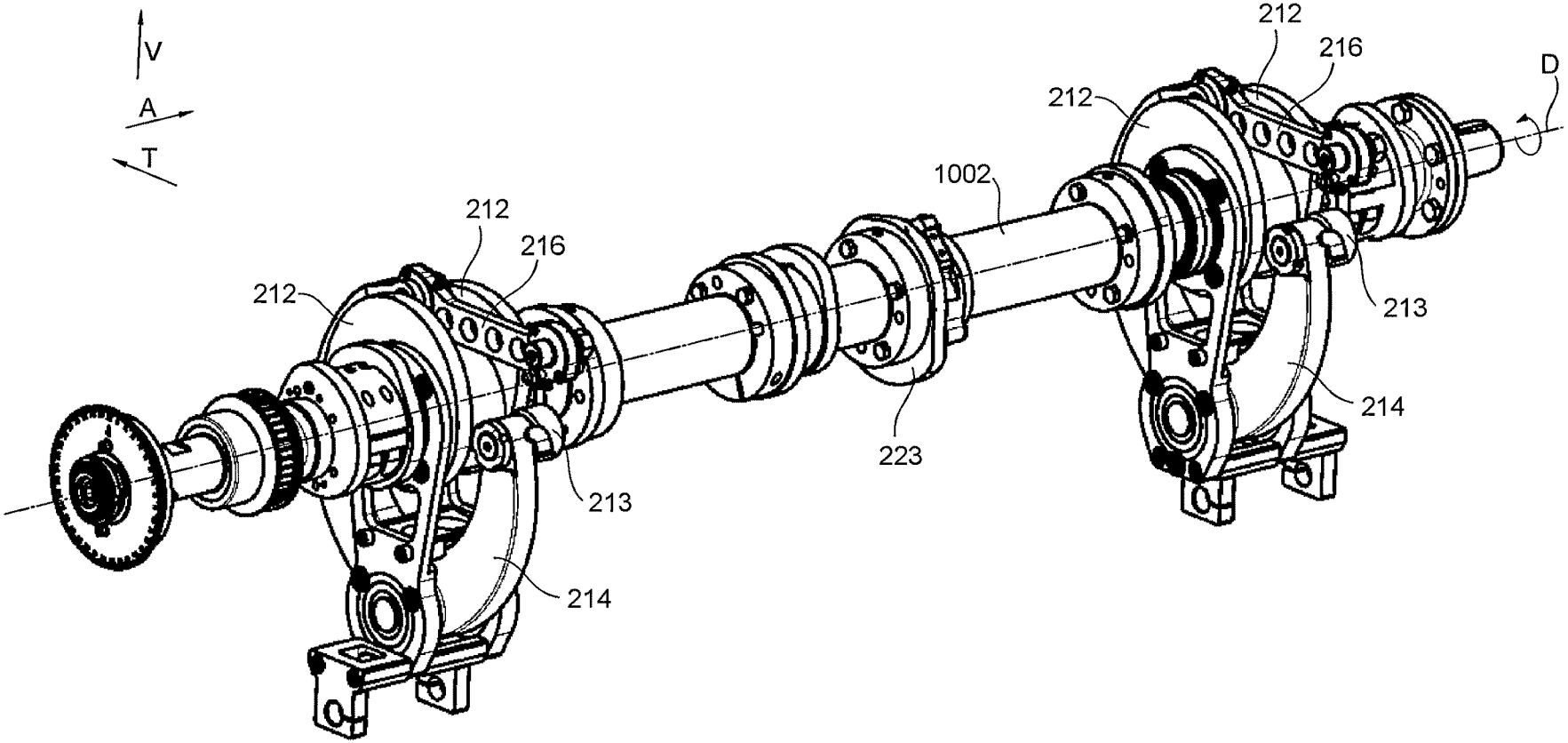
FIG. 9 a perspective illustration of a possible embodiment of a drive shaft comprising multiple cam disks.
Figure 10:
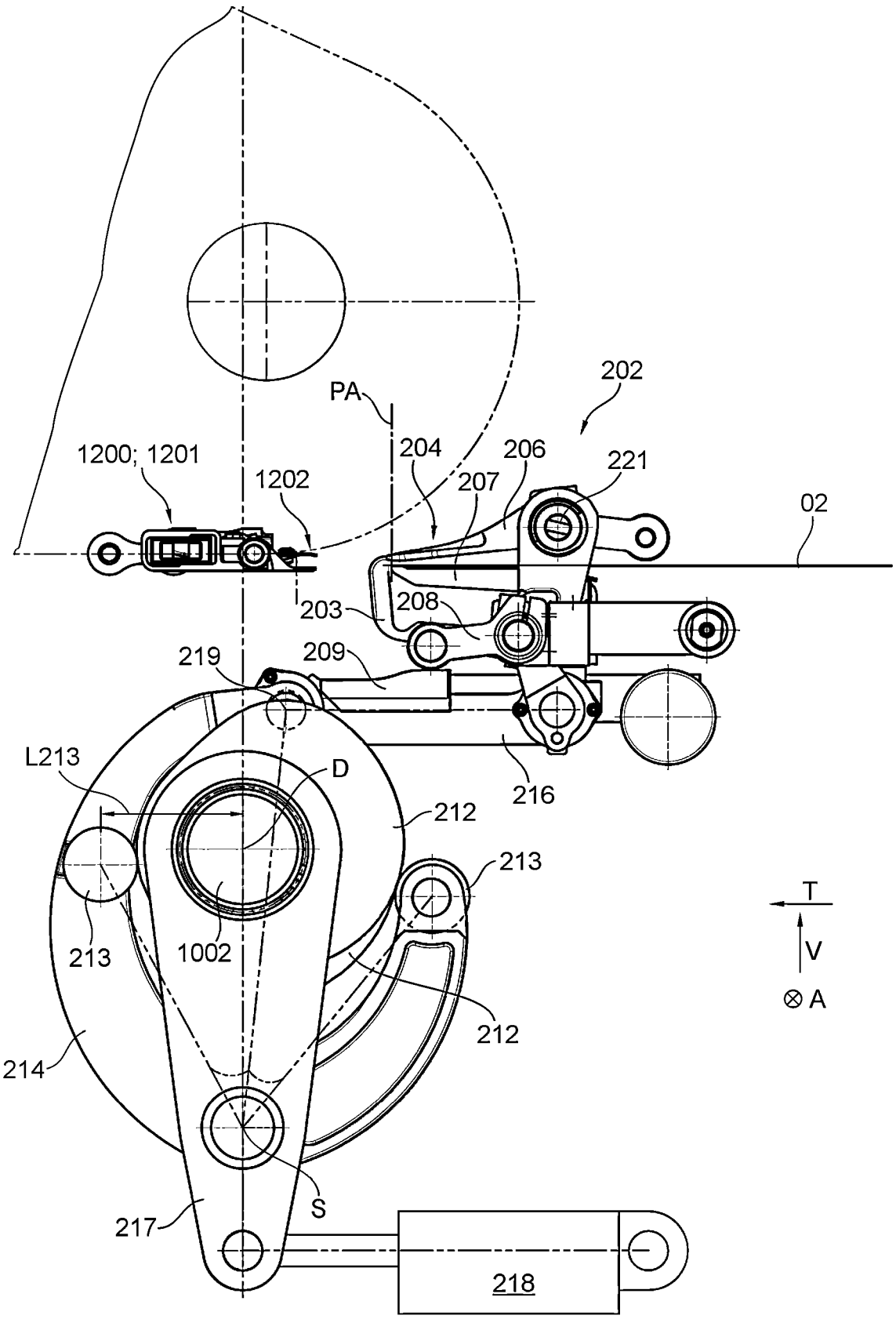
FIG. 10 a schematic infeed system comprising a cam mechanism assigned to the transport movement, and a transport means arranged in the alignment position.
Figure 11:
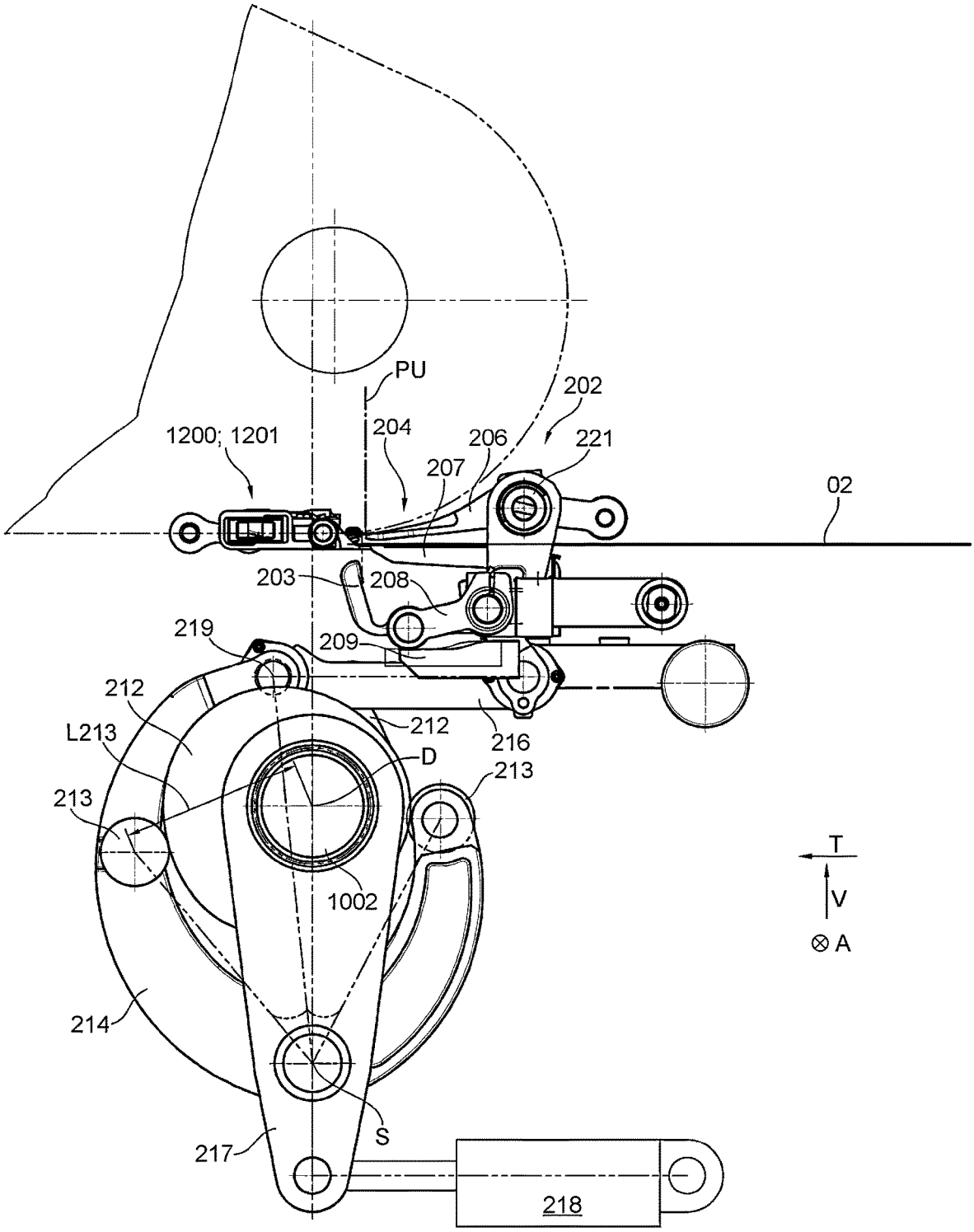
FIG. 11 a schematic infeed system comprising a cam mechanism assigned to the transport movement, and a transport means arranged in the transfer position.
Figure 12:
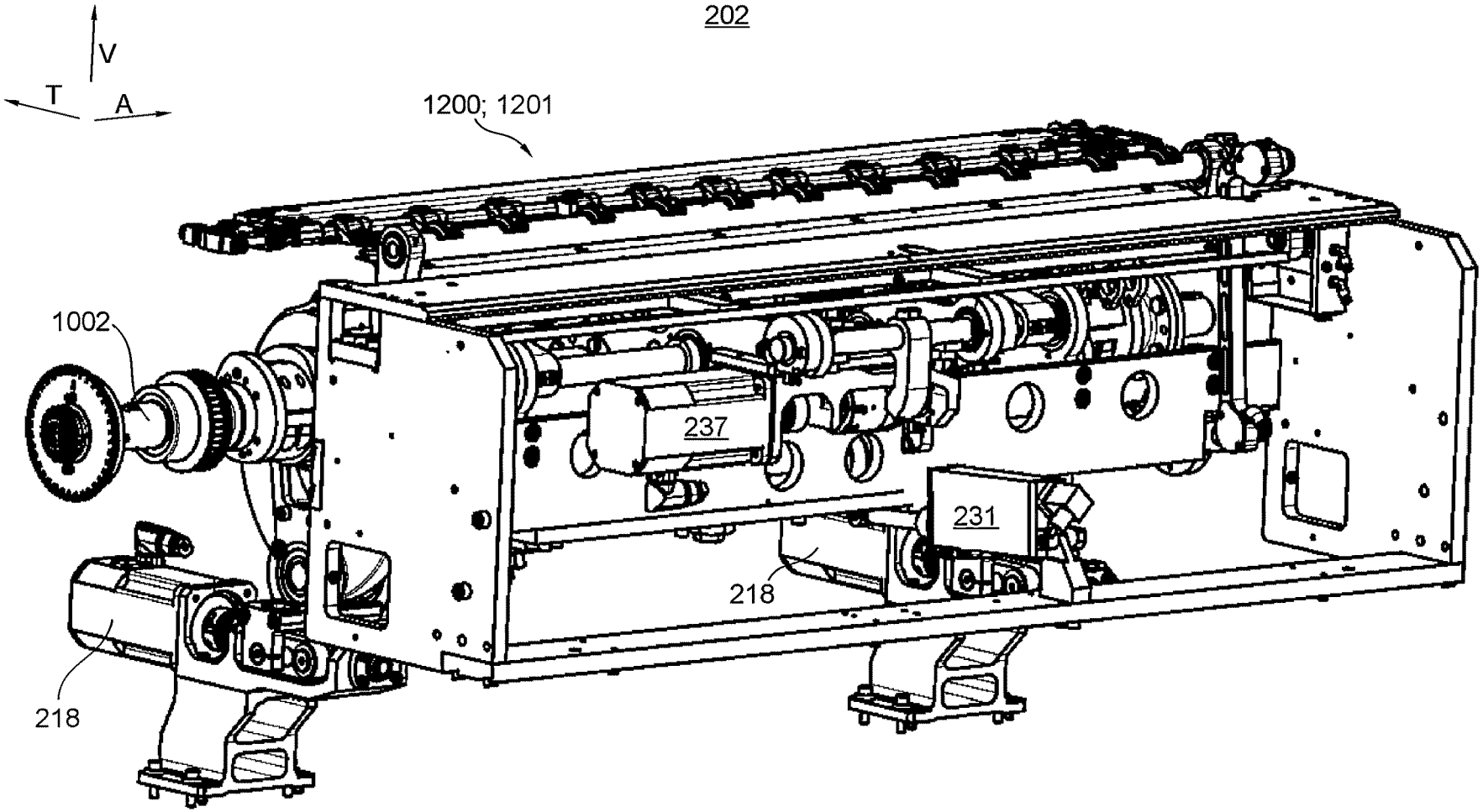
FIG. 12 a perspective illustration of a possible embodiment of an infeed system comprising multiple servo drives.
Figure 13:
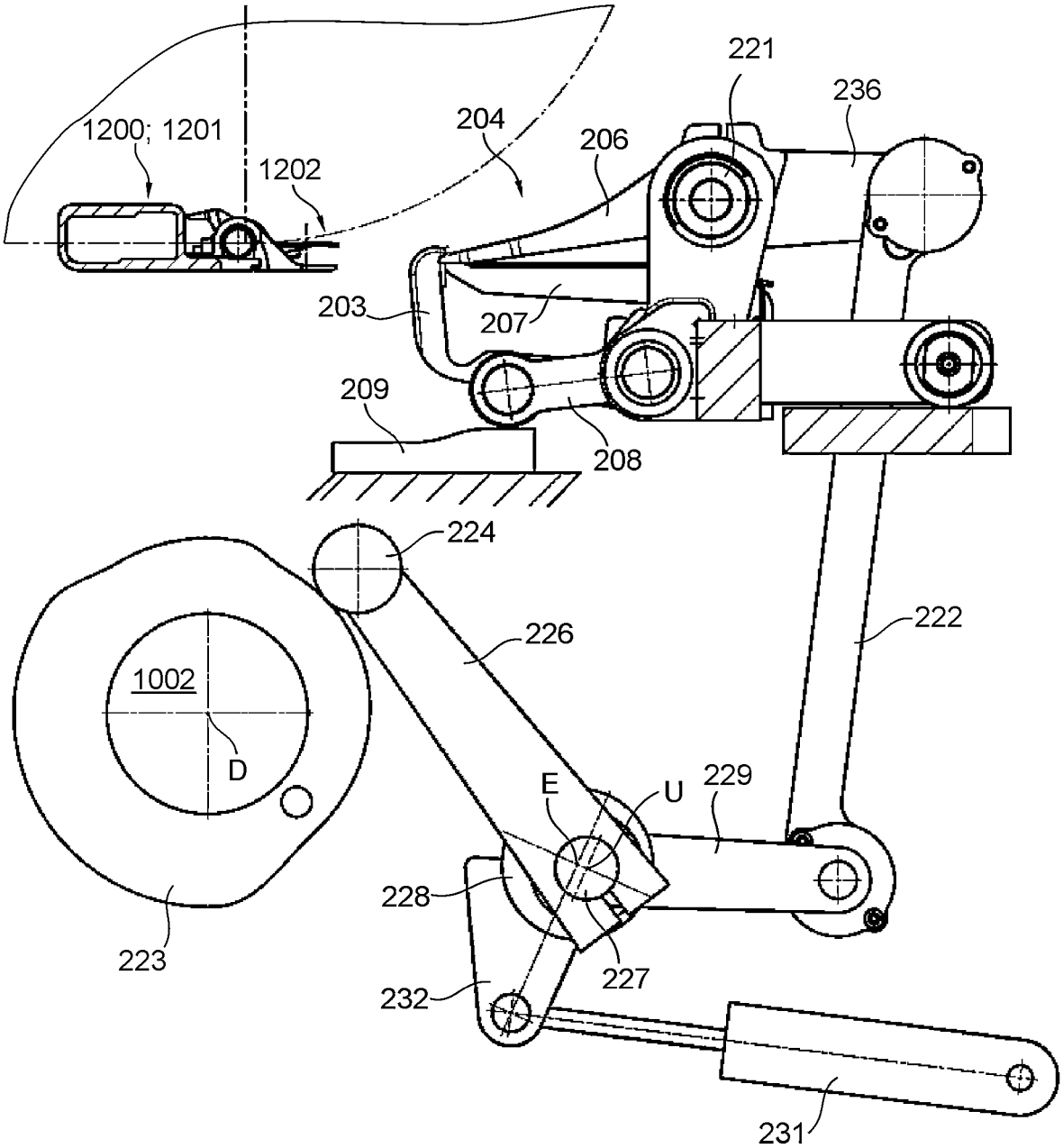
FIG. 13 a schematic illustration of an infeed system comprising a cam mechanism having a minimal distance of the holding surfaces of the at least one holder with respect to one another.
Figure 14:
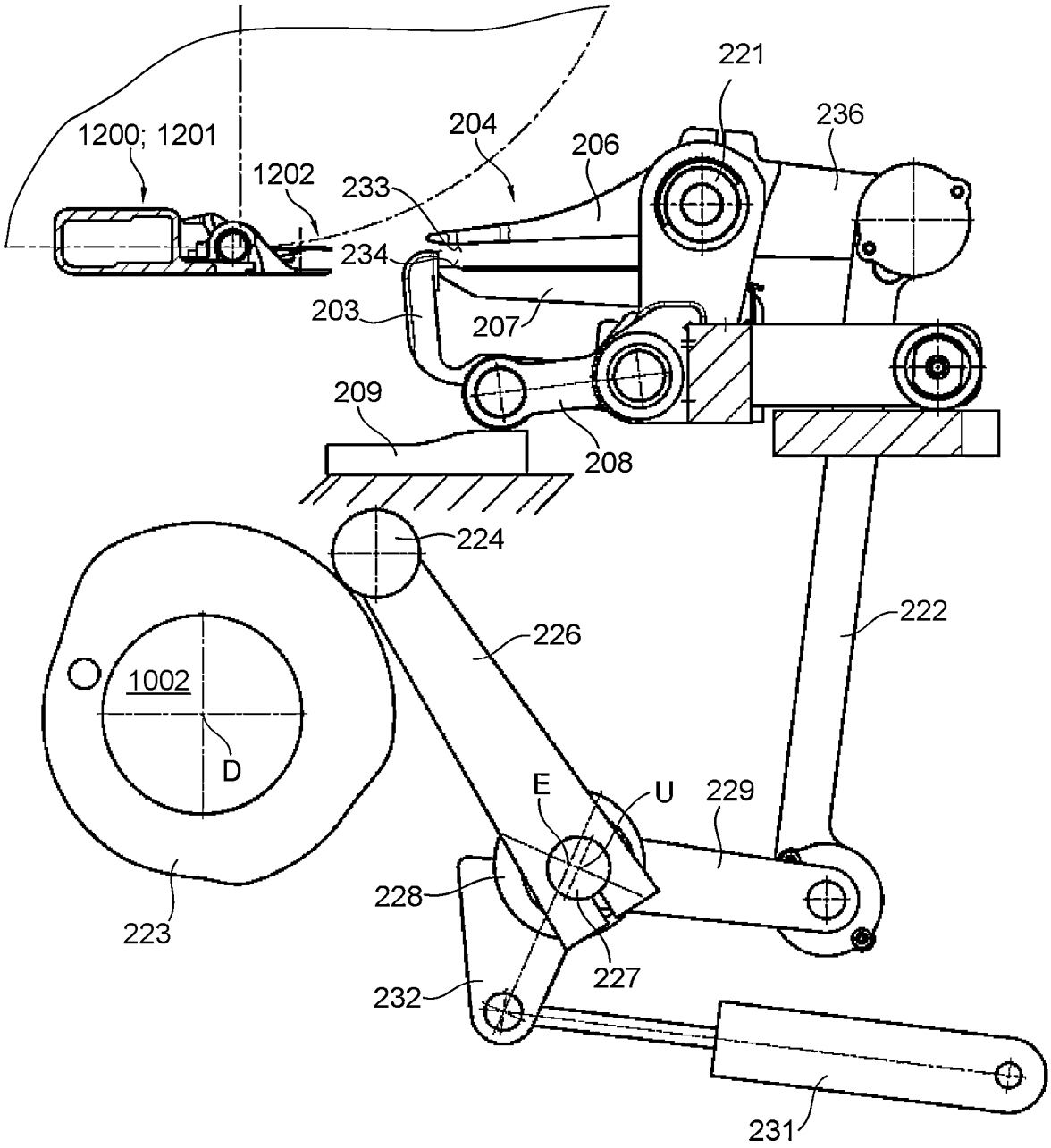
FIG. 14 a schematic illustration of an infeed system comprising a cam mechanism having a maximal distance of the holding surfaces of the at least one holder with respect to one another.
Figure 15:
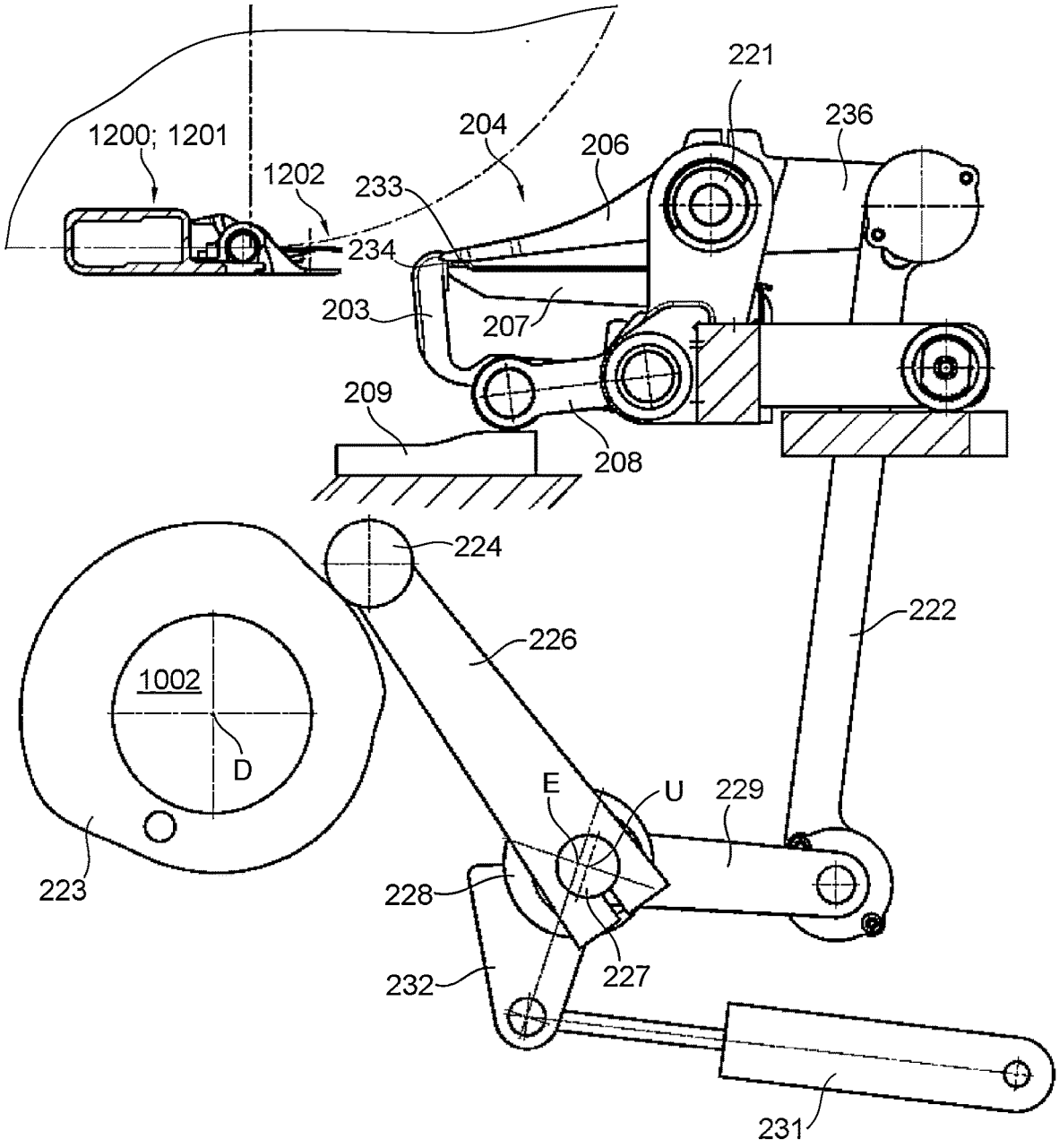
FIG. 15 a schematic illustration of an infeed system comprising a cam mechanism having an average distance of the holding surfaces of the at least one holder with respect to one another for a first thickness of sheets in the vertical direction.
Figure 16:
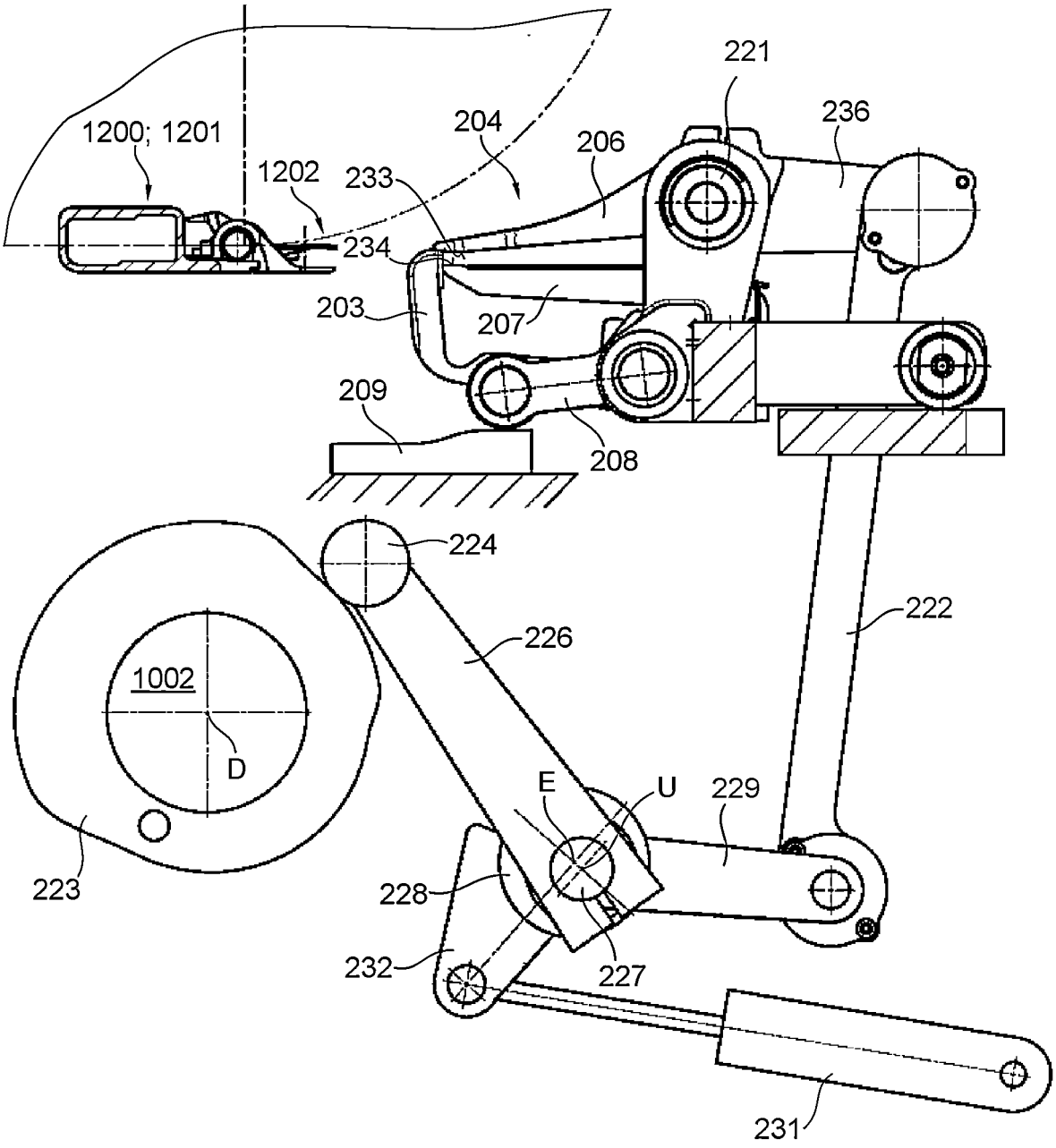
FIG. 16 a schematic illustration of an infeed system comprising a cam mechanism having an average distance of the holding surfaces of the at least one holder with respect to one another for a second thickness of sheets in the vertical direction.
Figure 17:
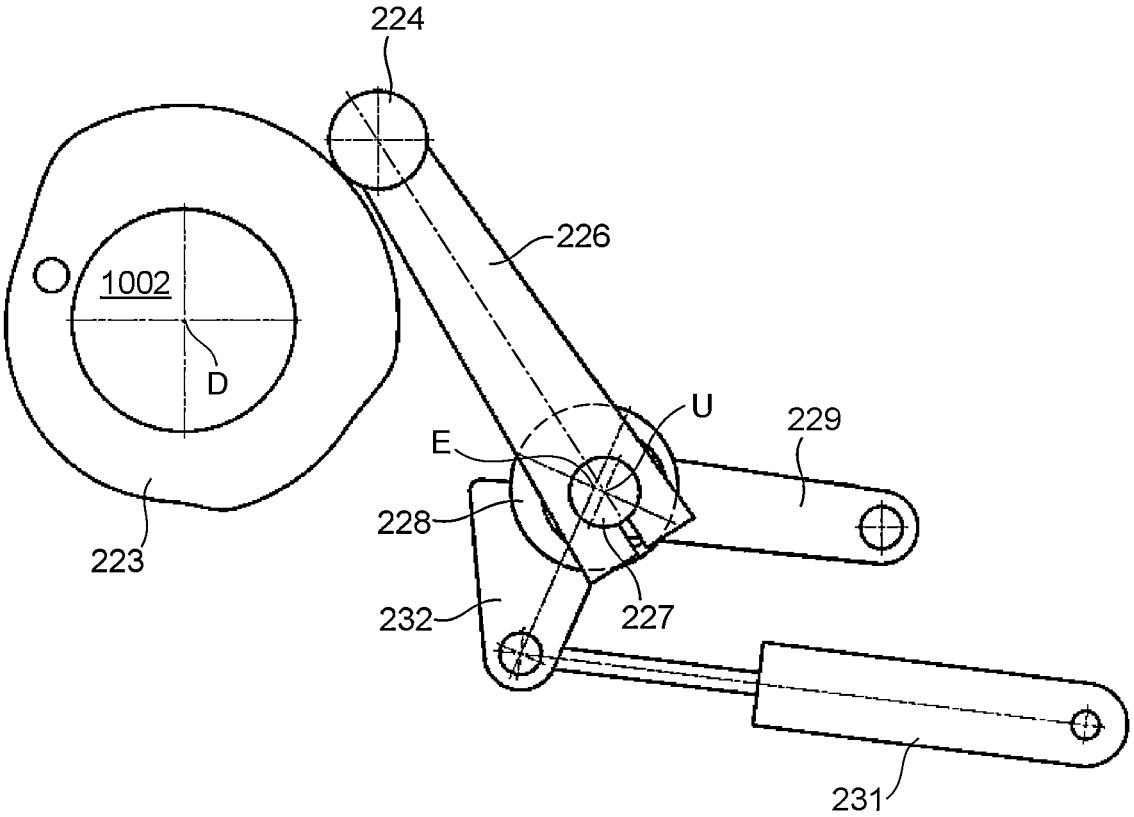
FIG. 17 a schematic illustration of an adjusting shaft comprising a transmission shaft eccentrically arranged therein.
Figure 18:
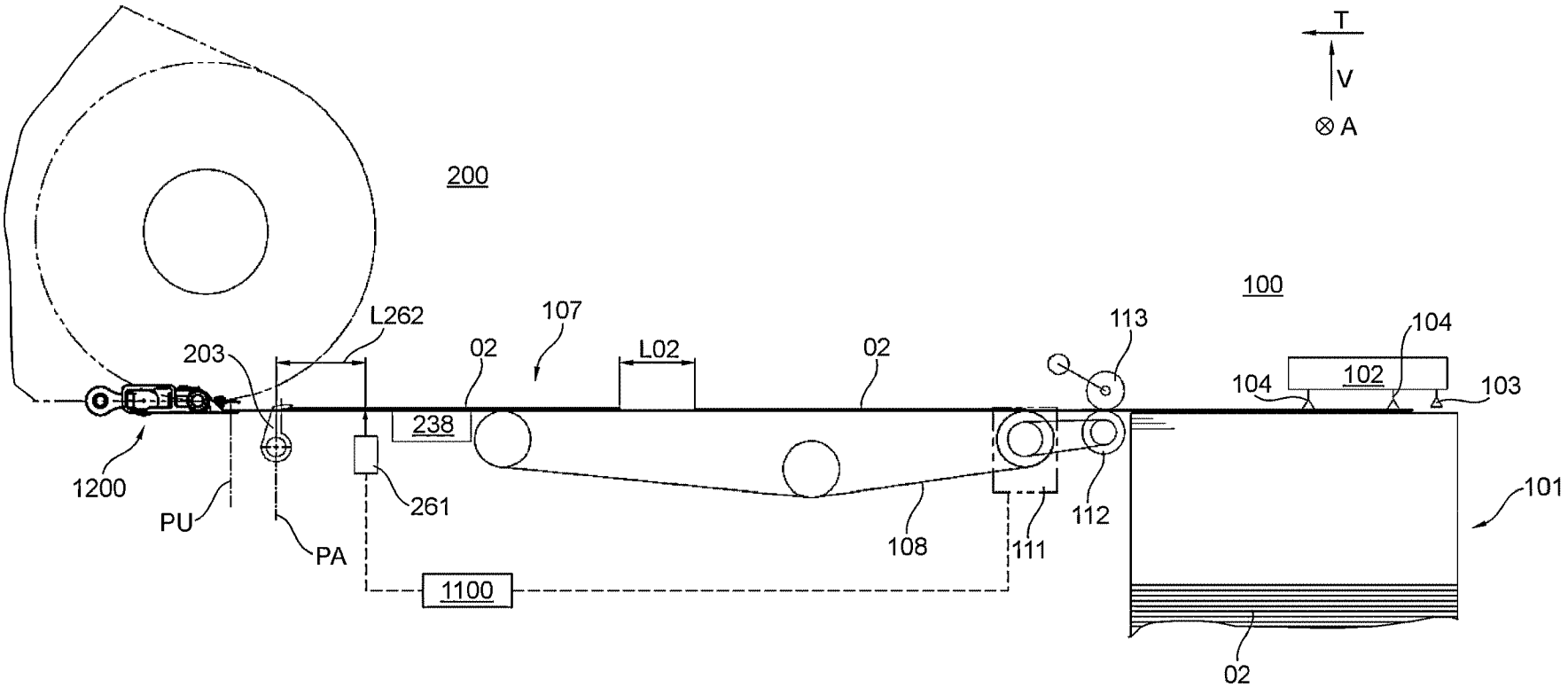
FIG. 18 a schematic illustration of a feeder unit and of an infeed unit.
Figure 19:
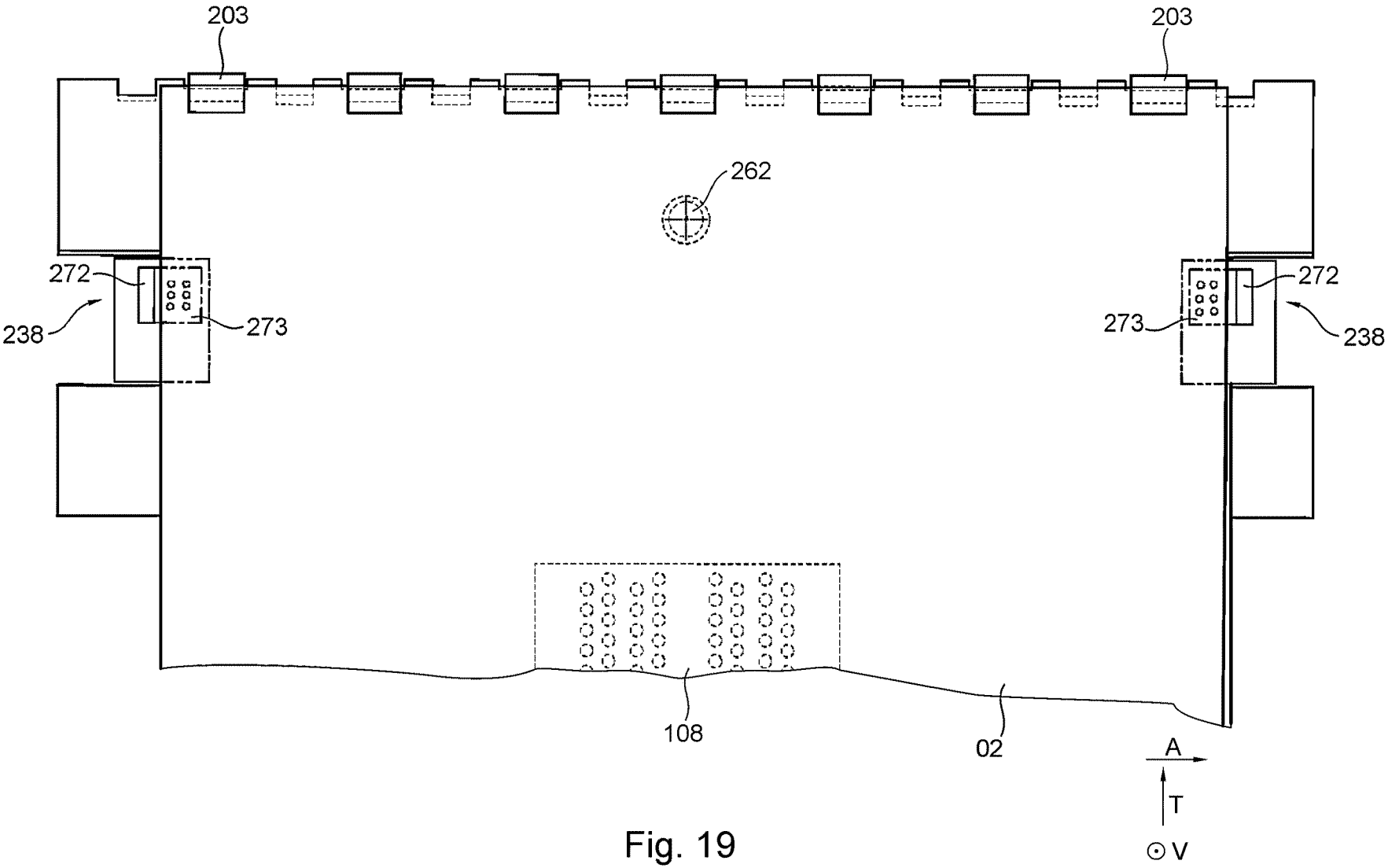
FIG. 19 a schematic illustration of a portion of an infeed unit in a top view.
Figure 22:
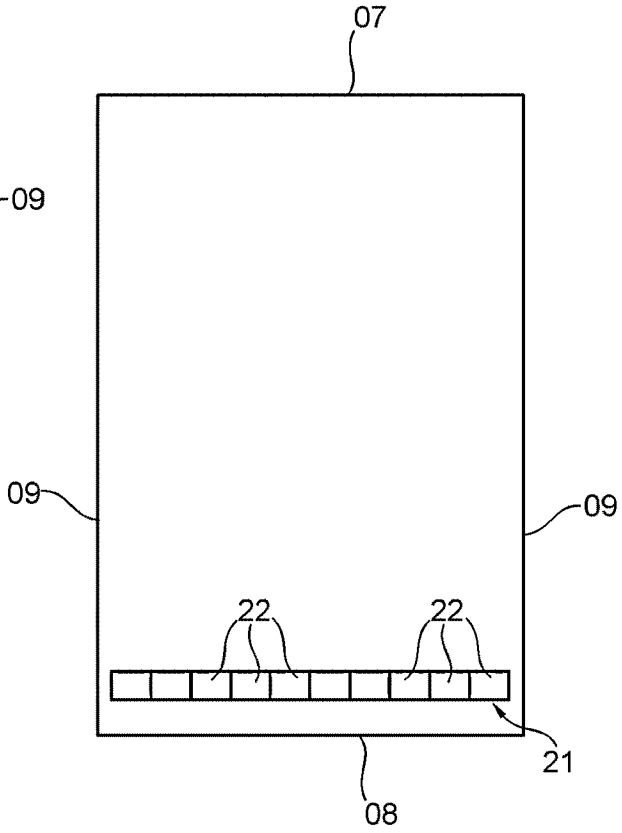
FIG. 22 a schematic illustration of an arrangement of a print control strip in the region of a trailing edge on a sheet.
Figure 21:
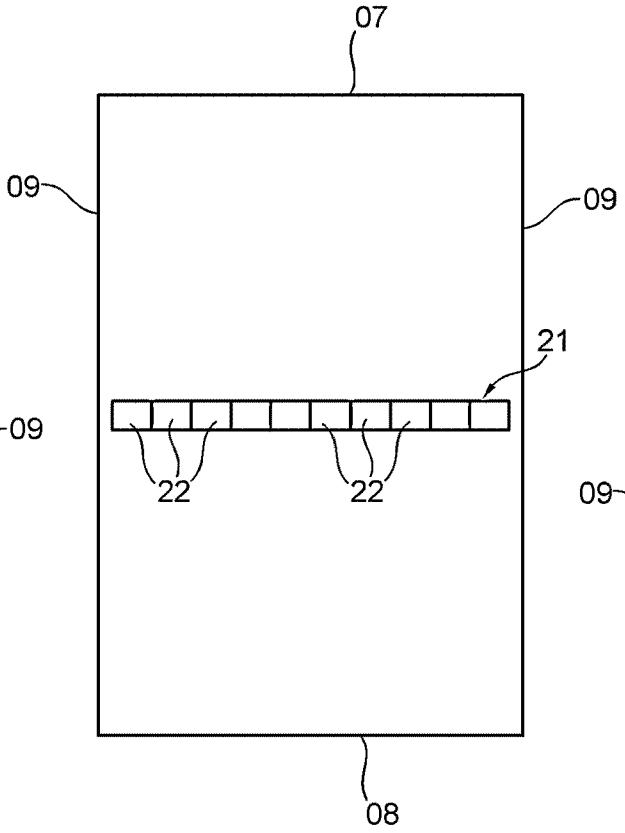
FIG. 21 a schematic illustration of an arrangement of a print control strip on a sheet in a region of a sheet center.
Figure 20:
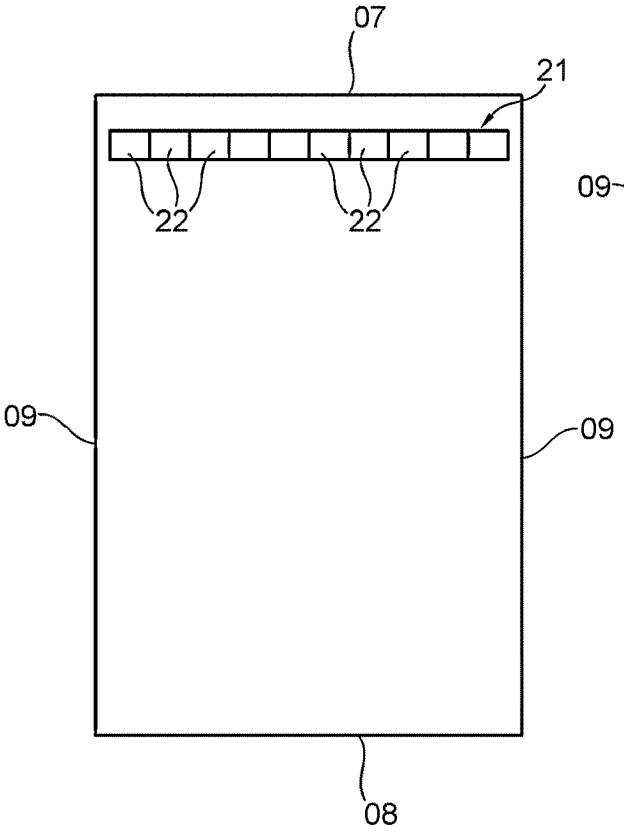
FIG. 20 a schematic illustration of an arrangement of a print control strip in the region of a leading edge on a sheet.

A processing machine 01 is preferably configured as a sheet processing machine 01, in particular as a die-cutting machine 01, more preferably as a flat-bed die-cutting machine 01, for processing sheet-like substrate 02 or sheets 02. Above and below, processing machine 01 and/or sheet processing machine 01 also refers to die-cutting machine 01. The processing machine 01 comprises at least one unit 100; 200; 300; 400; 500; 600; 650; 700; 800; 900, preferably a multiplicity of units 100; 200; 300; 400; 500; 600; 650; 700; 800; 900. The processing machine 01, in particular the sheet processing machine 01, preferably comprises at least one unit 300, configured as a shaping unit 300, for processing sheets 02.

Unless an explicit distinction is made, the term sheet-like substrate 02, specifically the term sheet 02, shall generally be understood to encompass any planar substrate 02 that is present in section, i.e., also substrate 02 present in panel- or boards-shaped form, i.e., also panels or boards. The sheet-like substrate 02 or the sheet 02 thus defined is made, for example, of cardboard and/or corrugated cardboard, i.e., cardboard sheets and/or corrugated cardboard sheets, or sheets, panels or possibly boards made of plastic, cardboard, glass, wood, or metal. The sheet-like substrate 02 is more preferably paper and/or paperboard, in particular paper and/or paperboard sheets. Above and below, the term sheet 02 refers, in particular, both to sheets 02 that were not yet processed by means of at least one unit 300; 400; 500; 650, and to sheets 02 that were already processed by means of at least one unit 300; 400; 500; 650 and, in the process, were potentially modified in terms of their shape and/or their mass.

According to DIN 6730 (February 2011), paper is a flat material, consisting mainly of fibers derived from vegetable sources, which is formed by the dewatering of a fiber suspension on a sieve. In the process, a card web is created, which is subsequently dried. The basis weight of paper is preferably a maximum of 225 g/m$^2$ (two hundred twenty-five grams per square meter).

According to DIN 6730 (February 2011), cardboard is a flat material, consisting mainly of fibers derived from vegetable sources, which is formed by the dewatering of a fiber suspension on a sieve or between two sieves. The fiber structure is compressed and dried. Cardboard is preferably manufactured from cellulose by gluing or pressing the cellulose together. Cardboard is preferably configured as solid board or corrugated cardboard. The basis weight of cardboard is preferably more than 225 g/m$^2$ (two hundred twenty-five grams per square meter). Corrugated cardboard is cardboard made of one or more layers of corrugated paper that is glued to one layer or between multiple layers of another, preferably smooth, paper or cardboard.

Above and below, the term paperboard refers to a sheet material that is preferably primed on one side and made of paper, having a basis weight of at least 150 g/m$^2$ (one hundred fifty grams per square meter) and no more than 600 g/m$^2$ (six hundred grams per square meter). Paperboard preferably has high strength relative to paper.

A sheet 02 to be worked preferably has a grammage of at least 70 g/m$^2$ (seventy grams per square meter) and/or of no more than 700 g/m$^2$ (seven hundred grams per square meter), preferably no more than 500 g/m$^2$ (five hundred grams per square meter), more preferably no more than 200 g/m$^2$ (two hundred grams per square meter). A sheet 02 to be worked preferably has a thickness of no more than 1 cm (one centimeter), preferably no more than 0.7 cm (zero point seven centimeters), more preferably no more than 0.5 cm (zero point five centimeters), more preferably no more than 0.3 cm (zero point three centimeters).

The at least one substrate 02 preferably comprises at least one multiple-up 03, preferably at least two multiple-ups 03. The at least one substrate 03 preferably comprises at least one offcut piece 04; 05; 06. The at least one multiple-up 03 preferably has at least one print image.

Above and below, the term multiple-up 03 preferably refers to the number of identical and/or different objects that are produced from the same piece of material and/or are arranged on shared substrate material, for example a shared sheet 02. A multiple-up 03 is preferably the region of a sheet 02 that is either configured as a product of the sheet processing machine 01, in particular as an intermediate product for producing an end product, and/or, for example, is further worked and/or is configured to be further workable into a desired or required end product. The desired or required end product here, which is preferably generated by further working the respective multiple-up 03, is preferably a packaging, in particular a folding box.

Above and below, an offcut piece 04; 05; 06 is the region of a sheet 02 that does not conform to any blank 03. Collected offcut pieces 04; 05; 06 are preferably referred to as scrap. An offcut piece 04; 05; 06 is preferably configured and/or removable as trim-off and/or broken-off pieces. During the operation of the sheet processing machine 01, the at least one offcut piece 04; 05; 06 is preferably generated in at least one shaping unit 300, preferably by at least one processing step of the respective sheet 02, for example in at least one die-cutting process. During the operation of the sheet processing machine 01, the at least one offcut piece 04; 05; 06 is preferably at least partially removed from the respective sheet 02, and is thus, in particular, separated from the respective blank 03 of the sheet 02. Preferably, at least one unit 400 configured as a stripping unit 400 is configured to remove at least one first offcut piece 04, in particular at least one scrap piece 04, and/or is configured to remove at least one scrap piece 04. Preferably, at least one unit 500 configured as a multiple-up separating unit 500 is configured to remove at least one second offcut piece 06, in particular at least one gripper edge 06, and/or is configured to remove at least one gripper edge 06. For example, a sheet 02 comprises an offcut piece 05 configured as a crosspiece 05. In particular, the blanks 03 are spaced apart from one another by the at least one crosspiece 05.

The spatial area provided for transporting a sheet 02, which the sheet 02, if present, at least temporarily occupies, is the transport path. The transport path is established, at least in a section, by at least one component of a system 1200 configured as a transport system 1200.

A transport direction T is a direction T which is intended for a shaping operating mode of at least one shaping unit 300 of the processing machine 01 and in which the sheet 02, if present, is transported at each point of the transport path. The transport direction T intended, in particular, for transporting sheets 02 is a direction T that is preferably oriented at least substantially horizontally, and more preferably completely horizontally. In addition or as an alternative, the transport direction T preferably points from a first unit 100 of the processing machine 01 to a last unit 800; 900 of the processing machine 01. In particular, the transport direction T points from a unit 100, in particular a feeder unit 100, on the one hand to a unit 600, in particular to a delivery unit 600, on the other hand. In addition or as an alternative, the transport direction T preferably points in a direction in which the sheets 02 are transported, apart from vertical movements or vertical components of movements, in particular from a first contact with a unit 200; 300; 400; 500; 600; 650; 700; 800; 900 of the processing machine 01 arranged downstream from the feeder unit 100 or a first contact with the processing machine 01 to a last contact with the processing machine 01. The transport direction T is preferably the direction T in which a horizontal component points in a direction that is oriented from the feeder unit 100 to the delivery unit 600. The transport direction T preferably points from a feeder side to a delivery side.

The feeder side preferably corresponds to the end face of the sheet processing machine 01, preferably the side on which the at least one feeder unit 100 is arranged. The side of the sheet processing machine 01 located opposite the feeder side preferably corresponds to the delivery side. In particular, the last unit 800; 900 of the sheet processing machine 01, preferably the at least one joint unit 900 and/or the at least one offcut piece delivery unit 800 are arranged on the delivery side. The feeder side and the delivery side are preferably arranged parallel to a direction A, in particular a transverse direction A, and a working width.

The transverse direction A is preferably a horizontally extending direction A. The transverse direction A is oriented orthogonally to the intended transport direction T of the sheets 02 and/or orthogonally to the intended transport path of the sheets 02 through the at least one unit 100; 200; 300; 400; 500; 600; 650; 700; 800; 900 of the processing machine 01. The transverse direction A is preferably oriented from an operator side of the processing machine 01 to a drive side of the processing machine 01.

A vertical direction V is preferably the direction V that is arranged orthogonally to a plane spanned by the transport direction T and the transverse direction A. The vertical direction V is preferably oriented perpendicularly from the bottom and/or from a base of the processing machine 01 and/or from a bottommost component of the processing machine 01 toward the top and/or to an uppermost component of the processing machine 01 and/or to an uppermost cover of the processing machine 01.

The operator side of the processing machine 01 is preferably the side of the processing machine 01, parallel to the transport direction T, from which an operator, at least partially and at least temporarily, has access to the individual units 100; 200; 300; 400; 500; 600; 650; 700; 800; 900 of the processing machine 01, for example during maintenance work and/or when replacing at least one shaping tool.

The drive side of the processing machine 01 is preferably the side of the processing machine 01, parallel to the transport direction T, which is located opposite the operator side. The drive side preferably comprises at least portions, preferably at least a majority, of a system 1000, in particular of a drive system 1000.

Above and below, the working width is the maximum width that a sheet 02 can have to be able to be transported through the at least one unit 100; 200; 300; 400; 500; 600; 650; 700; 800; 900, in particular the respective units 100; 200; 300; 400; 500; 600; 650; 700; 800; 900, of the processing machine 01, and/or to still be able to be worked by way of the at least one shaping unit 300 of the processing machine 01; this thus corresponds to the maximum width of the respective sheet 02 that can be worked by way of the at least one shaping unit 300 of the processing machine 01. The working width of the processing machine 01, in particular sheet processing machine 01, is preferably at least 30 cm (thirty centimeters), more preferably at least 50 cm (fifty centimeters), still more preferably at least 80 cm (eighty centimeters), still more preferably at least 120 cm (one hundred twenty centimeters), and still more preferably at least 150 cm (one hundred fifty centimeters).

The sheet 02 to be processed preferably has a sheet width, preferably parallel to the transverse direction A, of at least 200 mm (two hundred millimeters), preferably at least 300 mm (three hundred millimeters), more preferably at least 400 mm (four hundred millimeters). The sheet width is preferably no more than 1,500 mm (one thousand five hundred millimeters), more preferably no more than 1,300 mm (one thousand three hundred millimeters), still more preferably no more than 1,060 mm (one thousand sixty millimeters). A sheet length, preferably parallel to the transport direction A, is, for example, at least 150 mm (one hundred fifty millimeters), preferably at least 250 mm (two hundred fifty millimeters), more preferably at least 350 mm (three hundred fifty millimeters). Furthermore, a sheet length is, for example, no more than 1,200 mm (one thousand two hundred millimeters), preferably no more than 1,000 mm (one thousand millimeters), more preferably no more than 800 mm (eight hundred millimeters).

A sheet 02 has multiple edges 07; 08; 09. In particular, an edge 07 configured as a leading edge 07 is located at the front of the sheet 02 in the transport direction, and is arranged parallel to the transverse direction A. In particular, the leading edge 07 is the edge 07 of the respective sheet 02 which can preferably be seized by at least one component of the sheet processing machine 01, in particular by at least one holding element 1202 of the transport system 1200, for transporting the respective sheet 02, and/or at which at least one component of the sheet processing machine 01 seizes the respective sheet 02, in particular by way of the at least one holding element 1202 of the transport system 1200. An edge 08 configured as a trailing edge 08 is preferably arranged opposite the leading edge 07. More preferably, the leading edge 07 and the trailing edge 08 are arranged parallel to one another. In particular, a trailing edge 08 is located at the rear of the sheet 02 in the transport direction T, and is arranged parallel to the transverse direction A. The sheet 02 furthermore has two edges 09 configured as side edges 09. The two side edges 09 are preferably arranged parallel to the transport direction T and orthogonally to the transverse direction A. Each of the side edges 09 is preferably arranged orthogonally to the leading edge 07 and/or to the trailing edge 08 of the sheet 02.

The substrate 02, which is preferably configured as a sheet 02, preferably includes at least one print image. The at least one print image is preferably arranged within the at least one multiple-up 03. Each multiple-up 03 preferably has at least one print image.

Above and below, the print image describes a representation on the sheet 02 which corresponds to the sum of all image elements, with the image elements having been transferred and/or being transferable to the sheet 02 during at least one working stage and/or at least one printing operation, preferably prior to being processed by the processing machine 01. More preferably, the at least one print image is an image representation that is present on a produced end product. The surface of the sheet 02 preferably includes at least one unprinted region, in particular an unprinted edge region. In particular, the at least one holding element 1202 preferably holds the sheet 02 at least at the unprinted edge region of the trailing edge 07, which is configured as an offcut piece 06 and/or a gripper edge 06.

The sheet 02 preferably includes at least one printing mark 11, preferably at least two printing marks 11. Above and below, a printing mark 11 is a mark, preferably for aligning the sheet 02 in the transport direction T and/or in the transverse direction A. The at least one printing mark 11 is preferably configured as a die-cutting mark 11. The at least one printing mark 11 is configured so as to align a substrate 02 in the transport direction T and/or in the transverse direction A. The at least one printing mark 11 is preferably an alignment mark. For example, the at least one printing mark 11 is, additionally or alternatively, configured to monitor a color register and/or a perfecting register.

A unit 100; 200; 300; 400; 500; 600; 650; 700; 800; 900 shall, in each case, preferably be understood to mean a group of devices that functionally cooperate, in particular to be able to carry out a preferably self-contained processing operation of at least one substrate 02. A unit 100; 200; 300; 400; 500; 600; 650; 700; 800; 900 in each case preferably encompasses a machine section of the processing machine 01, which is preferably arranged so as to be at least partially separable from further machine sections.

A system 1000; 1100; 1200 of the processing machine 01 is preferably at least one device that is at least temporarily, in particular permanently, in contact and/or can interact with and/or can be functionally connected to at least one unit 100; 200; 300; 400; 500; 600; 650; 700; 800; 900, preferably at least two different units 100; 200; 300; 400; 500; 600; 650; 700; 800; 900 of the processing machine 01.

The processing machine 01 preferably comprises at least one unit 100 configured as a feeder unit 100. The feeder unit 100 is preferably configured as a feeder 100, more preferably as a sheet feeder 100, more preferably as a sheet feeder unit 100. The feeder unit 100 is preferably configured as the first unit 100 of the processing machine 01 in the transport direction T. The feeder unit 100 is preferably configured to feed sheets 02 to the processing machine 01 on the transport path and/or configured to feed sheets 02 to at least one unit 200; 300; 400; 500; 600; 650; 700; 800; 900 arranged downstream from the feeder unit 100 in the transport direction T.

At least one unit 200 configured as an infeed unit 200 is preferably arranged downstream from the at least one feeder unit 100 in the transport direction T. The at least one infeed unit 200 is preferably configured to feed sheets 02, preferably from a sequential supply of sheets 02, to the at least one shaping unit 300. The at least one infeed unit 200 preferably comprises at least one device for detecting sheets 02. A respective sheet 02 can preferably be at least partially, preferably completely, aligned by the at least one infeed unit 200 with respect to its position in the transport direction T and/or in the transverse direction A.

At least one unit 300 configured as a shaping unit 300 is preferably arranged downstream from the at least one feeder unit 100 in the transport direction T, and preferably downstream from the at least one infeed unit 200. The at least one shaping unit 300 preferably comprises at least one shaping mechanism 301. The shaping mechanism 301 is preferably configured as a die-cutting mechanism 301, more preferably as a flat-bed die-cutting mechanism 301. The corresponding unit 300 is then preferably configured as a die-cutting unit 300 and/or a creasing unit 300 and/or a cutting unit 300 and/or a die cutter 300, more preferably as a flat-bed die-cutting unit 300 and/or a flat-bed die-cutter 300.

Above and below, a device for partially severing and/or reducing the thickness of and/or stripping away the sheet 02 to be processed, in particular of the packaging material, is referred to as a creasing unit 300. In particular, notches and/or creases are introduced into the preferably paper-containing or paperboard-containing packaging material, in particular the sheet 02. In the case of corrugated cardboard, for example, the uppermost layer is severed in at least one creasing unit 300. In particular, the sheet 02, in particular the packaging material, can thus preferably be bent and/or folded into a certain shape, for example a three-dimensional shape, with lower force expenditure. A device for severing, preferably for completely severing, the sheet 02, in particular the packaging material, at certain points is referred to as a cutting unit 300 or a die-cutting unit 300. In particular, the at least one offcut piece 04; 05; 06, in particular the packaging material that is not required, can thus subsequently be easily separated from the multiple-ups 03.

The at least one shaping mechanism 301 preferably comprises at least one upper shaping tool, in particular at least one upper die-cutting tool, and/or at least one lower shaping tool, in particular at least one lower die-cutting tool. The at least one upper shaping tool is preferably in each case assigned at least one lower shaping tool, preferably exactly one lower shaping tool. At least one shaping tool is preferably configured to be movable, preferably movable in the vertical direction V. More preferably, at least one upper shaping tool and/or at least one lower shaping tool is in each case configured to be movable in the vertical direction V. The at least one upper shaping tool and the at least one lower shaping tool are preferably synchronized with respect to one another, and in particular with respect to the multiple-up 03 and/or the sheet 02. Preferably, in particular when both the at least one upper shaping tool and the at least one lower shaping tool are configured to be movable, the movement of respective shaping tools is preferably synchronized and/or can be synchronized in terms of time. The respective upper shaping tool and the respective lower shaping tool preferably have opposing relative movements with respect to one another during a die-cutting operation, so that the shaping tools are moved and/or can be moved relative toward one another and/or away from one another in the vertical direction V. The at least one upper shaping tool is preferably at least temporarily, preferably at least once per machine cycle, more preferably in a closed position of the at least one shaping mechanism 301, in direct contact with the at least one lower shaping tool. The at least one upper shaping tool is preferably spaced apart from the at least one lower shaping tool at a distance of greater than zero in an open position of the shaping mechanism 301.

The processing machine 01 preferably comprises at least one drive system 1000. The respective shaping tool is preferably in contact with, preferably functionally connected to, the at least one drive system 1000 and/or can be at least temporarily driven, preferably by way of a cyclical movement, by the drive system 1000.

A sheet 02 that has been processed by the at least one shaping unit 300, i.e., that is arranged downstream from the at least one shaping unit 300 on the transport path in the transport direction T, preferably includes at least one die-cut impression. The at least one die-cut impression is configured as a crease and/or a score mark and/or an embossment and/or a cut and/or a perforation, for example. The at least one die-cut impression, in particular when it is configured as a perforation and/or a cut, is preferably configured to at least partially separate the at least one multiple-up 03 from at least one offcut piece 04; 05; 06 and/or from at least one further multiple-up 03 of the relevant sheet 02. A sheet 02 that has been processed by the at least one shaping unit 300, i.e., that is arranged downstream from the at least one shaping unit 300 on the transport path in the transport direction T, preferably comprises the at least one multiple-up 03, preferably at least two multiple-ups 03, and at least one offcut piece 04; 05; 06.

At least one unit 400 configured as a stripping unit 400 is arranged downstream from the at least one shaping unit 300 in the transport direction T, preferably subsequent to the at least one shaping unit 300, more preferably without a further unit of the processing machine 01 being interposed. The at least one stripping unit 400 is preferably configured to remove the at least one first offcut piece 04, preferably to remove the at least one scrap piece 04, from the respective sheet 02. The at least one stripping unit 400 preferably comprises at least one stripping mechanism 401.

A sheet 02 that has been processed by the at least one stripping unit 400, i.e., that is arranged downstream from the at least one stripping unit 400 on the transport path in the transport direction T, preferably only comprises the at least one multiple-up 03, in particular a multiplicity of multiple-ups 03, and the at least one second offcut piece 06. For example, the sheet 02 that has been processed by the at least one stripping unit 400 additionally comprises the at least one crosspiece 05.

At least one unit 500 configured as a multiple-up separating unit 500 is preferably arranged downstream from the at least one shaping unit 300, in particular the at least one die-cutting unit 300. When the at least one stripping unit 400 is present, the at least one multiple-up separating unit 500 is also arranged downstream from the at least one stripping unit 400 in the transport direction T. The at least one multiple-up separating unit 500 comprises at least one multiple-up separating mechanism 501 for separating the multiple-ups 03 and the at least one remaining offcut piece 05; 06 from one another.

The sheet processing machine 01 furthermore preferably comprises at least one unit 600, in particular a delivery unit 600 for delivering and stacking the multiple-ups 03, more preferably a delivery 600. In the transport path of the sheets 02, the at least one delivery unit 600 is arranged downstream from the at least one die-cutting unit 300, and more preferably the at least one multiple-up separating unit 500 and/or the at least one stripping unit 400. In a preferred embodiment, the at least one multiple-up separating unit 500 comprises the at least one delivery unit 600, with the two units 500; 600 preferably being configured as a joint unit 650.

Furthermore, the sheet processing machine 01 preferably comprises the at least one unit 700, which is preferably configured as a sheet insert unit 700. The at least one sheet insert unit 700 is preferably assigned to the at least one multiple-up separating unit 500, and more preferably is arranged downstream from the at least one multiple-up separating unit 500 in the transport direction T. The at least one sheet insert unit 700 preferably inserts at least one sheet 02, preferably at least one unprocessed sheet 02, into a pile of sheets 02 and/or multiple-ups 03, which are preferably separated from one another, to increase the stability. The sheet processing machine 01, in particular, comprises the sheet insert unit 700 for inserting a sheet 02 into a pile of multiple-ups 03. The sheet insert unit 700 preferably comprises at least one pile formation device 701. Furthermore, the at least one pile formation unit 700 comprises at least one sheet cartridge 702, in particular an intermediate sheet cartridge 702, for holding, preferably unprocessed, sheets 02. The sheet insert unit 700 can also be arranged downstream from the joint unit 650.

Furthermore, the sheet processing machine 01 preferably comprises at least one unit 800 for collecting offcut piece 05; 06 configured as an offcut piece delivery unit 800. In particular, the at least one offcut piece 05; 06 is separated from the at least one multiple-up, preferably all multiple-ups 03. The at least one offcut piece delivery unit 800 is preferably arranged downstream from the multiple-up separating unit 700 in the transport direction T. More preferably, the at least one offcut piece delivery unit 800 is arranged downstream from the at least one delivery unit 600. In a preferred embodiment, the at least one offcut piece delivery unit 800 is encompassed by the at least one sheet insert unit 700, and these are configured as a joint unit 900.

The at least one drive system 1000 is preferably functionally connected to at least one system 1100, in particular a control system 1100, and/or the at least one transport system 1200.

The at least one drive system 1000 preferably comprises at least one clock generator and/or angular position transducer, more preferably exactly one clock generator and/or angular position transducer. The at least one clock generator and/or angular position transducer is preferably configured to generate a guide value, for example a virtual guide value and/or a guide value in the form of pulses, by way of which movements of components of the processing machine 01 can be synchronized and/or are synchronized.

Furthermore, the at least one sheet processing machine 01 comprises at least one system 1200 configured as a transport system 1200. The at least one transport system 1200 guides the sheets 02, preferably continuously holding them, through the sheet processing machine 01 and, in particular, at least through the units 300; 400; 500; 650. In particular, the sheets 02 are preferably guided at least substantially horizontally in the transport direction T through the sheet processing machine 01. The transport system 1200 is preferably configured as a chain transport system 1200, and more preferably as a chain gripper system 1200. In particular, the at least one chain transport system 1200 comprises at least one guide device 1203, wherein the at least one guide device 1203 is preferably configured as at least one chain 1203. In particular, the at least one guide device 1203 is at least partially, preferably completely, arranged outside the transport path. The chain gripper system 1200 is preferably configured with at least one carriage, preferably with multiple carriages, 1201, in particular a gripper carriage 1201. In particular, the at least one guide device 1203 holds the at least one gripper carriage 1201, preferably all gripper carriages 1201, and establishes the position of the at least one gripper carriage 1201 in at least one transport system 1200. In particular, the respective gripper carriage 1201, during sheet guidance, has a position in the transport direction T that is predefined by the at least one guide device 1203. The at least one holding element 1202, in particular the at least one gripper 1202, is preferably arranged at each carriage 1201. In particular, each gripper carriage 1201 comprises multiple holding elements 1202, preferably grippers 1202, in the transverse direction A across the working width, preferably at equal distances with respect to one another. The at least one holding element 1202 is preferably transferred from an open position into a closed position for gripping a sheet 02. A sheet 02 is preferably seized by the at least one holding element 1202 at the transfer position of the at least one infeed unit 200. For depositing the at least one second offcut piece 06, preferably in the at least one offcut piece delivery unit 800, the at least one holding element 1202 is preferably transferred from a closed position into an open position. The chain gripper system 1200 preferably has a cyclical and/or periodic movement for transporting sheets through the units 300; 400; 500; 650. In particular, the movement is configured to be so periodic and/or cyclical that the sheet 02 and/or the gripper carriage 1201, in particular the chain gripper carriage 1201, are at a standstill during the processing step in one of the units 300; 400; 500; 650. In particular, the at least one chain gripper carriage 1201 and/or the sheet 02 are in motion between the individual processing steps. The transport system 1200 is coupled to and synchronized with the transport means of the individual units via the control system 1100 and the drive system 1000.

The at least one drive system 1000 preferably comprises at least one drive 1001. For example, the at least one drive 1001 is configured as a central drive of the processing machine 01. The drive system 1000 preferably comprises a drive 1001 configured as a central drive. The at least one drive 1001 is preferably configured to transmit torque and/or linear movement to at least one component of at least one unit 100; 200; 300; 400; 500; 600; 650; 700; 800; 900, for example at least one transport means 103; 104; 108; 204, and/or to at least one component of the transport system 1200. The at least one drive 1001 is preferably configured to transmit torque and/or linear movement to at least two different components of the same unit 100; 200; 300; 400; 500; 600; 650; 700; 800; 900 and/or two different units 100; 200; 300; 400; 500; 600; 650; 700; 800; 900 and/or to at least one component of the transport system 1200. The at least one drive 1001 is preferably in contact with and/or functionally connected to at least one component of at least one unit 100; 200; 300; 400; 500; 600; 650; 700; 800; 900 which is to be moved at least temporarily and/or at least one component of the transport system 1200. The at least one drive 1001 of the at least one drive system 1000 is preferably linked, or can be linked, to at least one component of at least one unit 100; 200; 300; 400; 500; 600; 650; 700; 800; 900 to be moved, preferably to all components of the respective unit 100; 200; 300; 400; 500; 600; 650; 700; 800; 900, or of the respective units 100; 200; 300; 400; 500; 600; 650; 700; 800; 900, which are to be moved by the respective drive 1001, and/or to at least one component of the transport system 1200 to be moved, in such a way that the respective component to be moved, and preferably all components to be moved by the drive 1001, can be operated and/or are operated in a synchronized manner.

The at least one drive system 1000 is preferably configured to transmit cyclical and/or periodic movements to at least one component of at least one unit 100; 200; 300; 400; 500; 600; 650; 700; 800; 900 and/or of the transport system 1200 by way of the at least one drive 1001.

In a preferred embodiment, the at least one drive system 1000 comprises exactly one drive 1001, which is preferably linked to different components of different units 100; 200; 300; 400; 500; 600; 650; 700; 800; 900 and/or to at least one component of the transport system 1200.

The at least one drive 1001 of the drive system 1000 is preferably configured as an electric motor, more preferably as a servo motor.

The sheet processing machine 01 preferably comprises at least one system 1100, in particular at least one control system 1100, for open-loop control and/or for closed-loop control. The at least one control system 1100 is functionally connected to the units 100; 200; 300, 400; 500; 600; 650; 700; 800; 900 and the at least one drive 1001, for example. The multiple units 100; 200; 300, 400; 500; 600; 650; 700; 800; 900 are preferably functionally connected to one another via the at least one control system 1100 and are synchronized and/or can be synchronized. The sheet processing machine 01 comprises multiple sensors, wherein the input signals thereof are detected and processed in at least one control system 1100. For example, at least one output signal is generated via the at least one control system 1100, which controls, by open-loop and/or closed-loop control, at least one component of a unit 100; 200; 300, 400; 500; 600; 650; 700; 800; 900, and/or is connected to a component of a unit 100; 200; 300, 400; 500; 600; 650; 700; 800; 900 so as to control the same by open-loop and/or closed-loop control. For example, the at least one drive 1001 of the at least one drive system 1000 and/or an alignment of sheets 02 and/or an infeed of sheets 02 into the processing machine 01 and/or an insertion of sheets into the at least one delivery pile can be controlled, by open-loop control and/or closed-loop control, via the at least one control system 1100. An operator can, for example, at least partially intervene in the mode of operation of the sheet processing machine 01 via a control console that is functionally connected to the at least one control system 1100.

The at least one infeed unit 200 preferably comprises at least one transport means, which is preferably configured as at least one transport roller and/or at least one transport brush. Sheets 02 are preferably transported by means of the at least one transport means of the at least one infeed unit 200, which is preferably configured as at least one transport roller and/or at least one transport brush, in the transport direction T along the transport path of sheets 02 toward an alignment position PA.

The infeed unit 200 preferably comprises at least one infeed system 202. The infeed unit 200 is preferably arranged upstream from the at least one shaping unit 300. The infeed unit is preferably arranged downstream from the at least one feeder unit 100. The at least one infeed system 202 is preferably arranged downstream from the feeder unit 100 preferably configured as a sheet feeder 100. The at least one infeed system 202 preferably comprises at least one stop 203, preferably at least two stops 203, which are preferably at least temporarily arranged within the plane of the transport path at the alignment position PA. The at least one infeed system 202 preferably comprises at least one transport means 204, which is preferably configured as a transfer means 204 and/or a holding means 204. The at least one infeed system 202 preferably comprises the at least one transport means 204, which is preferably configured as a transfer means 204 and/or a holding means 204 and which is preferably configured to transport sheets 02 sequentially from the alignment position PA to a transfer position PU, wherein the transfer position PU is arranged along the transport path in the transport direction T downstream from the alignment position PA. At the transfer position PU, a respective, preferably the at least one, sheet 02 can preferably be transferred and/or is transferred to the at least one transport system 1200 of the processing machine 01, in particular, when at least one holding element 1202 of the transport system 1200 is situated in the transfer position PU at the time of transfer. The at least one sheet 02 is preferably transferred at the transfer position PU to the at least one holding element 1202 of the transport system 1200, preferably by the at least one transport means 204 of the infeed system 202.

Preferably in addition or as an alternative, the at least one infeed unit 200 comprises at least one device for detecting sheets 02, in particular at least one sensor device 251. The at least one sensor device 251 preferably comprises at least one sensor 252, more preferably at least two sensors 252, more preferably two sensors 252, for example alternatively at least three sensors 252. The at least one sensor device 251 preferably comprises at least one sensor 252, more preferably at least two sensors 252, more preferably at least three sensors 252. The at least one sensor device 251 preferably comprises at least one sensor 252, more preferably at least two sensors 252, more preferably exactly two sensors 252, which are arranged next to one another in the transport direction T, i.e., behind one another in the transverse direction A. Preferably, the at least one sensor 252 is, preferably the at least two sensors 252 are, arranged outside the transport path of sheets 02, and directed at the transport path of sheets 02. Preferably, the at least one sensor 252 is, preferably the at least two sensors 252 are, configured to selectively detect at least one printing mark 11 and/or at least one edge 07; 08; 09 of sheets 02, preferably of the at least one sheet 02. Preferably, a respective sensor 252 of the sensor device 251, preferably each sensor 252 of the at least two sensors 252, is configured to selectively detect at least one printing mark 11 of the at least one sheet 02 and/or at least one edge 07; 08; 09 of the at least one sheet 02. Preferably, a respective sensor 252 of the sensor device 251, preferably the at least one sensor 252, more preferably each sensor 252 of the at least two sensors 252, is configured to selectively detect, at least partially, at least one printing mark 11 of a respective, preferably of the at least one, sheet 02 and/or at least one edge 07; 08; 09 of the respective, preferably of the at least one, sheet 02, in particular the leading edge 07 of the respective sheet 02 and/or at least one side edge 09 of the respective sheet 02 which is arranged parallel to the transport direction T, preferably in at least one detection zone 253, more preferably in a detection zone 253 having a surface area of no more than 10% of a respective upper side and/or underside of the respective, preferably of the at least one, sheet 02. The detection zone 253 of a sensor 252 is preferably the surface area within the plane of the transport path which can be detected and/or is detected, at least temporarily, by the relevant sensor 252, preferably by the at least one sensor 252, more preferably by the at least one sensor 252 of the at least two sensors 252. The detection zone 253 is preferably at least 10 mm (ten millimeters), preferably at least 15 mm (fifteen millimeters), more preferably at least 20 mm (twenty millimeters), and/or no more than 40 mm (forty millimeters), preferably no more than 30 mm (thirty millimeters), in the transport direction T.

Above and below, a detection of an object, preferably the detection of the at least one substrate 02 preferably configured as a sheet 02 and/or of the at least one printing mark 11 and/or of at least one edge 07; 08; 09 and/or of at least one control patch 22 of a print control strip 21, by the at least one sensor device 251 preferably describes an identification of the presence of the detected object within the at least one detection zone 253, in particular the acquisition of an image, for example of a digital image, of the detected object, and preferably its evaluation. As a result of the detection of the object, preferably at least one signal, preferably a measurement signal, is generated within the at least one sensor device 251, preferably by means of the at least one sensor 252, which, for example, generates a digital image and/or, for example, data present in digital form regarding the detection time and/or, for example, data present in digital form regarding the configuration of the detected object. Preferably, the at least one sensor device 251 comprises at least one control unit, for example a processing unit, and/or is connected to the control unit. Preferably, the control unit is configured so as to evaluate the signal of the at least one sensor 252, for example the data regarding the detection time and/or the image of the detected object.

Above and below, the selective detection of at least one edge 07; 08; 09 and/or at least one printing mark 11 preferably describes that the at least one sensor device 251 of the sheet processing machine 01, preferably at least one of the at least two sensors 252, more preferably the at least two sensors 252, have at least two, preferably at least three, operating modes that can be distinguished from one another. In a, for example first, preferred operating mode, the at least one sensor device 251, preferably at least one of the at least two sensors 252, more preferably the at least two sensors 252, are configured to detect the at least one printing mark 11. In a, for example second, operating mode, the at least one sensor device 251, preferably at least one of the at least two sensors 252, more preferably the at least two sensors 252, are configured to detect the at least one edge 07; 08; 09. In a, for example third, operating mode, the at least one sensor device 251, preferably at least one of the at least two sensors 252, more preferably the at least two sensors 252, are configured to detect the at least one printing mark 11 and the at least one edge 07; 08; 09. It is preferably possible to select between the at least two, preferably at least three, operating modes, at least for the present print job, preferably for the at least one sheet 02, more preferably for each individual sheet 02. In particular, the at least one sensor device 251, preferably at least one of the at least two sensors 252, more preferably the at least two sensors 252, can be operated both in the first operating mode, i.e., in which the at least one printing mark 11 is detected, and in the second operating mode, i.e., in which the at least one edge 07; 08; 09 is detected, and also in the third operating mode, i.e., in which both the printing mark 11 and the edge 07; 08; 09 are detected, and/or are operated either in the first operating mode or the second operating mode or the third operating mode.

The at least one sensor device 251 is preferably configured to generate at least one signal, which is processed and/or can be processed by the at least one control system 1100. The at least one infeed unit 200 is preferably configured to at least partially, preferably completely, align the respective at least one sheet 02 with respect to its position in the transport direction T and/or in the transverse direction A, in particular based on the at least one signal of the at least one sensor device 251 and/or based on at least one signal of the at least one control system 1100. A respective sheet 02, preferably the at least one sheet 02, can preferably be at least partially, preferably completely, aligned by the at least one infeed unit 200 in terms of its position in the transport direction T and/or in the transverse direction A. Preferably, the at least one signal of the at least one sensor device 251 and/or the at least one signal of the at least one control system 1100 can be processed and/or is processed for aligning the at least one sheet 02 by the at least one infeed system 202.

The infeed system 202 is preferably configured to feed sheets 02 to a unit 300; 400; 500; 600; 650; 700; 800; 900 arranged downstream in the transport direction T, in particular to the shaping unit 300. In addition, a sheet 02, preferably the at least one sheet 02, is preferably at least partially aligned by the infeed system 202, so that the sheet 02 is processed and/or can be processed in the correct position by the units 300; 400; 500; 600; 650; 700; 800; 900 arranged downstream in the transport direction T.

A sheet 02 transported in the infeed unit 200, preferably the at least one sheet 02, is preferably transported to the alignment position PA. The alignment position PA is preferably established by the at least one stop 203, in particular the at least two stops 203, each preferably being configured as a front lay mark 203. The alignment position PA is preferably established by the at least two front lay marks 203 arranged horizontally with respect to the transport direction T and parallel next to one another. The at least two front lay marks 203 are preferably arranged parallel next to one another in the transport direction T and spaced apart from one another. The infeed system 202, in the transport direction T, preferably comprises the at least two front lay marks 203 arranged parallel to one another, which are configured to roughly align the at least one sheet 02 in the alignment position PA. For example, the at least two front lay marks 203 are configured as rough alignment means. Advantageously, larger infeed errors, for example a deviation in the position of the sheet 02 from its target position by more than 10%, preferably more than 15%, preferably more than 20%, more preferably more than 30%, are thus corrected.

A rough alignment preferably describes an alignment of sheets 02, wherein the position of the at least one sheet 02 still deviates from a reference after the rough alignment. Preferably, a deviation of a measured value, preferably of the position, of the sheets 02, preferably of the at least one sheet 02, from its reference is reduced to no more than 8 mm (eight millimeters), preferably no more than 5 mm (five millimeters), more preferably no more than 4 mm (four millimeters), more preferably no more than 3 mm (three millimeters), during a rough alignment.

Preferably in addition, the infeed system 202 comprises at least one servo drive 218, which is configured to finely align sheets 02. The infeed system 202 preferably comprises at least two servo drives 218. For example, the at least one servo drive 218 is configured as a fine alignment means. The infeed system 202, in the transport direction T, preferably comprises at least two front lay marks 203 arranged parallel to one another, which are configured to roughly align the at least one sheet 02 in the alignment position PA, and the at least one servo drive 218, which is configured to finely align sheets 02.

A fine alignment preferably describes an alignment of sheets 02, wherein the position of the at least one sheet 02 preferably only deviates minimally, preferably not at all, from a reference after the fine alignment. Preferably, a deviation of a measured value, preferably of the position, of the sheets 02, preferably of the at least one sheet 02, from its reference is reduced to no more than 1 mm (one millimeter), preferably no more than 0.5 mm (zero point five millimeter), more preferably no more than 0.1 mm (zero point one millimeter), more preferably no more than 0.05 mm (zero point zero five millimeter), more preferably no more than 0.01 mm (zero point zero one millimeter), more preferably no more than 0.005 mm (zero point zero five millimeter), during a fine alignment.

The at least one front lay mark 203 is, preferably the at least two front lay marks 203 are, in each case configured to protrude and/or protrude at least temporarily into the transport path of sheets 02. The at least one front lay mark 203 is, preferably the at least two front lay marks 203 are, preferably configured to protrude at least temporarily into the transport path of sheets 02. At least a portion of the at least one front lay mark 203 is preferably at least temporarily arranged within the plane of the transport path at the alignment position PA. In this way, the at least one front lay mark 203, preferably the at least two front lay marks 203, preferably at least temporarily form a barrier in the transport direction T for sheets 02 transported along the transport path, so that the movement of these sheets 02 in the transport direction T is preferably at least temporarily impeded at the position of the relevant at least one front lay mark 203. Preferably in addition, the at least one front lay mark 203, preferably the at least two front lay marks 203, are configured to be pivotable and/or to be pivoted and/or to pivot and/or are pivoted outside the transport path of sheets 02. Preferably, the least one portion of the at least one front lay mark 203 which is at least temporarily arranged within the plane of the transport path in the alignment position can be pivoted and/or is pivoted at least temporarily out of the plane of the transport path in the alignment position PA. The at least one front lay mark 203, preferably the at least two front lay marks 203, preferably at least temporarily protrude into the transport path of sheets 02 and are preferably at least temporarily pivoted outside the transport path of sheets 02.

The at least two front lay marks 203 arranged parallel to and next to one another in the transport direction T, preferably at least four, more preferably at least eight, more preferably all front lay marks 203 arranged parallel next to one another in the transport direction T, are preferably connected to one another via at least one shaft. The shaft of the front lay marks 203 is preferably arranged outside the transport path of sheets 02, in particular in the vertical direction V beneath the transport path of sheets 02. The at least one front lay mark 203 is preferably connected to at least one roller lever 208, preferably via the at least one shaft of the front lay marks 203. For example, the infeed system 202 of the sheet processing machine 01 comprises two roller levers 208 assigned to the at least two front lay marks 203. The respective, preferably the at least one, front lay mark 203 and the at least one roller lever 208 are preferably configured to be movable, preferably at least in and/or counter to the transport direction T. Preferably, at least one profiled cam 209, the position of which is preferably fixed, in particular in the transport direction T, is assigned in each case to the respective roller lever 208. The respective, preferably the at least one, profiled cam 209 preferably has a different height in the vertical direction V, in particular along the transport direction T. The respective, preferably the at least one, roller lever 208 is preferably configured to carry out a rolling motion along the surface of the profiled cam 209 assigned thereto, preferably at least in and/or counter to the transport direction T, in particular in the case of a movement of the roller lever 208 in and/or counter to the transport direction T.

The infeed system 202 preferably comprises the at least one transport means 204, which is preferably configured as a transfer means 204 and/or as a holding means 204. The at least one transport means 204 preferably is at least one gripper 204. The infeed system 202 preferably comprises at least two transport means 204 that are spaced apart from one another, more preferably at least four, more preferably at least eight, for example eleven, in particular a multiplicity of transport means 204 that are spaced apart from one another, which are preferably arranged horizontally next to one another in the transport direction T, i.e., behind one another in the transverse direction A. The individual transport means 204 are preferably connected to one another via at least one shaft 221, in particular at least one gripper shaft 221, and/or each of the individual transport means 204 is attached to the at least one gripper shaft 221. The at least one transport means 204 is preferably attached to the at least one gripper shaft 221. Preferably, a multiplicity of grippers 204 that are spaced from one another in the transverse direction A are attached to the at least one gripper shaft 221 and/or connected to one another via the at least one gripper shaft 221.

The at least one transport means 204 preferably comprises at least one transfer element 206; 207. Each of the at least one transport means 204 preferably comprises at least one upper holder 206 and/or at least one lower holder 207. The upper holder 206 is preferably configured as an upper transfer element 206, for example as an upper half of the gripper 204. The upper holder 206 is preferably at least primarily arranged in the vertical direction V above the plane of the transport path at the position of the transport means 204. The lower holder 207 is preferably configured as a lower transfer element 207, for example as a lower half of the gripper 204. The lower holder 207 is preferably at least primarily arranged in the vertical direction V below the plane of the transport path at the position of the transport means 204. Each of the at least one upper holder 206 preferably comprises an upper holding surface 233, which corresponds to the region of the upper holder 206 that makes direct contact at least temporarily with a sheet 02 to be transported and/or that faces the respective, preferably the at least one, lower holder 207, i.e., is arranged in the vertical direction V downwardly at the relevant upper holder 206, and/or that can be arranged and/or is arranged at least temporarily at the alignment position PA in the vertical direction V, coming from above, within the plane of the transport path. Each of the at least one lower holder 207 preferably comprises a lower holding surface 234, which corresponds to the region of the lower holder 207 that makes direct contact at least temporarily with a sheet 02 to be transported and/or that faces the respective, preferably the at least one, upper holder 206, i.e., is arranged in the vertical direction V upwardly at the relevant lower holder 207, and/or that can be arranged and/or is arranged at least temporarily at the alignment position PA in the vertical direction V, coming from beneath, within the plane of the transport path.

The at least one respective transfer element 206; 207, preferably the at least one upper holder 206 and/or the at least one lower holder 207, of the transport means 204 is preferably configured to at least temporarily detect a respective, preferably the at least one, sheet 02 in an edge region and/or outside the at least one print image of the sheet 02. For example, the at least one transport means 204 seizes the at least one sheet 02 in an edge region and/or outside the at least one print image, preferably by means of the at least one upper holder 206 and the at least one lower holder 207.

The at least one transport means 204 configured as a transfer means 204 and/or as a holding means 204 is preferably configured to sequentially transport sheets 02, in particular from the alignment position PA to the transfer position PU. The transport means 204 configured in particular as a transfer means 204 and/or as a holding means 204 preferably has a straight guidance or a linear guidance. The at least one transport means 204 can be moved and/or is moved, preferably horizontally, along the transport path in the transport direction T and/or counter to the transport direction T. The at least one transport means 204 is preferably configured to move and/or to be movable and/or to be moved from the alignment position PA to the transfer position PU and/or back. The at least one transport means 204, during its movement from the alignment position PA to the transfer position PU, and preferably additionally back from the transfer position PU to the alignment position PA, preferably has a rectilinear movement, preferably a forward movement and/or a backward movement in the horizontal plane, preferably in a plane spanned by the transport direction T and the transverse direction A. The at least one transport means 204 of the infeed system 202 preferably carries out a planar transport of sheets 02. The transfer of the at least one sheet 02 to the transport system 1200 downstream from the infeed system 202, preferably the transfer of the at least one sheet 02 from the at least one transport means 204 of the infeed system 202 to the at least one holding element 1202 of the transport system 1200, preferably takes place in a horizontal plane, preferably in a plane spanned by the transport direction T and the transverse direction A.

Preferably, at least one component of the infeed system 202, in particular at least the at least one transport means 204 configured as a transfer means 204 and/or as a holding means 204, preferably configured as a gripper 204, can be moved and/or is moved at least partially in the transport direction T and/or in the transverse direction A. The infeed system 202 preferably has at least one mounting point S, about which preferably at least one connecting point 219 is pivotingly and/or pivotably arranged, the connecting point 219 preferably being connected to the at least one transport means 204. The at least one connecting point 219 is preferably pivotingly and/or pivotably arranged about the at least one mounting point S as a function of a rotation of a drive shaft 1002, which is preferably configured as an infeed drive shaft 1002.

The at least one drive shaft 1002 is preferably connected to the at least one drive 1001 of the drive system 1000 and/or is driven at least temporarily, preferably permanently, by the at least one drive 1001. The at least one drive system 1000 preferably comprises at least one clock generator and/or angular position transducer and/or at least one rotary encoder, more preferably exactly one clock generator and/or angular position transducer and/or rotary encoder. The at least one drive shaft 1002 is preferably configured as a single-turn shaft 1002 and, per machine cycle, carries out exactly one full rotation of 360° about an axis of rotation D of the drive shaft 1002.

The infeed system 202 preferably comprises at least one gear mechanism, preferably at least one cam mechanism, preferably to carry out the movement in and/or counter to the transport direction T, and preferably additionally or alternatively in and/or counter to the transverse direction A. The at least one infeed system 202 of the sheet processing machine 01 preferably comprises the at least one cam mechanism, preferably so as to at least partially transmit a movement from the drive shaft 1002 to the at least one transfer means 204 of the infeed system 202. The at least one drive shaft 1002, preferably as a result of its rotational movement, preferably by way of the at least one drive 1001, is preferably configured to generate a preferably continuous movement, for example a fixed stroke, of the cam mechanism. Preferably in addition or as an alternative, the at least one infeed system 202 comprises at least one servo drive 218 that is independent of the drive shaft 1002, preferably of the at least one drive 1001. The at least one servo drive 218 is preferably mechanically independent of, preferably mechanically decoupled from, the drive shaft 1002, preferably the at least one drive 1001.

The at least one infeed system 202 of the sheet processing machine 01 preferably comprises the at least one cam mechanism. The at least one infeed system 202 preferably comprises at least two cam mechanisms. The at least one cam mechanism preferably comprises at least one cam disk 212; 223.

At least one of the cam mechanisms preferably comprises at least one cam disk 212. Each of the at least one cam mechanism is preferably configured as a disk cam mechanism, preferably including at least one cam disk 212. Each of the at least one cam mechanism preferably has the at least one cam disk 212 and an axis of rotation D of the at least one cam disk 212. The cam mechanism is preferably connected to the at least one drive shaft 1002. The at least one cam mechanism is preferably driven by the at least one drive 1001, preferably via the at least one drive shaft 1002, preferably continuously. The axis of rotation D of the drive shaft 1002 is preferably identical to the axis of rotation D of the at least one cam disk 212 of the at least one cam mechanism. The at least one cam disk 212 is preferably concentrically arranged about the at least one drive shaft 1002. Preferably, the at least one cam disk 212 of the at least one cam mechanism thus carries out a complete rotation about the axis of rotation D per machine cycle. The at least one cam mechanism preferably comprises at least two cam disks 212, preferably in each case exactly two cam disks 212.

The at least one drive 1001 of the at least one drive shaft 1002 of the cam mechanism is preferably mechanically connected to at least one drive of the transport system 1200 arranged downstream from the infeed system 202 in the transport direction T of sheets 02. For example, the drive shaft 1002 and the transport system 1200 arranged downstream from the infeed system 202 in the transport direction T of sheets 02 comprise a joint drive 1001, to which they are preferably connected, for example via different gear mechanisms. The sequence of motions of the infeed system 202 is preferably at least partially coupled to and/or synchronized with the sequence of motions of the transport system 1200 arranged downstream in the transport direction T of sheets 02.

Preferably, at least one scanning element 213 is arranged to rest against and/or rests against the at least one cam disk 212. The at least one scanning element 213 is preferably configured as a roller. The respective, preferably the at least one, scanning element 213 is preferably assigned to at least one drive lever 214. The infeed system 202 preferably comprises the at least one drive lever 214 assigned to the respective, preferably the at least one, cam disk 212. The at least one scanning element 213 of the at least one drive lever 214 is preferably configured to rest permanently without clearance against a cam disk 212 of the respective, preferably at least one, cam mechanism. In particular while the scanning element 213 rests without clearance against the at least one cam disk 212, the center of gravity of the at least one scanning element 213 preferably has a distance L213 with respect to the axis of rotation D of the drive shaft 1002, which preferably changes during a rotation of the at least one cam disk 212 about its axis of rotation D. Each of the at least one drive lever 214 preferably has the at least one mounting point S. The at least one mounting point S is preferably configured as the pivot point S of the drive lever 214 and/or as a pivot axis S of the drive lever 214. The pivot axis S is preferably oriented parallel to the transverse direction A. The at least one scanning element 213 is preferably arranged at a position along the drive lever 214 which is spaced apart from the mounting point S, and is configured to pivot and/or be pivotable about the mounting point S.

The at least one sensing element 213 is preferably connected to the at least one transport means 204 via the at least one drive lever 214. The at least one drive lever 214 is preferably connected to the at least one transport means 204 via at least one coupler 216. The at least one drive lever 214 and the at least one coupler 216 preferably have the at least one connecting point 219 to one another. The at least one connecting point 219 is preferably in each case positioned spaced apart from the at least one scanning element 213 and/or from the mounting point S along the drive lever 214, and is preferably configured to pivot and/or be pivotable about the mounting point S.

The at least one drive lever 214 is preferably configured to have at least one rotational movement of the cam mechanism scanned by the at least one scanning element 213. Preferably in addition or as an alternative, the at least one drive lever 214 is configured to convert the at least one rotational movement of the cam mechanism into at least one linear movement of the transfer means 204. The at least one drive lever 214 is preferably configured to transmit the at least one rotational movement of the cam mechanism to the connecting point 219, whereby the at least one assigned coupler 216 is preferably made to carry out at least one, preferably at least primarily linear, movement, preferably having a main component of the movement direction in and/or counter to the transport direction T.

At least one cam mechanism of the cam mechanisms of the infeed system 202 is preferably configured as a dual cam mechanism, each preferably comprising at least two cam disks 212. The at least one cam mechanism is preferably configured as a dual cam mechanism, each preferably comprising at least two cam disks 212. The at least two cam disks 212 of the at least one dual cam mechanism are preferably arranged behind one another in the transverse direction A. At least one scanning element 213 is arranged so as to rest without clearance, in particular so as to rest permanently without clearance, against each of the at least two cam disks 212 of the dual cam mechanism. The at least two scanning elements 213 of the dual cam mechanism are preferably arranged on a joint drive lever 214. The at least two scanning elements 213 of the dual cam mechanism are preferably arranged on a joint drive lever 214, with the mounting point S therebetween. The at least one scanning element 213 of the at least one drive lever 214 is preferably configured to rest permanently without clearance against a cam disk 212 of the respective, preferably at least one, cam mechanism. The respective, preferably the at least one, scanning element 213 is preferably configured to permanently rest without clearance against the respective, preferably at least one, cam disk 212, without suspension. A scanning element 213 of the at least two scanning elements 213 of a drive lever 214 preferably in each case rests permanently without clearance against a cam disk 212 of the dual cam mechanism. The respective at least one further scanning element 213 is preferably configured as a pressing element of the respective at least one another scanning element 213. The distance L213 between the respective, preferably the at least one, scanning element 213 and the axis of rotation D of the drive shaft 1002 for the scanning element 213 assigned to a first cam disk 212 is preferably different from the distance L213 for the scanning element 213 of the same cam mechanism assigned to a second cam disk 212.

Each of the at least one cam disk 212 preferably comprises at least two, preferably at least three, more preferably at least four, regions, with regions abutting one another having different radii. The at least one cam disk 212 preferably has at least two different radii with respect to its axis of rotation D along its circumference. For example, the at least one cam disk 212, along its circumference, includes at least one depression and/or at least one elevation and/or at least one lobe with respect to the surrounding regions. A cam function of the circumference of the at least one cam disk 212 is preferably continuous, preferably continuously differentiable, in all points along its arc length. The cam function of the at least one cam disk 212 is preferably configured to correspond to a movement profile of the at least one transport means 204, which is configured to transfer sheets 02 to the transport system 1200 arranged downstream from the infeed system 202 in the transport direction T. The cam function, preferably in each case at least a region, of the at least one cam disk 212 preferably corresponds to a movement of the at least one transport means 204 from the alignment position PA to the transfer position PU, and vice versa, as well as the residence time of the at least one transport means 204 in the alignment position PA and/or in the transfer position PU.

The at least two cam disks 213 of the dual cam mechanism are preferably displaced with respect to one another by at least one angle of rotation. The at least two cam disks 213 of the dual cam mechanism are preferably displaced with respect to one another by at least one angle of rotation, so that the joint projection of the at least two cam disks 213 of a dual cam mechanism, in a plane spanned by the transport direction T and the vertical direction V, has a larger surface area than the projection of an individual one of the at least two cam disks 213 in the same plane. At least one cam disk 213 of the dual cam mechanism is preferably configured as a spring replacement for the at least one drive lever 214, so that in each case at least one, preferably each, scanning element 213 of the drive lever 214 rests permanently without clearance against a respective cam disk 213 of the dual cam mechanism.

The scanning element 213 preferably has a minimal distance L213 with respect to the axis of rotation D of the drive shaft 1002 when the radius of the assigned cam disk 212 is minimal in the region that, at this time, faces the relevant scanning element 213. The scanning element 213 preferably has a maximal distance L213 with respect to the axis of rotation D of the drive shaft 1002 when the radius of the assigned cam disk 212 is maximal in the region that, at this time, faces the relevant scanning element 213. The at least one drive lever 214 is preferably configured to pivot about its mounting point S. The at least one drive lever 214 is preferably configured to pivot about its mounting point S, corresponding to the distance L213 between the at least one scanning element 213 and the axis of rotation D of the drive shaft 1002.

By scanning the circumference of the at least one cam disk 212 using the at least one scanning element 213, in particular by the scanning element 213 that is preferably configured as a roller, carrying out a rolling motion on the respective cam disk 212, the at least one assigned drive lever 214 is pivoted about its mounting point S. The drive lever 214 is preferably deflected from its existing position about its mounting point S by the profile of the at least one cam disk 212. Likewise, the connecting point 219 thus pivots about the mounting point S. The at least one coupler 216 connected to the connecting point 219 is moved, wherein the respective movement direction preferably has a largest component of its orientation in and/or counter to the transport direction T.

The at least one transport means 204 is thus preferably moved along its linear guidance in and/or counter to the transport direction T. The at least one transport means 204 is preferably configured to move and/or is moved in and/or counter to the transport direction T by the at least one drive lever 214 being pivoted about its mounting point S. The at least one transport means 204 is preferably configured to move and/or is moved in and/or counter to the transport direction T by the profile of the at least one cam disk 212.

The distance between the mounting point S of the at least one drive lever 214 and the axis of rotation D of the drive shaft 1002 and/or the axis of rotation D of the at least one cam disk 212 is preferably constant.

The mounting point S and the axis of rotation D are preferably configured to be adjustable and/or to be adjusted and/or to adjust relative to one another and/or are adjusted relative to one another. More preferably, the mounting point S and the axis of rotation D are preferably configured to be pivotable and/or to be pivoted and/or to pivot relative to one another and/or are preferably pivoted relative to one another. The relative pivoting of the mounting point S and of the axis of rotation D with respect to one another, preferably a pivoting of the mounting point S about the axis of rotation D, preferably changes a relative position of the mounting point S and of the axis of rotation D with respect to one another. A relative position of the at least one transport means 204 is preferably configured to be changeable and/or to be changed and/or is changed by the relative adjustment, preferably pivoting, of the mounting point S and of the axis of rotation D, more preferably a pivoting of the mounting point S about the axis of rotation D, with respect to one another.

The at least one infeed system 202 preferably comprises the at least one servo drive 218. The infeed system 202 preferably comprises at least two cam mechanisms, which are arranged parallel to one another in the transport direction T, on the at least one drive shaft 1002 and/or preferably at least one servo drive, preferably two servo drives 218, which are independent of the drive shaft 1002 and are preferably each assigned to one of the cam mechanisms. The at least one servo drive 218 is preferably configured as a hand wheel or a mechanical drive or an electric drive, preferably as an actuator and/or an electric motor. The at least one servo drive 218 is preferably independent of, preferably mechanically independent of, more preferably mechanically decoupled from, the at least one drive 1001, in particular independent of the drive system 1000 of the processing machine 01. The at least one servo drive 218 is preferably configured to intervene and/or intervenes in the at least one cam mechanism of the infeed system 202, in particular in a respective cam mechanism assigned to the servo drive.

The at least one servo drive 218 is preferably connected via at least one rocking lever 217 to the mounting point S of the at least one drive lever 214. The rocking lever 217 is preferably arranged to pivot about the axis of rotation D of the drive shaft 1002. The at least one servo drive 218 is preferably configured to pivot the at least one rocking lever 217 about the axis of rotation D of the drive shaft 1002.

The at least one servo drive 218 is preferably configured to adjust, preferably pivot, the mounting point S relative to the axis of rotation D. The at least one servo drive 218 is preferably configured to adjust, preferably pivot, the mounting point S of the at least one drive lever 214 relative to the axis of rotation D of the drive shaft 1002 and/or of the axis of rotation D of the at least one cam disk 212, and/or adjusts, preferably pivots, these relative to one another. The mounting point S and the axis of rotation D are preferably arranged to be pivotable and/or to be pivoted and/or to pivot and/or are pivoted relative to one another by the at least one servo drive 218. The mounting point S and the axis of rotation D are preferably arranged to be pivotable and/or to be pivoted and/or are pivoted relative to one another as a function of a detection of the respective, preferably the at least one, sheet 02 by the at least one sensor device 251. The mounting point S is preferably arranged to pivot about the axis of rotation D. More preferably, the at least one mounting point S has a fixed relative position with respect to the at least one rocking lever 217 and is preferably arranged to pivot and/or to be pivotable and/or to be pivoted about the axis of rotation D together with the relevant at least one rocking lever 217.

As a result of the open-loop and/or closed-loop control of the at least one servo drive 218, a movement that is transmitted from the at least one drive shaft 1002 to the at least one transfer means 204 can preferably be at least temporarily superimposed and/or is superimposed by a movement that is transmitted from the at least one servo drive 218. As a result of the open-loop and/or closed-loop control of the at least one servo drive 218, a movement that is transmitted from the at least one drive shaft 1002 to the at least one transfer means 204 can preferably be at least temporarily superimposed and/or is superimposed by a movement that is transmitted from the at least one servo drive 218 to the at least one transfer means 204. A movement that is transmitted from the at least one drive shaft 1002 to the at least one transfer means 204 is preferably superimposed by a movement of the at least one servo drive 218, and thus, preferably, at least one position error of the respective sheet 02, preferably of the at least one sheet 02 of the sheets 02, can be compensated for and/or is compensated for. The at least one servo drive 218 is preferably configured to intervene in a movement that is transmitted from the at least one drive shaft 1002, preferably generated by the at least one drive 1001, to the at least one transport means 204, preferably to change this movement, more preferably to superimpose this movement, and/or intervenes.

The at least one transport means 204 preferably transports sheets 02 from the alignment position PA to the transfer position PU. The transport path of the at least one sheet 02 is preferably horizontal. The transport movement of the at least one transport means 204, in particular from the alignment position PA to the transfer position PU, preferably takes place in a plane, preferably spanned by the transport direction T and the transverse direction A, more preferably horizontally. The sheet processing machine 01 preferably comprises the at least one transport system 1200 arranged downstream from the at least one infeed system 202 in the transport direction T, preferably including the at least two holding elements 1202 that are spaced apart from one another orthogonally to the transport direction T. The respective holding element 1202 of the transport system 1200 is preferably spaced apart from an assigned transfer element 206; 207 of the transport means 204 in the transfer position PU, in each case at a first distance. in the transport direction T. One of the at least two holding elements 1202 is in each case preferably spaced apart from an assigned transfer element 206; 207 in the transfer position PU at a first distance in the transport direction T.

By adjusting, preferably pivoting, the mounting point S and the axis of rotation D relative to one another, the one holding element 1202 of the at least two holding elements 1202 is preferably spaced apart from the assigned transfer element 206; 207 at a second distance in the transfer position PU. By adjusting the mounting point S of the at least one drive lever 214 and the axis of rotation D relative to one another, the respective holding element 1202 of the transport system 1200 is preferably spaced apart from the respective assigned transfer element 206; 207 at a second distance in the transport direction T in the transfer position PU. In particular, the second distance for two holding elements 1202 of the transport system 1200, which are spaced apart from one another in the transverse direction A, differs with respect to the respective assigned transfer element 206; 207. The second distance of two holding elements 1202 that are spaced apart from one another in the transverse direction A preferably differs in particular when the gripper shaft 221 is not arranged parallel to the transverse direction A and/or is arranged in a direction that differs from the transverse direction A. The respective second distance is preferably different from the first distance.

The mounting point S and the axis of rotation D are preferably adjusted relative to one another and/or can be adjusted relative to one another by the at least one servo drive 218, in particular at least by the at least one servo drive 218 assigned for the transport of sheets 02, more preferably by the at least one servo drive 218 intervening in the at least one cam mechanism. The mounting point S and the axis of rotation D are preferably adjusted relative to one another and/or can be adjusted relative to one another as a function of the detection of the preferably at least one respective sheet 02 by the sensor device 251, in particular by the at least one sensor 252, preferably the at least two sensors 252, of the sensor device 251. The at least one transport means 204 can be adjusted and/or adjusts and/or is adjusted in the transport direction T and/or transverse direction A as a function of the detection by the at least one sensor device 251.

The at least one drive lever 214 preferably scans the at least one rotational movement of the at least one cam mechanism by way of the at least one scanning element 213. Preferably in addition or as an alternative, the at least one drive lever 214 converts the at least one rotational movement of the at least one cam mechanism into at least one linear movement of the at least one transfer means 204.

The sheet 02, preferably the at least one sheet 02, preferably comprises the at least one printing mark 11, preferably at least two printing marks 11, for example exactly two printing marks 11, more preferably at least three printing marks 11. Above and below, the printing mark 11 is a mark, preferably for aligning the sheet 02 in the transport direction T and/or in the transverse direction A. The at least one printing mark 11 is configured to align the at least one substrate 02 in the transport direction T and/or in the transverse direction A. The at least one printing mark 11 for aligning the sheet 02 in the transport direction T and/or transverse direction A is preferably configured as a die-cutting mark 11. For example, the at least one printing mark 11 is, additionally or alternatively, configured to monitor a color register and/or a perfecting register. The at least one printing mark 11 is, for example, configured as a mark for monitoring a color register and/or, for example, as an element for color management 23, preferably for zonal color measurement, and/or, for example, for monitoring a perfecting register and/or preferably for aligning, in particular for a position determination on which the alignment is based, the at least one sheet 02 in the transport direction T and/or in the transverse direction A. For example, the at least one printing mark 11, for its function of aligning the sheet 02 in the transport direction T and/or transverse direction A in the sheet processing machine 01, additionally fulfills the function of an element for color management 23 and/or additionally the function of a register element 37; 38; 39; 41. The at least one printing mark 11 described above and below, also referred to as a die-cutting mark 11, is preferably at least configured as a mark for aligning, in particular for a position determination on which the alignment is based, the at least one sheet 02 in the transport direction T and/or in the transverse direction A. Preferably, the at least one printing mark 11 is configured as a mark for aligning the at least one sheet 02 in the processing machine 01, preferably in the at least one infeed unit 200.

Preferably, at least one print control strip 21 is provided on the at least one substrate 02. For example, the at least one print control strip 21 is generated in the prepress stage, for example as a digital data set. For example, the at least one print control strip 21 is at least present in digital form. For example, in addition or as an alternative, at least one tool of an application mechanism comprises at least one component, for example at least one control patch 22 and/or at least one component of a control patch 22, of the at least one print control strip 21. Preferably, this at least one component is transferred, during processing of the at least one substrate 02, to the at least one substrate 02 by this application mechanism.

The at least one sheet 02 preferably includes at least one print control strip 21, also referred to as color measurement strip. Hereafter, the at least one print control strip 21 is described based on its arrangement or configuration on a sheet 02. The configuration of the print control strip 21, and preferably its arrangement, can, for example, also be applied to substrates 02 different from sheets 02, for example, web-format substrates, and/or to print control strips 21 only present digitally, and are preferably identical for these. For example, the at least one sheet 02 includes a print control strip 21 on a first surface, preferably the upper side, of the at least one sheet 02 and/or a print control strip 21 on a second surface, preferably the underside, of the at least one sheet 02. The at least one print control strip 21 is preferably printed onto the sheet 02.

Preferably, the at least one print control strip 21 includes at least one control patch 22, preferably at least two control patches 22, more preferably at least eight control patches 22, more preferably at least ten control patches 22, more preferably at least twenty control patches 22, more preferably at least fifty control patches 22, more preferably at least one hundred control patches 22, more preferably at least one hundred fifty control patches 22, more preferably at least two hundred control patches 22, more preferably at least two hundred fifty control patches 22. Preferably, the at least one control patch 22, preferably all control patches 22, in each case comprise a partial region of the at least one print control strip 21, to which in each case at least one function is assigned. The functions of two different control patches 22 preferably differ from one another. Preferably, the at least one sensor device 251 is configured to detect and/or evaluate the at least one control patch 22, preferably at least two control patches 22, more preferably at least ten control patches 22, more preferably at least twenty control patches 22, more preferably at least fifty control patches 22, more preferably at least one hundred control patches 22, more preferably at least one hundred fifty control patches 22, more preferably at least two hundred control patches 22, more preferably at least two hundred fifty control patches 22, more preferably the at least one print control strip 21. For example, the at least one control patch 22 comprises a printed frame, for example in the color used for register marks, preferably black. For example, as an alternative, the at least one control patch 22 is frameless. For example, as an alternative, the at least one control patch 22 comprises an unprinted frame, wherein preferably at least one edge region of the at least one control patch 22 does not comprise any printing ink. The edge region of the at least one control patch 22 is preferably the region of the control patch 22 which adjoins the outer delimitation of the control patch 22 on all sides and/or preferably does not comprise any printed structures. The extension of the edge region to the height of the control patch 22 preferably has a ratio of no more than 0.5 (zero point five). The extension of the edge region to the width of the control patch 22 preferably has a ratio of no more than 0.5 (zero point five).

A direction that extends from a first side edge 09 to a second side edge 09 of the at least one sheet 02, or vice versa, is preferably the shortest connection between the two side edges 09 with respect to one another. A direction that extends from the trailing edge 08 to the leading edge 07 of the at least one sheet 02, or vice versa, is preferably the shortest connection between the trailing edge 08 and the leading edge 07 of the at least one sheet 02. The direction that extends from the first side edge 09 to the second side edge 09 of the at least one sheet 02 is preferably perpendicular to the direction that extends from the trailing edge 08 to the leading edge 07 of the at least one sheet 02, or vice versa.

Preferably, the width of the at least one print control strip 21 is its maximum extension in the transverse direction A, more preferably in the direction that extends from the first side edge 09 to the second side edge 09 of the at least one sheet 02. The at least one control patch 22 preferably has a width, preferably in the transverse direction A, more preferably in the direction that extends from the first side edge 09 to the second side edge 09 of the at least one sheet 02, of at least two millimeters, preferably of at least three millimeters, for example of four millimeters or, for example, of five millimeters. The at least one control patch 22 preferably has a width, preferably in the transverse direction A, more preferably in the direction that extends from the first side edge 09 to the second side edge 09 of the at least one sheet 02, of no more than twenty millimeters, preferably of no more than fifteen millimeters, more preferably of no more than ten millimeters, more preferably of no more than eight millimeters. Preferably, the height of the at least one print control strip 21 is its maximum extension in the transport direction T, more preferably in the direction that extends from the trailing edge 08 to the leading edge 07 of the at least one sheet 02. The at least one control patch 22 preferably has a height, preferably in the transport direction T, more preferably in the direction that extends from the trailing edge 08 to the leading edge 07 of the at least one sheet 02, of at least two millimeters, preferably of at least three millimeters, for example of three millimeters or, for example, of four millimeters. The at least one control patch 22 preferably has a height, preferably in the transport direction T, more preferably in the direction that extends from the trailing edge 08 to the leading edge 07 of the at least one sheet 02, of no more than twenty millimeters, preferably of no more than fifteen millimeters, more preferably of no more than ten millimeters, more preferably of no more than five millimeters. The control patches 22 are preferably arranged in the at least one print control strip 21 in a row and/or adjacent to one another and/or abutting one another. Preferably, the control patches 22 are arranged along the direction of the longitudinal extension of an edge 07; 08; 09, preferably along the leading edge 07, of the at least one sheet 02 in a row, preferably in one row, for example, alternatively, in at least two rows. An arrangement of the control patches 22 in a row preferably means that the centroids of the control patches 22 are arranged on a straight line. For example, as an alternative, the control patches 22 are arranged along the side edge 09 of the at least one sheet 02 in a row, preferably in one row, for example, alternatively, in at least two rows. Preferably, the at least two control patches 22, preferably all control patches 22, of the at least one print control strip 21 are arranged next to one another and/or in a row and/or abutting one another. More preferably, the at least two control patches 22, preferably all control patches 22, of the at least one print control strip 21 are arranged next to one another and/or in a row, preferably in one row, and/or abutting one another, in the direction that extends from the first side edge 09 to the second side edge 09 of the at least one sheet 02. Preferably, no print image elements of at least one print image, preferably of a print image of the end product to be generated, which differ from components of the at least one print control strip 21 are arranged between two control patches 22 that are adjacent to one another.

Preferably, at least one sensor 252 of the at least two sensors 252 is, preferably the at least two sensors 252 are, configured to detect the at least one print control strip 21 of the at least one sheet 02. Preferably, the at least one sensor device 251 is configured to evaluate at least one control patch 22, preferably the control patches 22, of the at least one print control strip 21.

The at least one print control strip 21 includes at least one control patch 22 configured as an element for color management 23 and/or at least one, preferably at least two, more preferably at least four, control patches 22 configured as print register elements 24, for example at least one print register element 24 used to set at least one printing unit, and/or at least one, preferably at least two, control patches 22 configured as a printing mark 11 and/or at least one, preferably at least two, control patches 22 configured as a side recognition mark 26 and/or at least one, preferably at least two, control patches 22 configured as a plate recognition patch 27 and/or at least one, preferably at least two, control patches 22 configured as an information mark 28 and/or at least one, preferably at least two, control patches 22 configured as a reference patch 29. The at least one printing mark 11 is more preferably at least one printing mark 11 at least for aligning the at least one sheet 02 in the sheet processing machine 01, for example in the at least one infeed system 202. The at least one printing mark 11 is configured so as to align a substrate 02, which is preferably configured as a sheet 02, in the transport direction T and/or in the transverse direction A. This means, for example, that a printing mark 11 cooperating with the at least one sensor device 251, and for example, additionally, with the at least one control system 1100, for aligning the at least one sheet 02 is provided on the substrate 02, which is preferably configured as a sheet 02. For example, the at least one printing mark 11 is configured as an alignment mark and, within the control patch 22, is preferably completely surrounded by an unprinted and/or differently colored and/or unicolor region. Preferably, the at least one printing mark 11 is situated adjacent to at least one element for color management 23, preferably without further control patches 22 therebetween. Preferably, in addition or as an alternative, the at least one side recognition mark 26 is situated adjacent to at least one element for color management 23, preferably without further control patches 22 therebetween. Preferably, in addition or as an alternative, the at least one print register element 24 is situated adjacent to at least one element for color management 23, preferably without further control patches 22 therebetween. Preferably, in addition or as an alternative, the at least one plate recognition patch 27 is situated adjacent to at least one element for color management 23, preferably without further control patches 22 therebetween. Preferably, in addition or as an alternative, the at least one information mark 28 is situated adjacent to at least one element for color management 23, preferably without further control patches 22 therebetween. Preferably, in addition or as an alternative, the at least one reference patch 29 is situated adjacent to at least one element for color management 23, preferably without further control patches 22 therebetween. Preferably, in addition or as an alternative, the at least one element for color management 23 is situated adjacent to at least one further element for color management 23, preferably without further control patches 22 therebetween.

Preferably, the at least one sheet 02, preferably the at least one print control strip 21, comprises at least one element for color management 23, preferably at least two elements for color management 23, more preferably at least four elements for color management 23, more preferably at least eight elements for color management 23, more preferably at least as many elements for color management 23 as printing colors are used to generate the print image. The at least one print control strip 21 preferably includes at least two elements for color management 23 having printing colors that differ from one another. Preferably, the at least one sheet 02, preferably the at least one print control strip 21, includes at least fifty, more preferably at least one hundred, more preferably at least one hundred fifty, for example at least two hundred, elements for color management 23. Preferably, a respective control patch 22 is configured as an element for color management 23. More preferably, the at least one sheet 02, preferably the at least one print control strip 21, includes the at least one control patch 22 configured as an element for color management 23. Preferably, at least one control patch 22 of the print control strip 21 is configured as an element for color management 23. Preferably at least one, preferably at least two, more preferably at least three, more preferably at least four, more preferably at least eight, for example ten, colors of the colors black and/or yellow and/or red and/or blue and/or green and/or cyan and/or magenta and/or special colors are used as printing inks and/or are contained in at least one print image of the at least one sheet 02 and/or are contained in the at least one print control strip 21. Above and below, a printing ink, also referred to as a printing fluid, denotes inks, printing colors and/or coating materials and/or further materials, which are applied and/or can be applied by at least one processing machine, for example a printing press, or at least one application mechanism or a unit of the processing machine configured as an application unit, in particular at least one printing mechanism or printing assembly or at least one finish coating mechanism or finish coating assembly of the printing press, onto a substrate 02, for example onto the at least one sheet 02. Inks and printing inks are preferably solutions or dispersions of at least one colorant in at least one solvent. For example, water and/or organic solvents can be used as solvents. Some inks are relatively low viscosity printing fluids, while others are relatively high viscosity printing fluids. Some inks contain no binding agent or relatively little binding agent, whereas others preferably contain a relatively large amount of binding agent, and more preferably contain additives. Colorants can be pigments and/or dyes, wherein pigments are insoluble in the respective solvent, while dyes are soluble in the respective solvent. In particular inks that contain dyes as the colorant preferably do not contain any binding agents. As an alternative or in addition, the printing fluid is embodied as printing fluid that cures under UV light. Above and below, when printing inks are mentioned, this in particular also includes colorless coating materials. Coating materials are water-based, for example, or embodied as UV coating materials, that is, curing under UV light. The at least one printing color is preferably black or yellow or red or blue or green or cyan or magenta or at least one special color, for example a printing color having a metallic look, or a mixed ink made up of the aforementioned colors, for example brown or orange or violet.

Preferably, the at least one element for color management 23 in each case comprises one, preferably in each case a single, printing ink, preferably a printing ink of the colors black or yellow or red or blue or green or cyan or magenta or special colors. Preferably, two elements for color management 23 arranged adjacent to one another comprise printing inks that differ from one another or the same printing ink having differing color densities. Preferably, at least two control patches 22 situated next to one another are in each case configured as an element for color management 23. Preferably, the at least one control patch 22 configured as an element for color management 23 is, preferably the at least two control patches 22 configured as elements for color management 23 are, arranged within the at least one print control strip 21 so that optimal contrast exists of the present printing inks of the control patches 22, preferably of the elements for color management 23, with respect to one another. Preferably, the elements for color management 23 of different printing inks, preferably in each case at least one element for color management 23 per printing ink used, are arranged next to one another and/or in a row and/or abutting one another within the at least one print control strip 21. For example, the order in which the elements for color management 23 are arranged is dependent on the printing inks used, preferably from the darkest printing ink to the lightest printing ink, or vice versa. Preferably, in each case at least one element for color management 23 per printing ink used is arranged, without further control patches 22 having different functions, such as for example a print register element 24 and/or a side recognition mark 26 and/or an information mark 28 and/or a reference patch 29 and/or a printing mark 11, therebetween, next to one another and/or in a row and/or abutting one another, within the at least one print control strip 21. For example, in this way at least two, preferably at least four, for example at least eight, elements for color management 23 of differing printing inks are arranged directly next to one another. Preferably, at least two, more preferably at least four, more preferably at least eight, for example at least twenty, elements for color management 23 of a printing color, preferably at least two solid-color patches 32; 34 of a printing color and/or at least two screen dot patches 33; 36 of a printing color are arranged distributed across the width of the at least one print control strip 21. The sequence of the elements for color management 23 preferably recurs within the at least one print control strip 21. More preferably, the order of the arrangement of the elements for color management 23 of the differing printing colors recurs in the at least one print control strip 21, more preferably the order recurs at least four times, more preferably at least twenty times.

Preferably, the at least one element for color management 23 of a printing color is, preferably in each case, embodied as a solid-color patch 32; 34 or as a screen dot patch 33; 36 of the printing color. Preferably, every point of the surface area, preferably 100% (one hundred percent) of the surface area, of an element for color management 23 embodied as a solid-color patch 32; 34 is covered with printing ink. Preferably, no more than 99% (ninety-nine percent) of the surface area of an element for color management 23 embodied as a screen dot patch 33; 36 is covered with printing ink. Preferably, the at least one print control strip 21 includes at least one solid-color patch 32; 34 for each printing ink, preferably for each printing ink used to print the at least one sheet 02. More preferably, the at least one print control strip 21 includes at least one solid-color patch 32; 34 and at least one screen dot patch 33; 36 for each printing ink, preferably for each printing ink used to print the at least one sheet 02. Preferably, the solid-color patch 32; 34 and the at least one screen dot patch 33; 36 of the same printing ink are arranged next to one another and/or in a row and/or abutting one another, within the at least one print control strip 21, preferably without further elements for color management 23 of a different printing color therebetween. For example, the at least one print control strip 21 comprises at least two, preferably at least three, for example four, screen dot patches 33; 36 of the same printing color, which more preferably are arranged next to one another and/or in a row and/or abutting one another.

Preferably, at least 5% (five percent) of the surface area, preferably at least 10% (ten percent), and/or no more than 35% (thirty-five percent) of the surface area, more preferably no more than 30% (thirty percent), for example 20% (twenty percent) of the surface area, of the at least one screen dot patch 33; 36, more preferably of at least one of the at least two screen dot patches 33; 36, is covered with printing ink. Preferably, alternatively, at least 35% (thirty-five percent) of the surface area, preferably at least 40% (forty percent), and/or no more than 65% (sixty-five percent) of the surface area, more preferably no more than 60% (sixty percent), for example 50% (fifty percent) of the surface area, of the at least one screen dot patch 33; 36, more preferably of at least one of the at least two screen dot patches 33; 36, is covered with printing ink. Preferably, alternatively, at least 65% (sixty-five percent) of the surface area, preferably at least 70% (seventy percent), and/or no more than 95% (ninety-five percent) of the surface area, more preferably no more than 90% (ninety percent), for example 80% (eighty percent) of the surface area, of the at least one screen dot patch 33; 36, more preferably of at least one of the at least two screen dot patches 33; 36, is covered with printing ink. The at least one screen dot patch 33; 36 preferably comprises at least one, preferably at least two, more preferably at least four, more preferably at least ten, more preferably at least twenty, screen dots. For example, the at least one screen dot of the at least one screen dot patch 33; 36 is configured as at least one circular dot and/or at least one square dot and/or at least one polygonal dot and/or at least one chain dot and/or at least one elliptical dot.

Preferably, the screening process used is amplitude modulation or frequency modulation or intensity modulation, or a mixture thereof. In the case of amplitude modulation, the dots, preferably the at least two dots of the at least one screen dot patch 33; 36, more preferably the at least four dots of the at least one screen dot patch 33; 36, are preferably spaced the same distance apart and have differing diameters, for example have differing surface areas, depending on the dot. In the case of frequency modulation, the dots, preferably the at least two dots of the at least one screen dot patch 33; 36, more preferably the at least four dots of the at least one screen dot patch 33; 36, preferably have the same diameter and are spaced differing distances apart. Preferably, in the case of frequency modulation, the dots, preferably the at least two dots of the at least one screen dot patch 33; 36, more preferably the at least four dots of the at least one screen dot patch 33; 36, are arranged so as to be randomly distributed with respect to one another. For example, as an alternative, a hybrid technique is employed, in which both amplitude modulation and frequency modulation are used, depending on the image. The hybrid technique uses, for example, frequency modulation screening for very light and very dark tones, and amplitude modulation screening for the remaining tonal value range. For example, as an alternative, modulation of the ink film thickness is used, wherein a tonal value is preferably varied through the surface area of the at least one dot and the thickness of the ink film on the sheet 02. For example, as an alternative, a mixture of two or all of the above-described modulation types is present. Above and below, the tonal value is a measure of the optical impression of a screened area, preferably stated as a percentage, where an unprinted area has a tonal value of 0%, and a fully printed area, referred to as a solid tone area, has a tonal value of 100%. When screening, the tonal value represents the ratio, in percent, of the halftone dots to the entire area. The screen dot patch 33; 36 preferably has an arrangement and structure of the dots, wherein preferably either the screen dots have the same size and are spaced the same distance apart, or they vary in size and are spaced the same distance apart, or the screen dots have the same size and are spaced variable distances apart, or they vary in size and are spaced variable distances apart.

Figure 23:
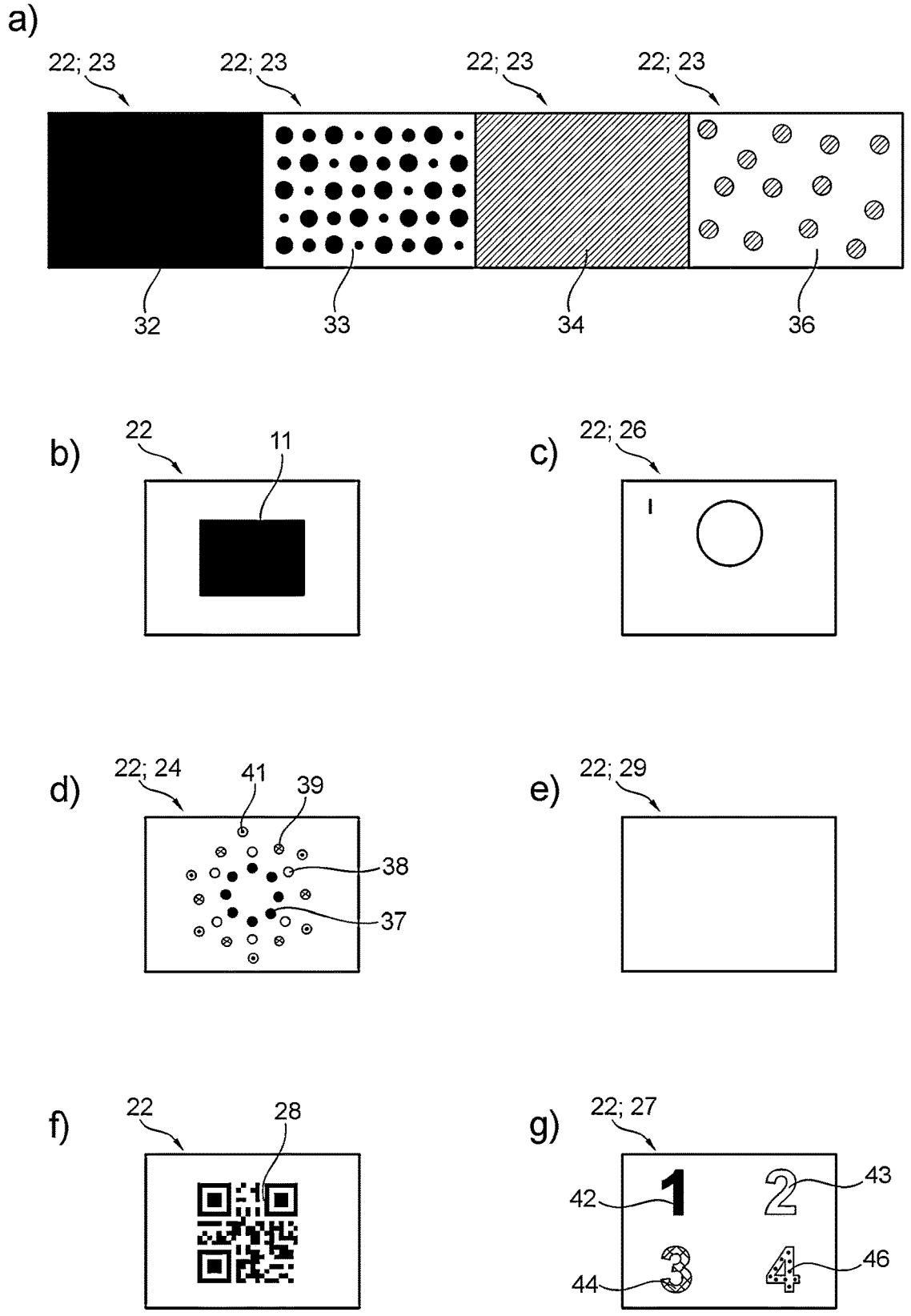
FIG. 23 a print control strip including a) control patches configured as elements for color management; b) a control patch configured as a printing mark; c) a control patch configured as a side recognition mark; d) a control patch which has an arrangement of print register elements of four printing colors that differ from one another; e) a control patch configured as a reference patch; f) a control patch configured as an information mark; and g) a control patch configured as a plate recognition patch.

Preferably, at least one element for color management 23, for example a first element for color management 23, of the elements for color management 23 is configured as a solid-color patch 32 of a first printing color. For example, the solid-color patch 32 of the first printing color is shown as a black area in FIG. 23*a*. Preferably, at least one element for color management 23, for example a second element for color management 23, of the elements for color management 23 is configured as a solid-color patch 34 of a second printing color different from the first printing color. For example, the solid-color patch 34 of the second printing color is shown as a hatched area in FIG. 23*a*. Preferably, in addition or as an alternative, at least one element for color management 23, for example a third element for color management 23, of the elements for color management 23 is configured as a screen dot patch 33 of the first printing color. For example, the dots of the screen dot patch 33 of the first printing color shown in FIG. 23*a* are spaced the same distance apart, but have different sizes. Preferably, in addition or as an alternative, at least one element for color management 23, for example a fourth element for color management 23, of the elements for color management 23 is configured as a screen dot patch 36 of the second printing color. For example, the dots of the screen dot patch 36 of the second printing color shown in FIG. 23*a* are spaced differing distances apart, but have an identical size.

The at least one element for color management 23 is preferably configured for zonal color measurement, preferably at least one measurement of the color density, for example the optical color density and/or the spectral color density, for example by densitometry, and/or a measurement of at least one spectral value, for example by spectrophotometry, and/or a measurement of the area coverage of the preferably individual printed printing inks. The color density is preferably measured by means of densitometry, wherein preferably the volume of ink per unit area is determined. Preferably, the relative printing contrast and/or ink trapping are determined by measuring the color density. The relative printing contrast is preferably determined from at least one measured value of the color density in the solid-color patch 32; 34 relative to at least one measured value of the color density in at least one screen dot patch 33; 36 of the same printing ink. Ink trapping is preferably the overprinting of at least two colored solid areas of differing printing inks. Ink trapping is preferably determined from at least two measured values of color densities of solid-color overprint patches and describes by how many percent a first printing ink lies over a second printing ink. The ink trapping of a solid-color patch 32; 34 that has only one printing color is preferably 100% (one hundred percent).

Preferably, the at least one element for color management 23 has an area coverage, preferably a coverage with printing ink of the region of the sheet 02 onto which the element for color management 23 is printed. The at least one print control strip 21 preferably comprises the at least one element for color management 23, more preferably at least two elements for color management 23, more preferably at least four elements for color management 23, preferably elements for color management 23 for solid colors and/or halftones and/or gray balance and/or solid color overlap print. Preferably, a respective element for color management 23 is in each case arranged in a control patch 22 of the at least one print control strip 21.

Preferably, at least one, for example at least two, control patches 22 of the at least one print control strip 21 are configured as print register elements 24. The at least one print register element 24 is preferably configured to monitor a color register and/or a perfecting register. For example, the at least one print control strip 21 includes at least one first print register element 24, which has a shorter distance with respect to the first side edge 09 than with respect to the second side edge 09 of the at least one sheet 02. Preferably, in addition or as an alternative, the at least one print control strip 21 includes at least one second print register element 24, which has a shorter distance with respect to the second side edge 09 than with respect to the first side edge 09 of the at least one sheet 02.

The at least one print register element 24 preferably comprises at least one register element 37; 38; 39; 41. Preferably, the at least one print register element 24 preferably in each case comprises at least one, preferably at least two, more preferably at least four, more preferably at least six, for example eight or nine, register elements 37; 38; 39; 41 of a printing ink. Preferably, the at least one print register element 24 preferably in each case comprises at least one, preferably at least two, more preferably at least four, more preferably at least six, for example eight or nine, register elements 37; 38; 39; 41 of at least two printing colors that differ from one another, preferably of at least four printing colors that differ from one another, for example of six printing colors that differ from one another, more preferably per printing color to be used for printing the at least one sheet 02. The at least one register element 37; 38; 39; 41 is preferably configured as a geometric shape, preferably as a circle or an ellipse or a polygon or a cross or a line. The at least one register element 37; 38; 39; 41 is preferably filled with printing ink, preferably across the entire area.

For example, the at least one print control strip 21 includes at least two control patches 22, which are each configured as print register elements 24 and are arranged so as to abut one another, in particular without further control patches 22 having different functions therebetween. For example, a first print register element 24 of the at least two print register elements 24 comprises at least one first register element 37 of at least one first printing color. Preferably, a second print register element 24 of the at least two print register elements 24 comprises at least one second register element 38; 39; 41 of at least one printing color that is different from the first printing color. For example, each of the at least two print register elements 24 comprises at least one register element 37; 38; 39; 41, wherein preferably at least two register elements 37; 38; 39; 41 of a printing ink are arranged in the same print register element 24. For example, the at least two, for example at least four, register elements 37; 38; 39; 41 of differing printing inks are arranged distributed between the at least two print register elements 24.

For example, two register elements 37; 38; 39; 41 of the at least one print register element 24 are arranged at a distance of greater than zero with respect to one another. Preferably, the register elements 37; 38; 39; 41 of the at least one print register element 24 are arranged at differing distances with respect to one another. Preferably, the at least two register elements 37; 38; 39; 41 of differing printing inks are arranged spaced apart from one another, at a distance of greater than zero, within the at least one print register element 24.

Preferably, the at least two, preferably at least four, more preferably at least six, preferably eight or nine, register elements 37; 38; 39; 41 of a printing ink are arranged at the same distance with respect to a point of the print register element 24 which is preferably configured to be the center. Preferably, the at least two, preferably at least four, more preferably at least six, for example eight or nine, register elements 37; 38; 39; 41 of a printing ink are arranged in a circular shape with respect to one another. Preferably, the radius of the arrangement of the register elements 37; 38; 39; 41 of a printing ink differs from the radius of the arrangement of register elements 37; 38; 39; 41 of a printing ink that is different therefrom. The arrangement of the register elements 37; 38; 39; 41 of the color for register marks, preferably black, preferably has the smallest radius. The arrangements of the register elements 37; 38; 39; 41 preferably have a shared center of the arrangement. For example, a radial arrangement of the register elements 37; 38; 39; 41 of the differing printing inks arises, that is, proceeding radially from a center.

Preferably, the at least two, preferably at least four, more preferably at least six, for example eight or nine, register elements 37 of a first printing color, shown by way of example filled in black in FIG. 23*d*, have a first preferably circular arrangement having a first radius. The first printing color is preferably the color for register marks, for example black. Preferably, the at least one print register element 24 has at least one second preferably circular arrangement of the register elements 38 of a second printing color, shown by way of example by an unfilled element in FIG. 23*d*, having a second radius. Preferably, the at least one print register element 24 has at least one third circular arrangement of the register elements 39 of a third printing color, shown by way of example by crossed hatching in FIG. 23*d*, having a third radius. Preferably, the at least one print register element 24 has at least one fourth circular arrangement of the register elements 41 of a fourth printing color, shown by way of example by dots in FIG. 23*d*, having a fourth radius. The first circular arrangement preferably has a smaller circular radius than the second and/or third and/or fourth arrangements.

The at least one print register element 24 is preferably configured to monitor a color register and/or a perfecting register. In accordance with DIN 16500-2, a color register, for example in multicolor printing, exists when individual print images/color separations are combined in precise alignment to form a single image The color register is also referred to as a color register system. Registration refers to the exact alignment of a print image on the front and back sides of a substrate that is printed on both sides (DIN 16500-2). Preferably, the arrangement of the at least one register element 37; 38; 39; 41 in the print register element 24 determines the printing plate that is used for printing this at least one register element 37; 38; 39; 41. The arrangement of the at least one register element 37; 38; 39; 41 in the print register element 24 preferably has a location code. Preferably, a respective printing plate is assigned to the at least one register element 37; 38; 39; 41. Preferably, the at least one sensor 252 of the at least one sensor device 251 is configured to detect and/or evaluate the at least one print register element 24.

For example, the at least one processing machine 01 comprises the at least one, preferably at least two, more preferably at least four, more preferably at least six, more preferably at least eight, for example ten, application mechanisms, preferably at least one printing mechanism and/or at least one finish coating mechanism. The at least one application mechanism of the processing machine 01 is preferably arranged upstream from at least the at least one shaping unit 300, and preferably is arranged upstream thereof in the transport direction T. For example, as an alternative, at least one printing press, which comprises the at least one application mechanism, is arranged upstream from the at least one processing machine 01. For example, the at least one application mechanism is configured to print the at least one sheet 02 with printing ink. For example, the at least one application mechanism is configured to print the at least one sheet 02 according to the offset method or according to the gravure printing method or according to the flexographic printing method or according to a plateless printing method. For example, at least two application mechanisms, which operate according to different methods, are used for printing the at least one sheet 02. Preferably at least one tool of the at least one application mechanism generating at least one print image, preferably at least one printing plate and/or at least one print head and/or at least one forme cylinder, is adjusted and/or aligned and/or moved for alignment, based on an evaluation of the at least one print register element 24.

At least one, preferably at least two, for example four, control patches 22 of the at least one print control strip 21 are preferably configured as side recognition marks 26. For example, the at least one print control strip 21 includes at least one first side recognition mark 26, which is situated at a shorter distance with respect to the first side edge 09 than with respect to the second side edge 09 of the at least one sheet 02. Preferably, in addition or as an alternative, the at least one print control strip 21 includes at least one second side recognition mark 26, which is situated at a shorter distance with respect to the second side edge 09 than with respect to the first side edge 09 of the at least one sheet 02. Preferably, the at least one side recognition mark 26 has an optical pattern, which preferably differs from optical patterns of other control patches 22 having different functions. For example, a print control strip 21, which is arranged on the first surface of the at least one sheet 02, this being its upper side, comprises at least one side recognition mark 26, whose pattern differs from the pattern of at least one side recognition mark 26 of another print control strip 21 on the second surface of the at least one sheet 02, this being its underside. The at least one side recognition mark 26 preferably has a first pattern when the side recognition mark is arranged on the upper side of the at least one sheet 02, and/or the at least one side recognition mark 26 preferably has a second mark when the side recognition mark is arranged on the underside of the at least one sheet 02. For example, the at least one control patch 22 configured as a side recognition mark 26 has at least one pattern, the pattern preferably being configured as at least one, for example at least two, printed geometric figures, for example at least one circle and/or at least one ellipse and/or at least one line and/or at least one polygon, or as at least one number or as at least one letter. For example, the at least one side recognition mark 26 arranged on the upper side of the at least one sheet 02 has one circle and one line. For example, the at least one side recognition mark 26 arranged on the underside of the at least one sheet 02 has one circle and two lines. The at least one side recognition mark 26 preferably allows the at least one print control strip 21 to be assigned to the side of the at least one sheet 02 on which the at least one print control strip 21 is printed, that is, the upper side or the underside of the at least one sheet 02. The at least one side recognition mark 26 is preferably used to distinguish on which side, this being the upper side or the underside, of the at least one sheet 02 the at least one print control strip 21 is printed. The at least one side recognition mark 26 is preferably configured to assign the at least one print control strip 21, and/or is configured for its assignment, to a surface of the at least one substrate 02, which is preferably configured as a sheet 02, on which the at least one print control strip 21 is situated and/or to be situated.

Preferably, the at least one side recognition mark 26 is detected and evaluated either in the processing machine 01 or offline, for example at at least one measuring station and/or control console. Preferably, at least one sensor of a measuring system, for example at least one camera and/or at least one color sensor, is configured to recognize the at least one side recognition mark 26. Preferably, the at least one side recognition mark 26 is recognized and/or evaluated by at least one measuring system, preferably its sensors, which is arranged at at least one measuring table and/or control console of the processing machine 01. For example, in addition or as an alternative, the at least one sensor device 251 of the processing machine 01 is configured to detect and/or evaluate the at least one side recognition mark 26.

At least one control patch 22 of the at least one print control strip 21 is configured as a plate recognition patch 27. Preferably, the at least one plate recognition patch 27 includes at least one, preferably at least two, more preferably at least four, more preferably at least eight, for example ten, elements for plate recognition 42; 43; 44; 46. Preferably, a respective element for plate recognition 42; 43; 44; 46 is assigned in each case to one printing ink. Preferably, in addition or as an alternative, a respective element for plate recognition 42; 43; 44; 45 is printed in each case by one printing ink. Preferably, a respective element for plate recognition 42; 43; 44; 46 is in each case assigned to an application mechanism, preferably a printing mechanism or finish coating mechanism, and/or is printed in each case by an application mechanism. Preferably, the at least one print control strip 21, preferably the at least one plate recognition patch 27, includes at least two, preferably at least four, more preferably at least eight, for example ten, elements for plate recognition 42; 43; 44; 46. Preferably, the at least one print control strip 21 comprises as many elements for plate recognition 42; 43; 44; 46 as printing inks and/or application mechanisms were used for processing, in particular, for printing, the at least one sheet 02, and/or, as many as there are application mechanisms in the at least one processing machine 01, for example, or alternatively, as many as a printing press arranged upstream from the processing machine 01 comprises. As an example, at least two control patches 22 are in each case embodied as plate recognition patches 27, wherein preferably each of the at least two control patches 22 includes at least one element for plate recognition 42; 43; 44; 46. The at least two plate recognition patches 27 are preferably arranged in a row and/or next to one another and/or adjacent to one another and/or abutting one another, more preferably without control patches 22 having other functions therebetween. The at least two plate recognition patches 27 preferably include elements for plate recognition 42; 43; 44; 46 that differ from one another. For example, the elements for plate recognition 42; 43; 44; 46 are arranged distributed between at least two plate recognition patches 27. The at least one element for plate recognition 42; 43; 44; 46 preferably has a two-dimensional form, preferably a planar geometric figure, for example a polygon or a circle or an ellipse, and includes preferably a number or preferably a letter. The at least two elements for plate recognition 42; 43; 44; 46 are preferably configured as forms that differ from one another, preferably as planar geometric figures that differ from one another or as digits that differ from one another or as letters that differ from one another. A mixture is also possible, wherein a first element for plate recognition is configured as a first form, for example a number, and a second element for plate recognition is configured as a second form that is different from the first form, for example a letter.

A control patch 22 configured as a plate recognition patch 27 is shown in FIG. 23*g* by way of example. A first element for plate recognition 42 having the form of the number one has a first printing color, shown by being filled in black by way of example. A second element for plate recognition 43 having the form of the number two has a second printing color, shown by an unfilled element by way of example. A third element for plate recognition 44 having the form of the number three has a third printing color, shown by crossed hatching by way of example. A fourth element for plate recognition 46 having the form of the number four has a fourth printing color, shown by dots by way of example.

The at least one plate recognition patch 27 preferably enables an unambiguous assignment of the printing color used to a printing plate and/or to an application mechanism, in particular a printing mechanism and/or finish coating mechanism, and thus preferably the assignment of a printing color to a pattern to be printed. The at least one plate recognition patch 27 is preferably configured so as to assign at least one printing color used to a printing plate and/or to an application mechanism and/or configured for its assignment. Preferably, it is monitored whether the assignment corresponds to the job data, preferably a reference.

Preferably, at least one control patch 22 of the at least one print control strip 21 is configured as an information mark 28. For example, the at least one information mark 28 is configured as a code, for example as a matrix code 28 or a barcode or as a series of numbers or a series of characters. The at least one information mark 28 preferably includes information of the at least one print control strip 21, preferably job data, more preferably job data regarding the at least one processing process, and/or preferably reference values of the control patches 22 of the at least one control strip 21. Preferably, in addition or as an alternative, the at least one information mark 28 includes information regarding arrangement rules, for example of the arrangement of the at least one print control strip 21 and/or of the at least one print image and/or of the at least one die-cut pattern on the at least one sheet 02 and/or the arrangement of the components of the processing machine 01 used for processing. Preferably, the at least one sensor of the at least one measuring system and/or the at least one sensor 252 of the at least one sensor device 251 are configured to detect the at least one information mark 28 and/or are preferably configured to read out the information of the information mark 28. Advantageously, this allows the processing process and/or the job-specific specifications to be monitored easily and quickly. This preferably offers relief to an operator and/or shortens the duration of a monitoring process.

The at least one print control strip 21 preferably includes at least one control patch 22 configured as a reference patch 29, for example at least two, preferably at least four, for example six, control patches 22, which are each configured as reference patches 29. The at least one reference patch 29 preferably only has the surface of the at least one sheet 02 primed, for example provided with at least one primer and/or priming agent. For example, the at least one control patch 22 configured as a reference patch 29 has a paper white surface of the at least one sheet 02. The at least one reference patch 29 is preferably unprinted and/or free of printing ink. The at least one reference patch 29 preferably has a color density of 0% (zero percent) and/or a tonal value of 0% (zero percent). For example, at least one reference patch 29 is, preferably two mutually abutting reference patches 29 are, arranged in the at least one print control strip 21 such that the at least one reference patch 29 marks, preferably the two mutually abutting reference patches 29 mark, the center, preferably half the extension, of the at least one print control strip 21, more preferably the center of the at least one print control strip 21 along the direction that extends from the first side edge 09 to the second side edge 09 of the at least one sheet 02. In the case of two mutually abutting reference patches 29, the center of the at least one print control strip 21 is preferably the shared delimitation of the two control patches 22. For example, the at least one print control strip 21, additionally or alternatively to the at least one reference patch 29 marking the center of the at least one print control strip 21, includes at least one further reference patch 29, which is arranged, for example, between at least one element for color management 23 and at least one side recognition mark 26 or which is arranged between two elements for color management 23.

The at least one reference patch 29 is preferably configured to set and/or to adjust the at least one sensor of the at least one measuring system. The at least one reference patch 29 is preferably configured to set and/or to adjust the at least one sensor 252, preferably the at least one sensor 252 of the at least two sensors 252, of the at least one sensor device 251, preferably at least with respect to setting and/or adjusting the zero point, preferably at least for use during zonal color measurement and/or of the sensitivity of the at least one sensor of the at least one measuring system and/or of the at least one sensor 252 of the at least one sensor device 251. In particular, a color density of 0% (zero percent) and/or a tonal value of 0% (zero percent), as a result of the detection and evaluation of the at least one reference patch 29, in particular for the evaluation of the at least one element for color management 23, is specified for the at least one sensor of the at least one measuring system and/or the at least one sensor 252 of the at least one sensor device 251.

The at least one element for color management 23 and the at least one print register element 24 and the at least one printing mark 11 are preferably different elements of the at least one print control strip 21. As an alternative, for example, the at least one printing mark 11 is configured both to align the sheet 02 in the transport direction T and/or transverse direction A, and as at least one element for color management 23 and/or as a print register element 24 of a printing ink, for example for monitoring a color register and/or a perfecting register.

The at least one print control strip 21 is preferably positioned on the at least one sheet 02 in a region outside the at least one print image and/or in an edge region of the at least one sheet 02 and/or preferably in the region of the leading edge 07 and/or preferably spaced apart from the leading edge 07. The at least one substrate 02, which is preferably configured as a sheet 02, preferably comprises the at least one multiple-up 03 and the at least one offcut piece 04; 05; 06. Preferably, an edge region of the at least one sheet 02 is part of the at least one offcut piece 04; 05; 06. The at least one print control strip 21 has preferably been positioned and/or is to be positioned and/or is positioned, preferably printed and/or to be printed, on the at least one offcut piece 04; 05; 06. The at least one print control strip 21 is preferably situated outside the at least one multiple-up 03. The at least one print control strip 21 and/or the at least one printing mark 11 are preferably separated from the at least one multiple-up 03 before the end product is finished. For example, as an alternative, the at least one print control strip 21 is integrated into at least one print image of the at least one sheet 02. The at least one print control strip 21 is preferably arranged within the at least one multiple-up 03.

The at least one print control strip 21 and/or the at least one printing mark 11 are preferably spaced apart from the leading edge 07 of the at least one sheet 02. The at least one sheet 02 preferably has an overall length, this being the distance between the leading edge 07 and the trailing edge 08 of the at least one sheet 02.

Preferably, the at least one sheet 02, preferably in a first embodiment, is fed to the sheet processing machine 01 in such a way that the at least one printing mark 11 and/or the at least one print control strip 21 are preferably positioned, on the at least one sheet 02, preferably on its upper side and/or on its underside, at the front in the transport direction T and/or preferably in the region of the leading edge 07 and/or preferably spaced apart from the leading edge 07. Preferably in the first embodiment, a ratio of the overall length of the at least one sheet 02 to the distance between the at least one print control strip 21, preferably the at least one printing mark 11, and the leading edge 07 of the at least one sheet 02 is preferably at least 4.0 (four point zero), more preferably at least 6.0 (six point zero), more preferably at least 8.0 (eight point zero). Since the at least one sheet 02 is held or guided, preferably at least at its leading edge 07, by at least one element of the processing machine 01, for example by the at least one transport means 204 or the at least one holding element 1202, while the at least one sheet 02 is being transported and/or being processed, the position of the leading edge 07 is preferably unambiguously defined or determined at preferably every point of the transport path. In this way, a simple and unambiguous recognition of the at least one printing mark 11 and/or of the print control strip 21 are preferably possible in the region of the leading edge 07.

For example, as an alternative, in a second embodiment, the ratio of the overall length of the at least one sheet 02 to the distance between the at least one print control strip 21, preferably the at least one printing mark 11, and the leading edge 07 of the at least one sheet 02 is no more than 1.33 (one point thirty-three), more preferably no more than 1.0 (one point zero). In particular in package printing, preferably when the at least one sheet is made of cardboard or corrugated cardboard, the distance between the at least one print control strip 21, preferably the at least one printing mark 11, and the leading edge 07 is greater than the distance between the at least one print control strip 21, preferably the at least one printing mark 11, and the trailing edge 07. Preferably, the at least one print control strip 21 and/or the at least one printing mark 11 are printed onto at least one offcut piece 04; 05; 06 of the at least one sheet 02, preferably a crosspiece 05 in the region of the trailing edge 08. Preferably, the at least one print control strip 21 and/or the at least one printing mark 11 can thus preferably be easily separated from the at least one multiple-up 03 before the end product is finished, for example by way of die cutting. The at least one print control strip 21 and/or the at least one printing mark 11 are preferably separated from the at least one multiple-up 03 before the end product is finished.

For example, as an alternative, preferably in a third embodiment, the ratio of the overall length of the at least one sheet 02 to the distance between the at least one print control strip 21, preferably the at least one printing mark 11, and the leading edge 07 of the at least one sheet 02 is at least 1.33 (one point three three), more preferably at least 1.5 (one point five), more preferably at least 1.9 (one point nine), and no more than 4.0 (four point zero), preferably no more than 3.5 (three point five), more preferably no more than 3.0 (three point zero), more preferably no more than 2.5 (two point five). In this way, the at least one print control strip 21 and/or the at least one printing mark 11 are preferably arranged in a central region of the at least one sheet 02. This is preferably used, in particular, in processing machines 01 which provide turning of the at least one sheet 02. Preferably, in this way one print control strip 21 is sufficient, instead of at least two print control strips 21, for example one print control strip 21 in the region of the leading edge 07 and one print control strip 21 in the region of the trailing edge 08.

The at least one printing mark 11 is, preferably the at least two printing marks 11 are, integrated into the at least one print control strip 21. Preferably, the at least one print control strip 21 includes at least two, preferably two, for example alternatively three, printing marks 11. Preferably, at least one control patch 22 of the at least one print control strip 21 is in each case configured as the at least one printing mark 11. Preferably, the at least two printing marks 11 are preferably arranged spaced apart from one another. Preferably, in addition or as an alternative, at least one control patch 22 having a different function is arranged between the at least two printing marks 11, preferably at least one, preferably at least four, more preferably at least fifty, elements for color management 23 and/or at least one, for example at least two, preferably two, side recognition marks 26 and/or at least one, for example at least two, preferably three, print register elements 24 and/or at least one, for example at least two, preferably two, reference patches 29 and/or at least one, for example at least two, preferably one, information mark 28 and/or at least one, for example at least two, plate recognition patches 27. Preferably, in addition or as an alternative, at least one printing mark 11 of the at least two printing marks 11 has a smaller distance with respect to the first side edge 09 of the at least one sheet 02 than with respect to its second side edge 09, and at least one second printing mark 11 of the at least two printing marks 11 has a smaller distance with respect to the second side edge 09 of the at least one sheet 02 than with respect to its first side edge 09. Preferably, in addition or as an alternative, the at least two printing marks 11 are preferably arranged symmetrically with respect to an axis of symmetry of the at least one print control strip 21. Preferably, at least two printing marks 11 are integrated into the at least one print control strip 21, wherein the at least two printing marks 11 are preferably spaced apart from one another and/or wherein preferably at least one element, preferably at least four, more preferably at least fifty, elements for color management 23 are arranged between the at least two printing marks 11 and/or wherein the at least two printing marks 11 are preferably arranged symmetrically with respect to an axis of symmetry of the print control strip 21. As a result of the integration of the at least one printing mark 11 into the at least one print control strip 21, space is preferably saved on the sheet 02 and/or additional printing marks 11, in addition to the at least one print control strip 21, preferably additional printing mark 11 arranged outside the at least one print control strip 21, can be omitted. For example, the at least one printing mark 11 is surrounded by at least one unprinted and/or differently colored, for example white, and/or unicolor region, in particular when the at least one printing mark 11 is integrated into the at least one print control strip 21. Preferably, the unprinted and/or differently colored and/or unicolor region completely surrounds the at least one printing mark 11, in particular in all directions. Preferably, the at least one printing mark 11, which is preferably embodied as an alignment mark, is arranged with the unprinted and/or differently colored and/or unicolor region within the control patch 22. In this way, the contrast preferably increases, and/or the at least one printing mark 11 can be recognized more easily compared to a printing mark 11 that is not surrounded by an unprinted and/or differently colored region. The at least one printing mark 11 is preferably legible, even with major register adjustments of different printing units with printing inks different from the printing mark 11. Preferably, all control patches 22, independently of their function, have the same height and/or the same width. Advantageously, the at least one print control strip 21 is thus not changed or influenced geometrically, in terms of its size and/or extension, by the integration of the at least one printing mark 11 into the at least one print control strip 21.

The respective, preferably the at least one, sheet 02 preferably comprises the at least one printing mark 11 in a region outside the at least one print image. For example, the at least one printing mark 11 is situated outside the at least one multiple-up 03. The at least one sheet 02 preferably comprises at least two printing marks 11, which are preferably arranged parallel to one another along the leading edge 07 of the at least one sheet 02, i.e., next to one another in the transport direction T, and/or are spaced apart from one another and/or, preferably additionally, are spaced apart from the leading edge 07. Preferably, a respective sheet 02, preferably the at least one sheet 02, comprises at least two printing marks 11, which are arranged parallel to one another along the leading edge 07 of the sheet 02 and are spaced apart from one another and preferably additionally are spaced apart from the leading edge 07. For example, the at least one printing mark 11 is spaced at least 5 mm (five millimeters), preferably at least 10 mm (ten millimeters), and/or no more than 20 mm (twenty millimeters), preferably no more than 15 mm (fifteen millimeters) apart from the at least one edge 07; 09 of the at least one sheet 02, preferably from the leading edge 07. Preferably, a respective sheet 02, preferably the at least one sheet 02, comprises at least one further printing mark 11, which is arranged at a smaller distance from at least one side edge 09 of the sheet 02 than from its leading edge 07.

As an alternative or in addition, for example, the at least one printing mark 11 is configured as at least a portion of the at least one print image. For example, the at least one print image comprises at least one element that is distinguishable from its surrounding environment, which preferably acts as a printing mark 11. As a result of the at least one element, a contrast is preferably present in the print image, which can be evaluated and/or is evaluated by the at least one sensor device 251. In particular, the detection zone 253 of the at least one sensor 252, for example of the at least two sensors 252, is directed at the at least one print image, in particular at the at least one element of the print image which is distinguishable from its surrounding environment. The at least one sensor device 251, preferably at least one sensor 252 of the at least two sensors 252, is preferably configured to detect and/or detects the at least one printing mark 11, wherein the at least one printing mark 11 is configured as at least one element of the at least one print image of the at least one sheet 02 which is distinguishable from its surrounding environment.

The at least one sheet 02 preferably comprises at least the at least one, more preferably at least two, more preferably at least four, printing marks 11. For example, the at least one sheet 02 comprises the at least one printing mark 11 in a region outside the at least one print image and/or in an edge region of the at least one sheet 02 in the region of the leading edge 07 and/or preferably spaced apart from the edge 07 of the at least one sheet 02 which is configured as the leading edge 07. The at least one printing mark 11 is integrated into the at least one print control strip 21, preferably as at least one control patch 22.

Preferably, the at least one sheet 02, preferably the at least one print control strip 21, comprises the at least one printing mark 11 in a printing color. The at least one printing mark 11 preferably has a color for register marks as the printing color. The color for register marks is preferably the printing color of a first application mechanism, preferably of a first printing mechanism, which is configured as a reference for setting the color register and/or the perfecting register of at least one further application mechanism, preferably a printing mechanism. Preferably, first an alignment of the first application mechanism, preferably printing mechanism, with respect to the color register and/or the perfecting register is carried out. Thereafter, the at least one further application mechanism, preferably printing mechanism, is preferably aligned relative to the first application mechanism, preferably printing mechanism. The color for register marks is preferably the darkest printing color of the print job that is used, for example black. By using the color for register marks for the at least one printing mark 11, its relative position with respect to the at least one print image is preferably true to register, that is, precise. Preferably, the die-cut pattern is thus true to register with respect to the print image as a result of the evaluation of the at least one printing mark 11.

The at least one sheet 02 preferably includes the at least one printing mark 11 in a printing color, preferably the color for register marks. For example, as an alternative, a sheet 02, preferably the at least one sheet 02, preferably comprises at least one printing mark 11 for each printing color with which the respective sheet 02 is at least partially printed. As an alternative, a respective printing mark 11 is composed of preferably at least two, preferably all, printing colors that are used. For example, the processing machine 01 comprises at least one, preferably two, more preferably at least four, application mechanisms, preferably printing mechanisms, printing the at least one sheet 02. The at least one application mechanism, preferably printing mechanism, is preferably arranged upstream from the at least one shaping unit 300, more preferably upstream from the at least one infeed unit 200.

The at least one printing mark 11 preferably comprises at least one two-dimensional element, preferably at least one geometric figure and/or preferably at least one line-shaped element. For example, the at least one printing mark 11 is configured in each case as a bar and/or a cross and/or a rectangle and/or a QR code. The at least one printing mark 11 is preferably configured as a polygon, more preferably as a rectangle, more preferably as a square. As an alternative, for example, the at least one printing mark 11 is configured as a dot or a circle. A simple and rapid evaluation of the at least one printing mark 11 preferably takes place when the printing mark has at least one straight edge or side, in particular when it is configured as a rectangle and/or a square. The at least one printing mark 11 is preferably filled with printing color, for example black. Preferably, at least one side and/or axis of the at least one printing mark 11 is arranged parallel to the leading edge 07 of the at least one sheet 02 and/or parallel to the transverse direction A. Preferably, at least one side and/or axis of the at least one printing mark 11 is arranged parallel to the side edge 09 of the at least one sheet 02 and/or parallel to the transport direction T. If the at least one printing mark 11 is configured as a rectangle, for example, preferably a square, at least one side is preferably arranged parallel to the transport direction T and at least one side is arranged parallel to the transverse direction A. If the at least one printing mark 11 is configured as a cross, for example, at least one axis, for example the longitudinal axis, is preferably arranged parallel to the transport direction T, and at least one axis, for example the transverse axis, is arranged parallel to the transverse direction A. The at least one printing mark 11 preferably enables a plurality of measurement points, which can be used to evaluate position information of the at least one sheet 02. The arrangement of the at least one printing mark 11 and/or the configuration as a rectangle, preferably a square, and/or the configuration as a cross preferably increase the accuracy of the evaluation of the at least one printing mark 11. The at least one printing mark 11 preferably has a surface area of at least 1.5 $mm^2$ (one point five square millimeters), more preferably at least 1.8 $mm^2$ (one point eight square millimeters), more preferably at least 1.9 $mm^2$ (one point nine square millimeters), more preferably at least 2.5 $mm^2$ (two point five square millimeters). The at least one printing mark 11 preferably has a surface area of no more than 25 $mm^2$ (twenty-five square millimeters), more preferably no more than 22 $mm^2$ (twenty-two square millimeters), more preferably no more than 20 $mm^2$ (twenty square millimeters), more preferably no more than 17 $mm^2$ (seventeen square millimeters). In this way, it is preferably possible to optimally detect the at least one printing mark 11 since blurring of the edge regions of the printing mark 11 is minimized and/or since the surface area generates sufficient contrast compared to its surrounding environment. The at least one printing mark 11 preferably has a geometry that can preferably be generated by at least one of the methods encompassing digital printing method and/or cold foil method and/or hot foil method and/or flexographic printing method and/or gravure printing method and/or offset printing method. The at least one printing mark 11 can preferably be easily generated by a method printing the at least one sheet 02. Preferably, the geometry of the at least one printing mark 11 is generatable and/or can be generated and/or is generated by any of the methods encompassing digital printing method, cold foil method, hot foil method, flexographic printing method, gravure printing method and offset printing method. Preferably, the at least one printing mark 11 is applied, preferably printed or glued, onto the at least one substrate 02 by way of a first process processing the substrate 02 that is preferably configured as a sheet 02, which preferably includes the at least one method generating the printing mark 11, and/or by a first machine processing the substrate 02, for example a finishing machine and/or a printing press. Preferably, at least one processing machine following the first machine, preferably at least two following processing machines, in particular the at least one die-cutting machine 01, and/or preferably at least one further processing process following the first process, preferably at least two further processing processes, in particular a die cutting operation of the at least one substrate 02, utilizes the at least one printing mark 11 for aligning the at least one substrate 02 in the respective processing machines and/or for the respective processing processes.

The at least one printing mark 11 is preferably configured so that the position of the at least one sheet 02 in the transport direction T and/or in the transverse direction A is preferably determined and/or can be determined by the at least one printing mark 11. Preferably, the position of the at least one sheet 02 in the transport direction T and in the transverse direction A is determined and/or can be determinable by the at least one printing mark 11. Preferably, a skewed position of the at least one sheet 02 is additionally determined and/or can be determined and/or is being determined by the at least one printing mark 11, preferably the at least two printing marks 11. More preferably, the position of the at least one sheet 02 in the transport direction T and/or in the transverse direction A is determined and/or can be determined by at least two printing marks 11, more preferably by no more than four printing marks 11, more preferably by two printing marks 11, the at least two printing marks 11 preferably being positioned on the at least one sheet 02 in a region along the leading edge 07 of the at least one sheet 02 and/or the at least two printing marks 11 preferably being positioned on the at least one sheet 02 parallel next to one another in the transport direction T and/or the at least two printing marks 11 being integrated into the at least one print control strip 21. For example, the at least two printing marks 11 are sufficient and/or, in addition to the at least two printing marks 11, preferably no further printing mark 11, for example lateral printing mark 11, is necessary to determine the position of the at least one sheet 02, in particular in the transverse direction A. An evaluation of the at least one printing mark 11 is preferably configured so as to move the at least one substrate 02, which is preferably configured as a sheet 02, in the transport direction T and/or in the transverse direction A.

Above and below, a distance between two surface areas or between two points or between one surface area and one point or between one direction and one further element describes the shortest connection between these two elements.

A sheet 02 to be transported by the infeed unit 200, preferably the at least one sheet 02, for example, has at least one position error when arriving at the alignment position PA. The position error of a sheet 02 describes a deviation of its positioning along the transport path relative to a target positioning. This is the case, for example, in the case of a position error in the transport direction T when the time at which the leading edge 07 and/or at least one printing mark 11 of the sheet 02 actually arrive at the alignment position PA deviates from an expected and/or required time at which the leading edge 07 and/or at least one printing mark 11 of the sheet 02 arrive. For example, if a sheet 02 arrives at the alignment position PA at a later time than expected and/or required, its leading edge 07 and/or the relevant at least one printing mark 11 are situated upstream from the expected and/or required position in the transport direction T at the expected and/or required time. For example, a position error of the sheet 02 also exists in the case of a skewed position of the sheet 02. In the case of a skewed position of the sheet 02, for example, its leading edge 07 has an angle of greater than 0° (zero degrees) with respect to the transverse direction A and/or its side edges 09 have an angle of greater than 0° (zero degrees) with respect to the transport direction T. In the case of a skewed position of the sheet 02, at least two printing marks 11 arranged parallel to and spaced apart from one another along the leading edge 07 of the sheet 02 have different coordinates along the transport direction T. In this way, at least one of the relevant printing marks 11 is arranged upstream from the respective, at least one further printing mark 11 in the transport direction T. An in particular lateral position error also exists when the sheet 02 is arranged displaced with respect to its expected and/or required position in the transverse direction A.

A respective sheet 02, preferably the at least one sheet 02, is preferably roughly aligned by the at least two front lay marks 203 arranged horizontally parallel to one another in the transport direction T of sheets 02. The rough alignment describes a reduction of the position error relative to the expected and/or required positioning of the sheet 02, due to the sheet 02 striking against the at least two front lay marks 203 in the alignment position PA. A sheet 02 is preferably fixed during the rough alignment, at least in the vertical direction V, in particular by the at least one transport means 204.

Preferably in addition or as an alternative, a respective, preferably the at least one, sheet 02 is finely aligned by adjusting the mounting point S and the axis of rotation D relative to one another. The at least one feed system 202 is preferably configured to finely align the at least one sheet 02 by adjusting the mounting point S and the axis of rotation D relative to one another. In addition, or as an alternative, the respective, preferably the at least one, sheet 02 is more preferably finely aligned by adjusting, preferably pivoting, the mounting point S and the axis of rotation D relative to one another. As a result of the fine alignment of the sheet 02, it is ensured that the sheet 02, in the transfer position PU, is transferred, while maintaining register accuracy, to the at least one holding element 1202 of the transport system 1200. The relative position of the at least one transport means 204 is preferably changed during the alignment of the sheet 02. A finely aligned sheet 02 is preferably situated in its expected and/or required position at the expected and/or required time, preferably with only minimal deviation of the position from the expected and/or required position, more preferably without any deviation of the position.

A position displacement of the mounting point S relative to the axis of rotation D is preferably configured to compensate for and/or compensates for at least one position error of the at least one sheet 02. To compensate for a position error of the at least one sheet 02, the mounting point S and the axis of rotation D can preferably be configured to be movable and/or to move and/or to be adjustable and/or to be adjusted and/or to adjust relative to one another. The at least one drive lever 214 is preferably deflected by an at least partial rotation of the at least one cam disk 212, preferably pivoted about its mounting point S. The deflection of the at least one drive lever 214 as a result of the at least partial rotation of the at least one cam disk 212 is preferably configured to move the at least one transport means 204 in and/or counter to the transport direction T. As a result of a position displacement of the mounting point S of the at least one drive lever 214 and of the axis of rotation D of the at least one cam disk 212 relative to one another, at least one position error of the respective sheet 02, in particular at least one position error of the leading edge 07 and/or of at least one printing mark 11 in the transport direction T and/or due to a skewed position of the respective sheet 02 can preferably be compensated for and/or is compensated for, in addition to a deflection of the at least one drive lever 214, as a result of an at least partial rotation of the at least one cam disk 212. The at least one cam mechanism is preferably driven by the drive system 1000, preferably by means of the at least one drive 1001, more preferably by means of the at least one drive shaft 1002, preferably continuously. The at least one servo drive 218 preferably adjusts the position of the mounting point S relative to the position of the axis of rotation D, preferably while the operating situation of the cam mechanism is being maintained by the drive system 1000. The at least one servo drive 218 preferably adjusts the position of the mounting point S relative to the position of the axis of rotation D, preferably while the at least one cam mechanism 212 is being driven, preferably rotated, by the at least one drive shaft 1002, preferably by the at least one drive 1001.

The at least one infeed system 202 preferably comprises at least two cam mechanisms. The at least one infeed system 202 preferably comprises at least two cam mechanisms at the at least one drive shaft 1002, which are arranged parallel to one another in the transport direction T. Preferably, the at least two cam mechanisms simultaneously pick up the driving torque from the at least one drive shaft 1002. In addition or as an alternative, the at least one infeed system 202 preferably comprises at least two servo drives 218 which are independent of the drive shaft 1002 and which are preferably assigned to one of the cam mechanisms. Preferably in addition or as an alternative, the at least one infeed system 202 comprises the at least two servo drives 218, which are preferably operated independently of the at least one drive 1001. Each of the at least two servo drives 218 is preferably configured to intervene in one of the at least two cam mechanisms, preferably to adjust the mounting point S relative to the axis of rotation.

At least one servo drive 218 is preferably activated and/or controlled by closed-loop control at least during a compensation for a skewed position of the sheet 02. The at least one servo drive 218 preferably generates a larger relative displacement of the mounting point S and of the axis of rotation D with respect to one another than a further servo drive 218, which is preferably activated and/or controlled by closed-loop control at the same time. The at least one servo drive 218 is preferably configured to be activatable and/or to be activated and/or to be controllable by closed-loop control and/or to be controlled by closed-loop control at least during a compensation for a skewed position of the sheet 02.

Preferably in addition or as an alternative, at least two servo drives 218 are configured to be activatable and/or activated and/or controllable by closed-loop control and/or controlled by closed-loop control and/or are activated and/or are controlled by closed-loop control, at least during a compensation for a position error in the transport direction T. Preferably, each of the at least two servo drives 218 generates an identical relative displacement of the mounting point S and the axis of rotation D with respect to one another.

The sheet 02 is preferably finely aligned laterally, preferably in the transverse direction A, to compensate for a lateral position error. In the case of a lateral fine alignment of the sheet 02 orthogonal to the transport direction T, in particular and/or in the transverse direction, at least the at least one transport means 204 of the infeed system 202 is preferably adjusted horizontally and orthogonally to the transport direction T, via at least one servo drive 237, which is preferably independent of the at least one drive shaft 1002, more preferably of the at least one drive 1001, of the lateral alignment. For example, the at least one coupler 216 is adjusted in the transverse direction A, at its connection to the at least one transport means 204, out of its existing position in the transverse direction A, while the connecting point 219 preferably remains in its position in the transverse direction A. For example, the at least one coupler 216 comprises at least one self-aligning bearing for this purpose. The respective sheet 02 is preferably adjusted horizontally and orthogonally to the transport direction T, as a function of the preferably selective detection of the at least one printing mark 11, preferably of the at least one lateral printing mark 11 and/or the at least one side edge 09 of the sheet 02. The at least one servo drive 237 of the lateral alignment is preferably configured as a hand wheel or a mechanical drive or an electric drive, preferably as an actuator and/or a linear motor and/or an electric motor. During a lateral alignment of the at least one sheet 02 of the sheets 02, the control system 1100 and/or the at least one sensor device 251 are preferably configured to activate the at least one servo drive 237 of the lateral alignment, preferably as a function of the at least one sensor device 251, in particular the detection of the sheet 02 by the at least one sensor device 251.

By adjusting the at least one coupler 216 in the transverse direction A, the path of the sheet 02, which it covers from the alignment position PA to the transfer position PU along the transport path, is at least partially shortened, in particular at the location of the adjusted coupler 216.

Preferably in addition or as an alternative, the at least one infeed unit 200 comprises at least one pulling device 238 for a lateral alignment of sheets 02. At least one support of the at least one pulling device 238, which is preferably configured as a vacuum plate 273, preferably seizes the relevant sheet 02, which is to be laterally aligned. Preferably, the relevant sheet 02 is moved, preferably pulled, against at least one lateral stop 272 of the at least one pulling device 238, in particular by the at least one vacuum plate 273. The at least one lateral stop 272 is preferably adapted to the format width of the sheet 02. The relevant sheet 02 is preferably only moved with respect to the transverse direction A during the lateral movement to the at least one lateral stop 272. Preferably, at least one lateral stop 272 is positioned on each of the two sides of the transport path. The pulling device 238 is preferably configured so that the relevant sheet 02 is moved and/or can be moved in and/or counter to the transverse direction A. The relevant sheet 02 is preferably at least roughly aligned with respect to the transverse direction A by the at least one pulling device 238.

The at least one infeed system 202 of the sheet processing machine 01 preferably comprises the at least one transport means 204, which is, in particular, configured as a holding means 204, preferably as a gripper 204, and which includes the at least one upper holder 206 and the at least one lower holder 207. The at least one holding surface 233; 234 of at least one holder 206; 207, preferably at least the at least one upper holder 206, is preferably configured to at least temporarily pivot and/or be pivotable and/or be pivoted about the at least one gripper shaft 221, preferably configured as a pivot axis 221, of the relevant holder 206; 207, preferably of the at least one upper holder 206. The at least one holding surface 233; 234 of at least one holder 206; 207 preferably pivots and/or is pivotable, preferably at least temporarily, about the at least one pivot axis 221 of the relevant holder 206; 207. The at least one lower holder 207 is preferably rigidly arranged within the at least one infeed system 202, and the at least one upper holder 206 is arranged to pivot and/or to be pivotable about the pivot axis 221.

Preferably, the at least one holding means 204, in particular the at least one transport means 204, preferably the at least one gripper 204, can be arranged and/or is arranged in at least three states. The at least one transport means 204 preferably has a minimally closed state, and a maximally closed state, and at least a mean state and/or is arranged and/or can be arranged in these states. The at least one upper holder 206 preferably has a maximum distance with respect to the at least one lower holder 207 in the minimally closed state, a minimal distance in the maximally closed state, and at least a mean distance in the at least one mean state.

A minimally closed state of the at least one holding means 204, in particular of the at least one transport means 204, preferably corresponds to a maximum distance between at least one upper holding surface 233 of the at least one respective upper holder 206 and at least one lower holding surface 234 of the lower holder 207 assigned to the respective upper holder 206. The minimally closed state of the at least one holding means 204 preferably corresponds to a maximally open state of the holding means 204. Preferably, the distance between the at least one upper holding surface 233 and the at least one assigned lower holding surface 234 in the minimally closed state of the at least one transport means 204, preferably holding means 204, is preferably at least greater than twice the thickness of a sheet 02 to be transported. Preferably, the distance between the at least one upper holding surface 233 and the at least one assigned lower holding surface 234 in the minimally closed state of the at least one holding means 204 is preferably at least greater than twice the thickness of a sheet 02 to be transported, so that the position of the respective sheet 02, in particular the leading edge 07 of the sheet 02, can preferably be at least partially moved in the transport direction T and/or in the transverse direction A and/or in the vertical direction V.

A maximally closed state of the at least one holding means 204 preferably corresponds to a minimum distance between the at least one upper holding surface 233 of the at least one respective upper holder 206 and the at least one lower holding surface 234 of the lower holder 207 assigned to the respective upper holder 206. Preferably, the distance between the at least one upper holding surface 233 and the at least one assigned lower holding surface 234 in the maximally closed state of the at least one transport means 204, preferably holding means 204, is preferably not greater than the thickness of a sheet 02 to be transported. Preferably, the distance between the at least one upper holding surface 233 and the at least one assigned lower holding surface 234 in the maximally closed state of the at least one holding means 204 is preferably not greater than the thickness of a sheet 02 to be transported, so that the position of the respective sheet 02, in particular of the leading edge 07 of the sheet 02, in the transport direction T and/or in the transverse direction A and/or in the vertical direction V is preferably completely fixed.

At least one mean state of the at least one holding means 204 preferably corresponds to at least a mean distance between the at least one upper holding surface 233 of the at least one respective upper holder 206 and the at least one lower holding surface 234 of the lower holder 207 assigned to the respective upper holder 206. In the mean state of the at least one holding means 204, the position of the respective sheet 02 is preferably fixed at least partially, preferably at least partially in the vertical direction V, more preferably completely in the vertical direction V. In a mean state of the at least one holding means 204, the respective sheet 02 is preferably configured to be movable and/or to move at least partially, preferably at least in the transport direction T and/or transverse direction A. The at least one mean state of the at least one transport means 204, preferably of the at least one holding means 204, preferably differs both from the maximally closed state and from the minimally closed state of the at least one transport means 204.

The state of the at least one holding means 204 is preferably dependent on the rotation of the drive shaft 1002 about its axis of rotation D. The state of the at least one holding means 204 preferably changes at least once during a machine cycle. The at least one holding means 204, preferably the at least one transport means 204 preferably configured as a holding means 204, preferably has the minimally closed state at least once, and the maximally closed state at least once, and the at least one mean state at least once during a machine cycle. The at least three states, these being the maximally closed state, the minimally closed state, and the at least one mean state, preferably occur during a machine cycle.

In the alignment position PA, preferably at least during a rough alignment of sheets 02 and/or preferably during a lateral alignment of sheets 02, the at least one transport means 204 preferably at least temporarily has the at least one mean state, preferably the at least one mean distance between the at least one upper holder 206 and the at least one lower holder 207 and/or the at least one mean distance between the holding surfaces 233, 234. Preferably, in the alignment position PA, the at least one transport means 204 preferably at least temporarily has the maximally closed state, preferably the minimal distance between the at least one upper holder 206 and the at least one lower holder 207 and/or the minimal distance between the holding surfaces 233, 234, preferably after being arranged in the at least one mean state, more preferably at least during a detection of the at least one sheet 02 by the at least one sensor device 251. Preferably, the at least one transport means 204 has the maximally closed state at least during its movement from the alignment position PA to the transfer position PU. Preferably, the at least one transport means 204 has the minimally closed state, preferably the maximal distance between the at least one upper holder 206 and the at least one lower holder 207 and/or the maximal distance between the holding surfaces 233, 234, at least while being moved from the transfer position PU to the alignment position PA, preferably at least while the at least one transport means 204 is being returned to the alignment position PA.

At the alignment position PA, preferably the at least one holding means 204, preferably the at least one transport means 204, preferably at least temporarily has the at least one mean state, in particular a mean distance between the holding surfaces 233; 234, for a rough alignment of sheets 02. The at least one holding means 204, preferably the at least one transport means 204, preferably at the alignment position PA, is at least temporarily arranged at the at least one mean distance between the at least one upper holding surface 233 of the at least one respective upper holder 206 and the at least one lower holding surface 234 of the respective lower holder 207 assigned to the respective upper holder 206, preferably in the at least one mean state, during the rough alignment of sheets 02. The at least one mean state preferably corresponds to a holding down of sheets 02, in particular of the leading edge 07 of the sheet 02, which at least partially, preferably completely, fixes the respective sheet 02, in particular the leading edge 07 of the sheet 02, in the vertical direction V, and/or which only allows a movement of the respective, preferably of the at least one, sheet 02, in particular of the leading edge 07 of the sheet 02, in the transport direction T and/or the transverse direction A, preferably in a horizontal plane. The at least one transport means 204 is preferably at least temporarily, preferably at least during a rough alignment of the at least one sheet 02 and/or during a lateral alignment of the at least one sheet 02, arranged in the at least one mean state, preferably is fixed in this state, more preferably is immobilized in this state. The distance between the at least one upper holder 206 and the at least one lower holder 207 in the at least one mean state of the at least one transport means 204 is preferably greater than the thickness of the at least one sheet 02, preferably the sheet to be transported. Preferably, the distance between the at least one upper holder 206 and the at least one lower holder 207, preferably the distance between the at least one upper holding surface 233 and the at least one assigned lower holding surface 234, in the at least one mean state of the holding means 204, preferably of the at least one transport means 204, is preferably at least greater than the thickness of a sheet 02 to be transported, preferably one and half times, more preferably at least twice as large as the thickness of a sheet 02 to be transported. The at least one mean distance between the at least one upper holding surface 233 and the at least one assigned lower holding surface 234 is preferably at least greater than the thickness of a sheet 02 to be transported, preferably one and half times, more preferably at least twice as large as the thickness of a sheet 02 to be transported.

Preferably, the at least one mean state, preferably the at least one mean distance between the at least one upper holding surface 233 of the at least one upper holder 206 and the at least one lower holding surface 234 of the lower holder 207 assigned to the at least one upper holder 206, is adapted to a maximum thickness of sheets 02 and/or set accordingly to a maximum thickness of the sheets 02 to be transported. Preferably, the at least one mean distance between the at least one upper holding surface 233 of the at least one respective upper holder 206 and the at least one lower holding surface 234 of the lower holder 207 assigned to the respective upper holder 206, is adapted to a maximum thickness of sheets 02, in particular which are preferably at least partially transported by the sheet processing machine 01 at this time and/or which are preferably arranged within the infeed system 202 at this time. Preferably, the at least one mean state, preferably the at least one mean distance, is set at least once for each processing job and/or is set according to the present processing job.

The at least one pivotable holding surface 233; 234, preferably the at least one holding surface 233 of the upper holder 206, is preferably functionally connected to the at least one drive shaft 1002, preferably to the at least one drive 1001, in particular via at least one gear mechanism. Preferably, the at least one pivotable holding surface 233; 234, preferably the at least one holding surface 233 of the upper holder 206, is functionally connected to at least one opening element 223, configured as a cam disk 223, via at least one scanning lever 226. Preferably, at least one scanning element 224 of the at least one scanning lever 226 is configured to rest permanently without clearance against the at least one cam disk 223. Preferably, the at least one scanning element 224 is configured to rest permanently without clearance against the at least one cam disk 223 as a result of at least one spring, preferably a compression spring, at the scanning lever 226 and/or a preload of the scanning lever 226. The at least one sensing element 224 is preferably configured as a roller and/or is configured to carry out a rolling motion at the at least one cam disk 223. At least one of the cam mechanisms of the infeed system 202 preferably comprises the at least one cam disk 223. For example, the at least one cam mechanism, which comprises the at least one cam disk 223, is different from the cam mechanism that is configured to transmit the movement in and/or counter to the transport direction T of the at least one transport means 204. Preferably, the at least one cam mechanism that comprises the at least one cam disk 223 is configured to set the state of the at least one transport means 204.

The at least one cam disk 223 is preferably arranged at the at least one drive shaft 1002 and is configured to rotate about the axis of rotation D thereof, in particular rotating together with the relevant drive shaft 1002. The at least one cam disk 223 is preferably concentrically arranged about the at least one drive shaft 1002. The at least one pivotable holding surface 233; 234, preferably the at least one holding surface 233 of the upper holder 206, preferably has the respective state corresponding to the angle of rotation of the drive shaft 1002, and thus the angle of rotation of the at least one cam disk 223 about the axis of rotation D. The state of the at least one transport means 204, preferably the distance between the at least one upper holder 206 and the at least one lower holder 207 of the at least one transport means 204, is preferably set and/or settable via the at least one cam disk 223. The at least one cam mechanism, preferably the at least one cam disk 223, preferably by a rotation of the at least one drive shaft 1002 and/or by virtue of the at least one drive 1001, is preferably configured to set and/or sets the state, preferably the maximally closed state and the minimally closed state and the at least one mean state, of the at least one transport means 204.

Preferably, the at least one scanning lever 226 is coupled via at least one transmission shaft 227 to the pivot axis 221 of the relevant holder 206; 207, preferably the at least one upper holder 206. More preferably, the at least one scanning lever 226 is coupled via at least one transmission shaft 227 to the pivot axis 221 of the relevant holder 206; 207, preferably the at least one upper holder 206, wherein the at least one transmission shaft 227 is arranged eccentrically in at least one adjusting shaft 228. The at least one transmission shaft 227 is preferably functionally connected via the at least one scanning lever 226 to the at least one cam disk 223 and/or the at least one drive shaft 1002. The at least one transmission shaft 227 is preferably functionally connected via at least one coupler 222 and/or at least one transmission lever 229, preferably via both at least one coupler 222 and at least one transmission lever 229, to the at least one pivot axis 221.

The scanning lever 226 is preferably arranged to pivot about the axis of rotation U of the at least one transmission shaft 227. The at least one transmission lever 229 is preferably connected to the transmission shaft 227 and arranged to pivot about the axis of rotation U thereof. The at least one coupler 222 is preferably connected to the at least one transmission lever 229. In the case of pivoting of the transmission lever 229, the coupler 222 preferably has an at least partial movement, preferably an at least primarily linear movement, with the main component in and/or counter to the vertical direction V. For example, the at least one coupler 222 is connected via at least one connecting lever 236 and/or at least one bearing to the at least one pivot axis 221. In the case of an at least partial linear movement of the at least one coupler 222, the pivot axis 221, which is preferably configured as a gripper shaft 221, is preferably made to at least partially rotate and/or at least partially pivot by way of the at least one connecting lever 236. The at least partial rotation and/or the at least partial pivoting of the gripper shaft 221 preferably generates a change in the state of the at least one holding means 204.

The at least one cam disk 223 preferably comprises at least three regions, wherein regions abutting one another have different radii. As a result of the different radii of the individual regions of the at least one cam disk 223, the distance between the axis of rotation D of the drive shaft 1002 and the center of gravity of the assigned at least one scanning element 224 is at least partially changed for the respective regions as a function of the present angle of rotation of the drive shaft 1002 and/or cam disk 223. The at least one cam disk 223 preferably has at least three different radii with respect to the axis of rotation D of the drive shaft 1002 along its circumference. A cam function of the circumference of the at least one cam disk 223 is preferably continuous, preferably continuously differentiable, in all points along its arc length. For example, the at least one cam disk 223, along its circumference, includes at least one depression and/or at least one elevation and/or at least one lobe with respect to the surrounding regions.

The respective regions of the at least one cam disk 223 preferably each correlate with a state of the at least one holding means 204, preferably of the at least one transport means 204. In the case of the minimally closed state of the at least one holding means 204, the at least one scanning element 224 is preferably arranged at the region of the cam disk 223 that has a maximal radius. In the case of the maximally closed state of the at least one holding means 204, the at least one scanning element 224 is preferably arranged at the region of the cam disk 223 that has a minimal radius. In the case of the at least one mean state of the at least one holding means 204, the at least one scanning element 224 is preferably arranged at the region of the cam disk 223 that has a mean radius. The minimal radius of the at least one cam disk 223 preferably corresponds to the minimal distance between the at least one upper holding surface 233 of the at least one respective upper holder 206 and the at least one lower holding surface 234 of the lower holder 207 assigned to the respective upper holder 206. The maximal radius of the at least one cam disk 223 preferably corresponds to the maximal distance between the at least one upper holding surface 233 of the at least one respective upper holder 206 and the at least one lower holding surface 234 of the lower holder 207 assigned to the respective upper holder 206. At least one mean radius of the at least one cam disk 223 preferably corresponds to the mean distance between the at least one upper holding surface 233 of the at least one respective upper holder 206 and the at least one lower holding surface 234 of the lower holder 207 assigned to the respective upper holder 206.

The at least one cam disk 223 preferably comprises at least one region that corresponds to a phase of a transport movement at least of the at least one holding means 204 from the alignment position PA to the transfer position PU arranged downstream along the transport direction T of sheets 02. Preferably additionally, the distance between the at least one upper holding surface 233 of the at least one respective upper holder 206 and the at least one lower holding surface 234 of the lower holder 207 assigned to the respective upper holder 206 is minimal in this region, in particular when the at least one scanning element 224 is arranged at this region of the at least one cam disk 223. In this way, the state of the at least one holding means 204 during the transport movement of at least the at least one holding means 204 from the alignment position PA to the transfer position PU arranged downstream along the transport direction T of sheets 02 is preferably unchanged and/or constant.

The at least one mean state of the at least one holding means 204 is preferably settable and/or is set, preferably as a function of the thickness in the vertical direction V of the sheets 02 to be transported, preferably the at least one sheet 02. Preferably, the at least one mean state is set by way of the position of the axis of rotation U of the at least one transmission shaft 227, preferably when the corresponding region of the at least one cam disk 223 for the mean state of the at least one holding means 204 is in contact with the at least one scanning element 224.

The at least one infeed system 202 preferably comprises the at least one adjusting shaft 228. The at least one transmission shaft 227 is preferably eccentrically arranged in the at least one adjusting shaft 228. In this way, the axis of rotation U of the at least one transmission shaft 227 has a distance greater than zero with respect to an axis of rotation E of the adjusting shaft 228. The distance between the axis of rotation E of the adjusting shaft 228 and the axis of rotation U of the at least one transmission shaft 227 is preferably dependent on the maximum adjustment range of the thickness of the sheets 02 to be transported. The angle of rotation at which the axis of rotation U of the at least one transmission shaft 227 is arranged relative to the axis of rotation E of the at least one adjusting shaft 228 is preferably settable and/or set. The angle of rotation of the axis of rotation U of the at least one transmission shaft 227 with respect to the axis of rotation E of the at least one adjusting shaft 228 is preferably no more than 90° (ninety degrees), preferably no more than 75° (seventy-five degrees), more preferably no more than 60° (sixty degrees), more preferably no more than 45° (forty-five degrees), more preferably no more than 35° (thirty-five degrees).

The at least one infeed system 202 preferably comprises the at least one servo drive 231. The at least one infeed system 202 additionally, in particular in addition to the at least one drive shaft 1002 and/or the at least one drive 1001 of the drive system 1000, comprises at least one servo drive 231. The at least one servo drive 231 is preferably configured as a hand wheel or a mechanical drive or an electric drive, preferably as an actuator and/or a linear motor and/or an electric motor. The at least one servo drive 231 is preferably at least temporarily configured to intervene in the functional connection between the at least one cam disk 223 and the at least one pivotable holding surface 233; 234 and/or at least temporarily intervenes in the functional connection between the at least one cam disk 223 and the at least one pivotable holding surface 233; 234. Preferably, the at least one servo drive 231 is independent, preferably mechanically independent, of the at least one drive shaft 1002 and/or the at least one drive 1001 of the drive system 1000. Preferably, the at least one servo drive 231 is configured to set, preferably adjust, and/or sets the at least one mean state of the at least one transport means 204, preferably the at least one mean distance between the at least one upper holder 206 and the at least one lower holder 207.

Preferably, the at least one servo drive 231 is configured to change and/or changes the at least one mean state of the at least one transport means 204. Preferably, the at least one servo drive 231 is configured to set and/or adjust and/or change, and/or sets and/or adjusts and/or changes, the at least one mean state of the at least one transport means 204 as a function of the thickness of the at least one sheet 02, preferably the sheet to be transported.

The axis of rotation U of the at least one transmission shaft 227 and the axis of rotation E of the at least one adjusting shaft 228 are preferably adjusted relative to one another by the at least one servo drive 231. The at least one servo drive 231 is preferably configured to adjust the axis of rotation U of the at least one transmission shaft 227 and the axis of rotation E of the at least one adjusting shaft 228 relative to one another. Preferably in addition or as an alternative, the axis of rotation U of the at least one transmission shaft 227 and the axis of rotation E of the at least one adjusting shaft 228 are adjusted relative to one another by the at least one servo drive 231. More preferably, the at least one servo drive 231 is configured to at least temporarily pivot the at least one adjusting shaft 228 about its axis of rotation E thereof. The at least one servo drive 231 preferably at least temporarily pivots the at least one adjusting shaft 228 about its axis of rotation E. Preferably, the at least one servo drive 231 is connected via at least one adjusting lever 232 to the at least one adjusting shaft 228. The at least one adjusting lever 232 is preferably moved by the at least one servo drive 231, whereby the at least one adjusting shaft 228 preferably at least partially pivots about its axis of rotation E. The at least one transmission shaft 227 is preferably at least partially pivoted about the axis of rotation E of the at least one adjusting shaft 228 by the at least partial pivoting movement of the at least one adjusting shaft 228. The at least one mean distance between the at least one upper holding surface 233 of the at least one respective upper holder 206 and the at least one lower holding surface 234 of the lower holder 207 assigned to the respective upper holder 206 is preferably set by an at least partial pivoting of the at least one transmission shaft 227 about the axis of rotation E of the at least one adjusting shaft 228.

As a result of an at least partial pivoting of the at least one adjusting shaft 228 about its axis of rotation E, the at least one scanning element 224 of the scanning lever 226, which is preferably in direct contact with the at least one cam disk 223, is preferably displaced by an angle of rotation of no more than 3° (three degrees), preferably of no more than 2° (two degrees), more preferably of no more than 1° (one degree), along the surface of the cam disk 223 about the axis of rotation D of the at least one cam disk 223 relative to the original position of the at least one scanning element 224. Preferably, the at least one mean distance between the at least one upper holding surface 233 of the at least one respective upper holder 206 and the at least one lower holding surface 234 of the lower holder 207 assigned to the respective upper holder 206 can be set and/or is set by at least partially pivoting the at least one adjusting shaft 228 about its axis of rotation E. Preferably, the axis of rotation U of the at least one transmission shaft 227 is preferably arranged relative to the axis of rotation E of the at least one adjusting shaft 228, preferably independently of an adjustment of the axis of rotation E of the at least one adjusting shaft 228 relative to the axis of rotation U of the at least one transmission shaft 227, in such a way that the axis of rotation U of the at least one transmission shaft 227 has a maximal distance of preferably 50 mm (fifty millimeters), preferably of more than 35 mm (thirty-five millimeters), more preferably of no more than 10 mm (ten millimeters), with respect to a connecting line of the axis of rotation E of the at least one adjusting shaft 228 with a contact point of the at least one scanning element 224 with the at least one assigned cam disk 223. More preferably, the axis of rotation U of the at least one transmission shaft 227, preferably independently of an adjustment of the axis of rotation E of the at least one adjusting shaft 228 relative to the axis of rotation U of the at least one transmission shaft 227, is at least partially arranged in the connecting line of the axis of rotation E of the at least one adjusting shaft 228 with a contact point of the at least one scanning element 224 with the at least one cam disk 223. Preferably, the times at which the at least one transport means 204 has the maximally closed state and the minimally closed state and the at least one mean state is almost not influenced by, preferably independent of, a setting made by the at least one servo drive 231.

The at least one infeed system 202 preferably comprises at least one cam mechanism. Preferably, the at least one infeed system 202 comprises at least one cam mechanism moving the at least one transport means 204 from the alignment position PA to the transfer position PU and/or aligning sheets 02. Preferably in addition or as an alternative, the at least one infeed system 202 comprises at least one cam mechanism setting the state of the at least one transport means 204, preferably the distance between the at least one upper holder 206 and the at least one lower holder 207. Preferably, the at least one infeed system 202 of the processing machine 01 comprises at least one cam mechanism for at least a transport from the alignment position PA to the transfer position PU and/or at least an alignment of sheets 02, and preferably additionally at least one cam mechanism for at least setting the relevant state of the at least one transport means 204, in particular holding means 204. Preferably, the at least one infeed system 202 comprises at least one servo drive 218 intervening in, preferably superimposing, the movement of the at least one transport means 204 from the alignment position PA to the transfer position PU. Preferably in addition or as an alternative, the at least one infeed system 202 comprises at least one servo drive 231 setting, preferably adjusting, the at least one mean state of the at least one transport means 204. Preferably, the at least one infeed system 202 comprises at least one servo drive 218, in particular for aligning sheets 02, and at least one servo drive 231, in particular for setting the respective state of the at least one transport means 204, in particular of the at least one holding means 204.

The sheet processing machine 01 preferably comprises the at least one sensor device 251. The at least one sensor device 251 is preferably arranged within the at least one infeed unit 200 and/or is assigned to the at least one infeed unit 200. The sensor device 251 comprises the at least one sensor 252, preferably the at least two sensors 252. Preferably, the sensor device 251 comprises exactly two sensors 252, alternatively the sensor device 251 comprises at least three sensors 252. The respective, preferably the at least one, preferably the at least two sensors 252 are preferably directed at the transport path of sheets 02.

The at least one sensor device 251 is preferably arranged above or beneath the transport path of sheets 02. As an alternative, at least one sensor device 251 is preferably arranged above and at least one further sensor device 151 is arranged beneath the transport path. For example, the at least one sensor 252 is, preferably the at least two sensors 252 are, more preferably at least three sensors 252 are, arranged above or beneath the transport path of the sheets 02. For example, both at least one sensor 252, preferably the at least two sensors 252, more preferably at least three sensors 252, are arranged above the transport path of the sheets 02, and at least one sensor 252, preferably at least one further sensor 252, preferably at least two further sensors 252, more preferably at least three further sensors 252, are arranged beneath the transport path. In this way, the, preferably at least one, sheet 02 is at least partially detected and/or detectable from above and/or from beneath by the sensor device 251, preferably by the at least one sensor 252, preferably by the at least two sensors 252, preferably in at least one detection zone 253 of the respective, preferably at least one, sensor 252.

Preferably, the respective, preferably the at least one, more preferably the at least two sensors 252 are configured as a camera 252, more preferably as a color camera, more preferably as an area scan camera, more preferably as at least one CMOS sensor and/or at least one CCD sensor. The at least two sensors 252 are preferably each configured as a color camera and/or as an area scan camera and/or as at least one CMOS sensor and/or as at least one CCD sensor. In a preferred embodiment, each of the at least two sensors 252 is preferably configured as area scan camera. Preferably, at least one light source configured as an illumination device, for example an LED light source, in particular a light source for white light, is assigned to the respective, preferably the at least one, preferably the at least two sensors 252. Preferably, at least one illumination device is arranged in each case in the transport direction T directly upstream and/or directly downstream from a detection zone 253 of the respective, preferably at least one, preferably the at least two sensors 252, and is directed at the detection zone 253. Preferably, the at least one, preferably the at least two, sensors 252 in each case comprise at least one optical device, for example at least one lens, which is preferably arranged between the at least one sensor 252 and the transport path intended for the transport of sheets 02.

Preferably, the at least one sensor 252, preferably the at least two sensors 252, of the at least one sensor device 251 are configured to selectively detect, and/or detect, at least one edge 07; 08; 09, preferably the leading edge 07, and/or at least one printing mark 11 of sheets 02, preferably of the at least one sheet 02. The position and/or alignment of the sheet 02 is preferably determined and/or can be determined independently of the present format of the at least one sheet 02 and/or the embodiment of the leading edge 07 of the at least one sheet 02, for example due to fraying or uneven cutting, and/or the presence of at least one print image. Preferably, the at least one sensor device 251 and/or the at least one control system 1100 connected to the sensor device 251 are configured to selectively evaluate, and/or evaluate, the at least one detected edge 07; 08; 09 and/or the at least one detected printing mark 11, preferably with respect to position information of the at least one sheet 02 of the sheets 02. Preferably, the at least one sensor device 251 and/or the at least one control system 1100 connected to the sensor device 251 are configured to evaluate, and/or evaluate, the at least one detected printing mark 11, preferably with respect to position information of the at least one sheet 02 of the sheets 02. After the at least one edge 07; 08; 09 and/or printing mark 11 have been detected, the position information is preferably evaluated. More preferably, information is derived, for example by the at least one sensor device 251 and/or by the control system 1100, from the evaluation of the position information, as to how at least one setting variable of the processing machine 01 is to be changed, preferably as to how the at least one servo drive 218; 231; 237 of the infeed system 202, more preferably the at least one servo drive 218 influencing and/or superimposing the movement of the at least one transport means 204 from the alignment position PA to the transfer position PU, is to be activated. The at least one sensor device 251 and/or the at least one control system 1100 connected to the sensor device 251 are preferably configured to derive, and/or derive, information from the evaluation of the position information as to how at least one setting variable of the processing machine 01 is to be changed, preferably as to how the at least one servo drive 218; 231; 237 of the infeed system 202 is to be activated. The at least one sensor device 251 and/or the at least one control system 1100 connected to the sensor device 251 are preferably configured to derive, and/or derive, information from the evaluation of the position information as to how the servo drive 218 influencing and/or superimposing a movement of the at least one transport means 204 from the alignment position PA to the transfer position PU is to be activated. Advantageously, it is possible to select between the evaluation of the information of the detected edge 07; 08; 09 and/or printing mark 11, for example as a function of the quality of the detected edge 07; 08; 09 and/or printing mark 11 and/or of the completeness of the detected information. More preferably, the at least one, preferably the at least two, sensors 252 of the sensor device 251 are configured, each in an unchanged position of the relevant sensor 252, to selectively detect at least one edge 07; 08; 09 and/or printing mark 11 of sheets 02. Preferably, the respective, preferably the at least one, more preferably the at least two, sensors 252 are positioned so that preferably at least one edge 07; 08; 09, preferably the leading edge 07, and/or at least one side edge 09 of the respective, preferably of the at least one, sheet 02, and preferably additionally at least one region of the sheet 02 can be detected by at least one printing mark 11, in particular within a measurement, preferably simultaneously, and/or preferably in an unchanged position of the relevant, preferably of the at least one, more preferably of the at least two sensors 252, preferably within the one detection zone 253 of the respective, preferably the at least one, sensor 252.

The sheet processing machine 01 preferably comprises the at least one sensor device 251 comprising the at least two sensors 252, each of the at least two sensors 252 being configured to preferably selectively detect at least one printing mark 11 and/or at least one edge 07; 08; 09 of the respective sheet 02, without changing the position of the respective sensor 252, wherein the sheet 02 is arranged in the alignment position PA. The sheet processing machine 01 preferably comprises the at least one sensor device 251 comprising the at least two sensors 252, each of which preferably selectively detects at least one printing mark 11 and/or at least one edge 07; 08; 09 of the respective sheet 02, without changing the position of the respective sensor 252, wherein the respective sheet 02 is arranged in the alignment position PA. The sheet processing machine 01 preferably comprises the at least one sensor device 251 comprising the at least two sensors 252, each of which preferably selectively detects at least one printing mark 11 and/or at least one edge 07; 08; 09 of the respective sheet 02, which is arranged in the alignment position PA, without changing the position of the respective sensor 252. At least the at least one sensor 252, preferably the at least two sensors 252, which are configured to selectively detect an edge 07; 08; 09 and/or a printing mark 11 of the at least one sheet 02, preferably has at least two different positions, for example the positions corresponding to different formats of sheets 02. For example, when the format of the sheets 02 is changed, preferably the at least one sensor 252, preferably the at least two sensors 252 are moved by means of at least one positioning drive.

The at least two sensors 252, in particular exactly two sensors 252, are preferably arranged parallel next to one another in the transport direction T of sheets 02. The at least two sensors 252 arranged parallel next to one another in the transport direction T, that is, behind one another in the transverse direction A, are preferably arranged spaced apart from one another at a distance of greater than zero. The at least two sensors 252 of the sensor device 251 are preferably arranged next to one another in the transport direction T at the alignment position PA, wherein the alignment position PA is established by at least two front lay marks 203 of the infeed system 202 of the sheet processing machine 01 which are arranged horizontally to the transport direction T and parallel next to one another. Preferably, these at least two sensors 252 are configured to preferably selectively detect the leading edge 07 and/or at least one printing mark 11 of a respective sheet 02.

The at least one sensor device 251 preferably comprises at least one positioning drive. The at least one positioning drive is preferably configured to move and/or moves at least one sensor 252 of the at least two sensors 252. Preferably, the at least one sensor 252, preferably the at least two sensors 252 comprise at least one positioning drive, for example at least one linear motor and/or electric motor and/or motor comprising a threaded spindle. Preferably, the position of the at least one sensor 252, preferably of the at least two sensors 252, is adapted by the at least one positioning drive to the respective width and/or the respective format of the at least one sheet 02, in particular orthogonal to the transport direction T. As an alternative, the at least two sensors 252 arranged parallel to one another are mechanically adjusted. In a preferred embodiment, the at least two sensors 252 arranged parallel next to one another in the transport direction T comprise at least one positioning drive of at least one respective sensor 252. The at least two sensors 252 arranged parallel next to one another in the transport direction T, that is, behind one another in the transverse direction A, preferably comprise a joint positioning drive or each comprise a dedicated positioning drive. The relevant at least two sensors 252 arranged parallel next to one another in the transport direction T, that is, behind one another in the transverse direction A, preferably comprise a joint positioning drive or each comprise a dedicated positioning drive.

The at least one sensor device 251, preferably the at least two sensors 252, the at least two sensors 252 preferably being arranged next to one another in the transport direction T, are preferably configured to determine the position of the at least one sheet 02 in the transport direction T and/or, preferably and, in the transverse direction A. In a preferred embodiment of the sensor device 251, the at least two sensors 252 that are preferably arranged next to one another in the transport direction T are configured to determine the position of the at least one sheet 02 in the transport direction T and/or in the transverse direction A, preferably both in the transport direction A and in the transverse direction A, by evaluating the preferably selective detection of the at least one printing mark 11, preferably at least two printing marks 11, more preferably at least two printing marks 11 arranged next to one another in the transport direction T, more preferably at least one printing mark 11 per sensor 252 and/or the at least one edge 07; 08; 09. Preferably, in this way, the position of the at least one sheet 02 in the transport direction T and in the transverse direction A and an oblique position or skewed position of the at least one sheet 02 is determined, preferably unambiguously determined, by the at least two sensors 252 arranged next to one another in the transport direction T.

Preferably, the at least one sensor 252, preferably at least one sensor 252 of the at least two sensors 252, is configured to selectively detect the at least one edge 07; 08; 09, preferably the leading edge 07, and/or the at least one printing mark 11, preferably to determine the position of the at least one sheet 02 and/or preferably to establish at least one position error of the at least one sheet 02. The at least one sensor 252, preferably at least one sensor 252 of the at least two sensors 252, more preferably the at least two sensors 252 are preferably configured to detect the position of the preferably selectively detected at least one edge 07; 08; 09 and/or printing mark 11 relative to a reference position and/or, for example, the arrival time of the preferably selectively detected at least one edge 07; 08; 09 and/or printing mark 11 at the alignment position PA and/or in the at least one detection zone 253, relative to a reference, and/or detects the position and/or the arrival time. For example, when using the at least two sensors 252, it is possible to form a mean value, and to thus increase the accuracy of the position detection. More preferably, the at least one sensor 252, preferably at least one sensor 252 of the at least two sensors 252, more preferably the at least two sensors 252 preferably detect the position of the detected at least one printing mark 11 relative to a reference position and/or the arrival time of the detected at least one printing mark 11 at the alignment position PA and/or in the at least one detection zone 253, relative to a reference.

To determine the position in the transport direction T of the at least one sheet 02 and/or a position error in the transport direction T of the at least one sheet 02, the at least one sensor 252, preferably at least one sensor 252 of the at least two sensors 252, is preferably configured to detect the position, in particular in the transport direction T, of the preferably selectively detected at least one edge 07; 08; 09, preferably the leading edge 07, and/or printing mark 11 relative to a reference position. As an alternative, for example, the at least one sensor 252 is configured to detect the arrival time of the preferably selectively detected at least one edge 07; 08; 09, preferably the leading edge 07, and/or printing mark 11 at the alignment position PA. The at least one preferably selectively detected edge 07; 08; 09 and/or printing mark 11 preferably includes at least one measurement point, preferably at least two measurement points, more preferably at least four measurement points, more preferably a multiplicity of measurement points, for determining a position error in the transport direction T. The at least two measurement points are preferably arranged next to one another in the transport direction T. The at least two measurement points are preferably simultaneously detected and/or evaluated. In the event of a deviation from a reference, preferably the target position, a position error in the transport direction T of the at least one sheet 02 is preferably present.

To determine a position error of the at least one sheet 02 in the form of a skewed position, each of the at least two sensors 252 is preferably configured to detect the position, in particular in the transport direction T, of the preferably selectively detected at least one edge 07; 08; 09, preferably the leading edge 07, and/or printing mark 11. This means that preferably each of the at least two sensors 252 in each case detects a printing mark 11, preferably in each case one printing mark 11 of the at least two printing marks 11. As an alternative, for example, each of the at least two sensors 252 is configured to detect the arrival time of the preferably selectively detected at least one edge 07; 08; 09, preferably the leading edge 07, and/or printing mark 11 at the alignment position PA. The at least two determined positions and/or arrival times are preferably compared to one another. In the event of a deviation from one another, a skewed position of the at least one sheet 02 is preferably present.

To determine the position in the transverse direction A of the at least one sheet 02 and/or a position error in the transverse direction A of the at least one sheet 02, the at least one sensor 252, preferably at least one sensor 252 of the at least two sensors 252, for example, only one sensor 252 of the at least two sensors 252, is preferably configured to detect the position, in particular in the transverse direction A, of the preferably selectively detected at least one edge 07; 08; 09, for example the side edge 09, and/or printing mark 11 relative to a reference position. The at least one preferably selectively detected edge 07; 08; 09 and/or printing mark 11 preferably includes at least one measurement point, preferably at least two measurement points, more preferably at least four measurement points, more preferably a multiplicity of measurement points, for determining a position error in the transverse direction A. The at least two measurement points are preferably arranged next one another in the transverse direction A, that is, behind one another in the transport direction T. The at least two measurement points are preferably simultaneously detected and/or evaluated. In the event of a deviation from a reference, preferably the target position, a position error in the transverse direction A of the at least one sheet 02 is preferably present.

The position of the at least one printing mark 11, preferably thus the position of the at least one sheet 02, is preferably determined at least by way of the center, for example the centroid, of the at least one printing mark 11. For this purpose, preferably the shape corresponding to the printing mark 11 on the at least one sheet 02, for example at least the boundary lines of the at least one printing mark 11, is detected, and the center, for example the centroid, of the at least one printing mark 11 is calculated therefrom. As an alternative, for example, the position of the at least one printing mark 11 in the transport direction T is determined by a side and/or an edge and/or an axis of the at least one printing mark 11, which is preferably parallel to the transverse direction A. As an alternative, for example, the position of the at least one printing mark 11 in the transverse direction A is determined by a side and/or an edge and/or an axis of the at least one printing mark 11, which is preferably parallel to the transport direction T.

At least one sensor 252 of the at least two sensors 252 preferably in each case detects the position in the transport direction T of the at least one substrate 02, preferably configured as a sheet 02, and/or the position in the transverse direction A of the at least one substrate 02, which is preferably configured as a sheet 02. The at least one sensor 252, preferably at least one sensor 252 of the at least two sensors 252, more preferably the at least two sensors 252 are preferably each configured to detect and/or to determine the position in the transport direction T of the at least one sheet 02 and/or, preferably and, the position in the transverse direction A of the at least one sheet 02 and/or detect the position and/or determine the position. The at least one sensor 252, preferably at least one sensor 252 of the at least two sensors 252, more preferably the at least two sensors 252 are preferably each configured to detect and/or to determine a position error in the transport direction T of the at least one sheet 02 and/or, preferably and, a position error in the transverse direction A of the at least one sheet 02 and/or detect the position error and/or determine the position error. In particular, the at least one sensor 252, preferably at least one sensor 252 of the at least two sensors 252 are configured to detect and/or to determine both a position error in the transport direction T of the at least one sheet 02 and a position error in the transverse direction A of the at least one sheet 02 and/or detect the position error and/or determine the position error. Preferably, the at least two sensors 252 are configured to detect and/or to determine a skewed position of the at least one sheet 02 and/or detect the skewed position and/or determine the skewed position.

Preferably in addition, at least one sensor 252, for example at least one sensor 252 of the at least two sensors 252 arranged next to one another in the transport direction T, or at least one third sensor 252, is configured to detect the at least one sheet 02 laterally, for example preferably selectively at its at least one side edge 09 and/or by at least one printing mark 11. The at least one sensor 252 is preferably configured to determine the lateral positioning in the transverse direction A of the at least one sheet 02. In the event of a lateral alignment of the at least one sheet 02 of the sheets 02, the control system 1100 and/or the at least one sensor device 251, preferably the at least two sensors 252 preferably arranged next to one another in the transport direction T, are preferably configured to activate the at least one servo drive 237 of the lateral alignment, as a function of the detection of the sheet 02, preferably the selective detection of the at least one edge 07; 08; 09, preferably the leading edge 07, and/or the at least one printing mark 11, preferably the at least one printing mark 11 of the at least two printing marks 11 preferably arranged next to one another in the transport direction T, by way of the at least one sensor device 251, preferably by way of the at least two sensors 252.

In a preferred embodiment, the sensor device 251 comprises the at least one, preferably third, sensor 252 for laterally detecting the at least one sheet 02. For example, the at least one third sensor 252 is arranged in the transport direction T for laterally detecting sheets 02. Preferably, the at least one third sensor 252 is arranged in the transport direction T to laterally detect at least one sheet 02, preferably the at least one sheet 02 of the sheets 02. Preferably, the at least one sensor 252, preferably the at least one third sensor 252, comprises at least one positioning drive for changing a position of at least the relevant sensor 252, for example at least one linear motor and/or electric motor and/or motor comprising a threaded spindle. Preferably, the positioning drive assigned thereto is configured to change the position, preferably at least in the transverse direction A, of the at least one sensor 252, preferably of at least one sensor 252 of the at least two sensors 252. Preferably, the at least one positioning drive is configured to change the position, preferably at least in the transverse direction A, of the at least one sensor 252, preferably of at least one sensor 252 of the at least two sensors 252. Preferably, the at least one sensor 252, preferably selectively detecting at least one lateral printing mark 11 and/or at least one side edge 09 of sheets 02 in the transport direction T in front of the alignment position PA is arranged so that a detection zone 253 of the relevant sensor 252 is configured to at least temporarily detect the at least one lateral printing mark 11 and/or the at least one side edge 09 of the, preferably at least one, sheet 02 of the sheets 02. Preferably, the at least one sensor 252, preferably the at least one third sensor 252, for the preferably selective detection of at least one lateral printing mark 11 and/or at least one side edge 09 of sheets 02 in the transport direction T in front of the alignment position PA is arranged so that the detection zone 253 of the relevant sensor 252, preferably of the at least one third sensor, is configured to at least temporarily detect the at least one lateral printing mark 11 and/or the at least one side edge 09 of the sheet 02. The at least one, preferably third, sensor 252 for the lateral detection of sheets 02 preferably comprises at least one positioning drive for changing a position of at least the relevant, preferably at least one third, sensor 252. The position of the relevant, preferably of the at least one third, sensor 252 is preferably adapted by the at least one positioning drive to the respective width and/or the respective format of the sheet 02 to be detected, in particular orthogonal to the transport direction T.

Preferably, a sheet 02, preferably the at least one sheet 02 of the sheets 02, is at rest in the alignment position PA during the detection by the at least one sensor 252, preferably the at least two sensors 252, more preferably the at least two sensors 252 arranged parallel next to one another, of the sensor device 251. The at least one sensor device 251, preferably the at least two sensors 252 are preferably configured to detect the at least one sheet 02 at rest in the alignment position PA. In addition, or as an alternative, a sheet 02, preferably the at least one sheet 02 of the sheets 02, is at least partially fixed in its position by the at least one holder 206; 207 of the at least one transport means 204 of the at least one infeed system 202 during the detection by the at least one sensor 252, preferably the at least two sensors 252, more preferably the at least two sensors 252 arranged parallel next to one another. Preferably, the at least one holder 206; 207 of the at least one transport means 204 of the at least one infeed system 202 is configured to at least partially fix the at least one sheet 02 in its position during the detection by the at least one sensor 252, preferably the at least two sensors 252, more preferably the at least two sensors 252 arranged parallel next to one another.

Preferably, the at least one sensor device 251, in particular the at least one respective sensor 252 of the sensor device 251, preferably each sensor 252 of the sensor device 251, is connected to at least one control unit of the control system 1100 and/or preferably comprises at least one control unit of the control system 1100. Preferably, the respective, preferably at least one, sensor 252, preferably the at least two sensors 252 generate at least one measurement signal, which is preferably processed in the control unit and/or which is compared to a reference stored in the control unit. Preferably, the at least one control unit issues at least one signal, in particular at least one open-loop control signal and/or at least one closed-loop control signal, to at least one component of the sheet processing machine 01. Preferably, the at least one sensor device 251 is configured to control by open-loop control and/or by closed-loop control the at least one servo drive 218; 231; 237 of the infeed system 202, in particular all respective servo drives 218; 231; 237 of the infeed system 202, and/or controls by open-loop control and/or closed-loop control the at least one servo drive 218; 231; 237, as a function of the detection of the respective, preferably at least one, sheet 02 by the at least one sensor 252, preferably the at least two sensors 252.

At least one component of the processing machine 01 is controlled by closed-loop control and/or open-loop control. The at least one sensor device 251, preferably at least one sensor 252 of the at least two sensors 252 is, more preferably the at least two sensors 252 are, preferably configured to detect, and/or detect, the at least one print control strip 21 of the at least one sheet 02. Preferably, the at least one control patch 22 is evaluated by the at least one sensor device 251 and/or by the at least one control system 1100 connected to the at least one sensor device 251. Preferably, the at least one sensor device 251 and/or the at least one control system 1100, as a function of the detected at least one control patch 22, preferably as a function of the at least one detected control patch 22 relative to its reference, generates at least one signal, preferably at least one control signal and/or at least one warning signal. Preferably, at least one component of the processing machine 01 is activated and/or controlled by closed-loop control as a function of the evaluation of the at least one print control strip 21, preferably of the at least one control patch 22 of the at least one print control strip 21. For example, the at least one warning signal is output to an operator. For example, the at least one warning signal is output to the operator in the form of an acoustic signal by means of a signal generator, for example a siren, or in the form of an optical signal, for example a notification on at least one display.

The at least one sensor device 251, preferably at least one sensor 252 of the at least two sensors 252, detects the at least one printing mark 11, integrated into the at least one print control strip 21, of the at least one substrate 02, which is preferably configured as a sheet 02. The at least two sensors 252 are preferably configured to detect the at least one print control strip 21, the at least one print control strip 21 including at least two printing marks 11. The at least one sensor device 251, preferably at least one sensor 252 of the at least two sensors 252, more preferably the at least two sensors 252 are configured to detect and/or detect the at least one printing mark 11, preferably at least two printing marks 11, more preferably two printing marks 11, the at least one printing mark 11 being integrated into the at least one print control strip 21. The at least one sensor device 251, preferably at least one sensor 252 of the at least two sensors 252 is, more preferably the at least two sensors 252 are, preferably configured to detect, and/or detect, the at least one printing mark 11, preferably at least two printing marks 11, more preferably two printing marks 11, the at least one printing mark 11 being configured as a mark for aligning the at least one sheet 02 in the transport direction T and in the transverse direction A. The at least one sensor device 251, preferably at least one sensor 252 of the at least two sensors 252 is, more preferably the at least two sensors 252 are, preferably configured to detect, and/or detect, the at least one printing mark 11, more preferably at least two printing marks 11, more preferably two printing marks 11, the at least one printing mark 11 being configured as a mark for monitoring a color register and/or for monitoring a perfecting register and/or for aligning the at least one sheet 02 in the transport direction T and in the transverse direction A. The at least one sensor device 251, preferably at least one sensor 252 of the at least two sensors 252 is, more preferably the at least two sensors 252 are, preferably configured to detect, and/or detect, the at least one printing mark 11, preferably at least two printing marks 11, more preferably two printing marks 11, wherein the at least one sheet 02 comprises the at least one printing mark 11 in a region outside at least one print image and/or in an edge region of the at least one sheet 02 in the region of the edge 07, configured as the leading edge 07, of the at least one sheet 02 and/or preferably spaced apart from the leading edge 07. The at least one sensor device 251, preferably at least one sensor 252 of the at least two sensors 252, more preferably the at least two sensors 252 are preferably configured to detect and/or detect the at least one printing mark 11, preferably at least two printing marks 11, more preferably two printing marks 11, the at least one printing mark 11 being configured as a rectangle and/or a square. Preferably, at least one sensor 252 of the at least two sensors 252 is configured to detect the at least one printing mark 11, the at least one printing mark 11 being configured as a geometric figure and/or a line-shaped element. The at least one sensor device 251, preferably at least one sensor 252 of the at least two sensors 252, more preferably the at least two sensors 252 are preferably configured to detect and/or detect the at least one printing mark 11, preferably at least two printing marks 11, more preferably two printing marks 11, wherein at least one side and/or axis of the at least one printing mark 11 is arranged parallel to the leading edge 07 of the at least one sheet 02 and/or parallel to the transverse direction A and/or wherein at least one side and/or axis of the at least one printing mark 11 is arranged parallel to the side edge 09 of the at least one sheet 02 and/or parallel to the transport direction T. The at least one sensor device 251, preferably the at least two sensors 252, are preferably configured to detect and/or detect the at least two printing marks 11 of the at least one sheet 02, more preferably two printing marks 11, the at least two printing marks 11 being arranged parallel to one another and spaced apart from one another along the leading edge 07 of the at least one sheet 02. Each of the at least two sensors 252 is preferably configured to detect and/or detects at least one printing mark 11 of the at least two printing marks 11. Preferably, the at least two printing marks 11 are integrated into the at least one print control strip 21, wherein the at least two printing marks 11 are spaced apart from one another and/or wherein at least one element for color management 23 is arranged between the at least two printing marks 11 and/or wherein the at least two printing marks 11 are arranged symmetrically with respect to the axis of symmetry of the print control strip 21. The at least two sensors 252 are preferably configured to detect the at least two printing marks 11 that are integrated into the at least one print control strip 21. Preferably, the at least one sensor device 251 and/or the at least one control system 1100 connected to the sensor device 251 evaluate the at least one detected printing mark 11, preferably with respect to position information of the at least one substrate 02, preferably of the at least one sheet 02 of the sheets 02. Preferably, the at least one sensor device 251 is configured to control by open-loop control and/or by closed-loop control the at least one servo drive 218; 231; 237 of the at least one infeed system 202 of the at least one infeed unit 200, in particular all respective servo drives 218; 231; 237 of the at least one infeed system 202, and/or controls by open-loop control and/or closed-loop control the at least one servo drive 218; 231; 237, as a function of the detection of the at least one substrate 02, preferably configured as a sheet 02, preferably as a function of the detection by the at least one sensor 252, more preferably as a function of the detection by the at least two sensors 252. The at least one servo drive 218; 231; 237 is preferably controlled by closed-loop control and/or open-loop control as a function of the detection of the at least one printing mark 11, preferably of at least two printing marks 11. The at least one substrate 02, preferably configured as a sheet 02, and/or preferably the at least one transport means 204 are adjusted as a function of the detection by the at least one sensor device 251, preferably the at least one sensor 252, more preferably the at least two sensors 252, in the transport direction T and/or transverse direction A, preferably for compensating for at least one position error of the at least one sheet 02. This means, preferably, that the at least one substrate 02, which is preferably configured as a sheet 02, is aligned as a function of the detection of the at least one printing mark 11, preferably the at least two printing marks 11, in the transport direction T and/or in the transverse direction A by a movement of the substrate 02 that is preferably configured as a sheet 02.

Preferably, the at least one sensor device 251, preferably the at least one sensor 252 of the at least two sensors 252, is configured to detect and/or evaluate and/or detects and/or evaluates the at least one element for color management 23. The at least one sensor device 251 preferably carries out at least one measurement of the color density and/or at least one measurement of at least one spectral value and/or at least one measurement of the area coverage of the at least one printing ink, preferably of the individual printed printing inks, by means of a detection and/or an evaluation of the at least one element for color management 23, preferably by means of a detection and/or an evaluation of at least one element for color management 23 of a printing ink, more preferably by means of a detection and/or an evaluation of at least one element for color management 23 per printing ink. Preferably, at least the solid-color patches 32; 34, for example additionally or alternatively the screen dot patches 33; 34, are measured and/or evaluated. Preferably, the at least one sensor device 251 and/or the at least one control system 1100 connected to the sensor device 251 compare the at least one obtained measured value to a reference, for example a stored measured value and/or to a second measured element for color management 23 and/or preferably a reference value obtained by evaluating the at least one reference patch 29. In the event of a deviation of the measured value from the reference, the at least one sensor device 251 and/or the at least one control system 1100 generates at least one signal, preferably at least one warning signal and/or at least one control signal. For example, the at least one control signal is conducted to at least one application mechanism, in particular the application mechanism that printed the at least one detected and evaluated control patch 22. Preferably, the at least one application mechanism is monitored with respect to the ink application that is carried out and/or is adapted and/or stopped in accordance with the control signal. For example, in addition or as an alternative, the at least one control signal is conducted to the at least one shaping unit 300 and/or to the at least one stripping unit 400 and/or to the at least one multiple-up separating unit 500 and/or to the at least one delivery unit 600. For example, a processing operation of the at least one sheet 02 in the at least one shaping unit 300 and/or the at least one stripping unit 400 and/or the at least one multiple-up separating unit 500 is suspended. Preferably, the at least one sheet 02, preferably without further processing, is conducted into the at least one delivery unit 600 and/or into the at least one offcut piece delivery unit 800.

Preferably, the at least one sensor device 251, preferably the at least one sensor 252 of the at least one sensor device 251, detects and/or evaluates the at least one print register element 24. Preferably, at least one distance between at least two register elements 37; 38; 39; 41, for example between at least two register elements 37; 38; 39; 41 of the same printing color or between at least two register elements 37; 38; 39; 41 of two printing colors that differ from one another, is determined and/or evaluated. The position of the at least one register element 37; 38; 39; 41 is preferably determined and compared to at least one target position. The target position is preferably stored digitally. Preferably, the at least one sensor device 251, preferably the at least one sensor 252 of the at least one sensor device 251, generates at least one signal, which contains information with respect to the current position of the at least one register element 37; 38; 39; 41 and/or with respect to the at least one distance. For example, the at least one signal is conducted to a control console and/or the control system 1100 of the processing machine 01 and/or to a printing press arranged upstream from the processing machine 01. A register deviation is preferably present when the at least one distance does not correspond to a target distance. The target distance is digitally stored, for example, or determined by at least one second distance between two further register elements 37; 38; 39; 41 of the at least one print register element 24. Preferably, in addition or as an alternative, a register deviation is present when the position of the at least one register element 37; 38; 39; 41 deviates from its target position. In the case of a register deviation, preferably a signal, preferably a warning signal and/or at least one control signal, is generated, which is conducted to at least one servo motor of at least one component of the processing machine 01 and/or to at least one servo motor of the printing press arranged upstream from the processing machine 01, preferably to at least one servo motor of a cylinder of an application mechanism. Preferably, the circumferential register and/or the lateral register and/or the diagonal register of at least one application mechanism, preferably at least one printing mechanism and/or at least one finish coating mechanism, is controlled by closed-loop control for printing the at least one sheet 02 in accordance with the at least one signal, preferably in accordance with the evaluation of the at least one print register element 24. For example, in addition or as an alternative, the at least one control signal is conducted to the at least one shaping unit 300 and/or to the at least one stripping unit 400 and/or to the at least one multiple-up separating unit 500 and/or to the at least one delivery unit 600. For example, a processing operation of the at least one sheet 02 in the at least one shaping unit 300 and/or the at least one stripping unit 400 and/or the at least one multiple-up separating unit 500 is suspended. Preferably, the at least one sheet 02, preferably without further processing, is conducted into the at least one delivery unit 600 and/or into the at least one offcut piece delivery unit 800.

Preferably, the at least one side recognition mark 26 is detected and evaluated either in the processing machine 01 or offline, for example at at least one measuring station and/or control console. Preferably, at least one sensor of a measuring system, for example at least one camera and/or at least one color sensor, of the measuring station and/or the control console detects the at least one side recognition mark 26. Preferably, the at least one side recognition mark 26 is recognized and/or evaluated by the at least one measuring system, preferably its sensor, which is arranged at at least one measuring table and/or control console of the processing machine 01. For example, in addition or as an alternative, the at least one sensor device 251 of the processing machine 01 detects and/or evaluates the at least one side recognition mark 26. It is preferably determined by means of the at least one side recognition mark 26 whether the sensor of the measuring system detecting the side recognition mark 26 and/or the at least one sensor 252 of the at least one sensor device 251 is directed at the upper side or at the underside of the at least one sheet 02. This preferably takes place by evaluating the pattern of the at least one side recognition mark 26. Preferably, the at least one sensor device 251, for example, alternatively, the at least one measuring system, determines the side, this being the upper side or the underside, of the at least one sheet 02, at which the at least one sensor 252 is directed, by detecting and/or evaluating the at least one side recognition mark 26. Preferably, at least one first signal for recognizing the upper side of the at least one sheet 02 and/or at least one second signal for recognizing the underside of the at least one sheet 02 are generated by means of the at least one sensor of the measuring system and/or by means of the at least one sensor 252 of the at least one sensor device 251. If the at least one sensor of the measuring system and/or the at least one sensor 252 of the at least one sensor device 251, at the time that the at least one side recognition mark 26 is detected, is directed at one side, this being the upper side or underside, of the at least one sheet 02 which does not require further evaluation, or when the other side, this being the underside or the upper side, is to be evaluated, the at least one sheet 02 is reversed from the upper side to the underside, or vice versa, prior to further detections or evaluations.

Preferably, the position of the at least one side recognition mark 26 is compared to a reference position, which is preferably digitally stored, for example, by the at least one control system 1100. Preferably, the position of the at least one control strip 21, and preferably, as a result, the position of the at least one sheet 02, on the at least one measuring table and/or the at least one control console is determined based on the at least one side recognition mark 26, and is adapted if needed. Preferably in addition or as an alternative, the position of the at least one print control strip 21 on the at least one sheet 02 is determined based on the at least one side recognition mark 26. Preferably, the height and/or the skewed position and/or the scaling of the at least one print control strip 21 are determined based on the at least one side recognition mark 26. The height of the at least one print control strip 21 preferably describes its extension along the direction from the trailing edge 08 to the leading edge 07 of the at least one sheet 02. The skewed position of the at least one print control strip 21 preferably describes its position in the direction of a first side edge 09 to a second side edge 09 of the at least one sheet 02. A skewed position of the at least one print control strip 21 is in particular present when the direction of the longest extension of the at least one print control strip 21 to the direction that is directed from the first side edge 09 to the second side edge 09 has an angle dissimilar from zero and/or dissimilar from ninety degrees. The scaling of the at least one print control strip 21 preferably describes the ratio of its extension along the direction from the trailing edge 08 to the leading edge 07 of the at least one sheet 02 relative to its extension in the direction that is directed from the first side edge 09 to the second side edge 09. Preferably, the height and/or the skewed position and/or the scaling of the at least one print control strip 21 are compared to a preferably stored reference, for example stored digitally and/or created using a sample sheet. In the event of deviations from the reference, preferably at least one signal is generated, which indicates the deviation.

Preferably, the at least one plate recognition patch 27 is detected and/or evaluated by an operator, preferably visually, for example at the at least one control console or measuring station. For example, as an alternative, the at least one plate recognition patch 27 is detected and/or evaluated by the at least one sensor of the measuring system. For example, as an alternative, the at least one plate recognition patch 27 is detected and/or evaluated by the at least one sensor device 251, preferably the at least one sensor 252 of the at least one sensor device 251. The printing ink of the at least one element for plate recognition 42; 43; 44; 46 of the at least one plate recognition patch 27 is assigned to an application mechanism and/or a printing plate which generated the at least one element for plate recognition 42; 43; 44; 46. The assignment is preferably compared to a reference and/or the job data. In the event of a deviation of the assignment from the reference and/or the job data, preferably at least one signal, for example at least one warning signal and/or at least one control signal, is generated. In the event of a deviation of the assignment from the reference and/or the job data, for example, the printing inks used in, for example, two application mechanisms were mixed up. So as to eliminate a deviation of the assignment, for example, the printing inks of the application mechanisms are exchanged and/or the printing plates of the application mechanisms are exchanged and/or the printing plates present in the application mechanisms are replaced with further printing plates. Preferably, the at least one application mechanism is monitored with respect to the ink application that is carried out and/or is adapted and/or stopped in accordance with the control signal. For example, in addition or as an alternative, the at least one control signal is conducted to the at least one shaping unit 300 and/or to the at least one stripping unit 400 and/or to the at least one multiple-up separating unit 500 and/or to the at least one delivery unit 600. For example, a processing operation of the at least one sheet 02 in the at least one shaping unit 300 and/or the at least one stripping unit 400 and/or the at least one multiple-up separating unit 500 is suspended. Preferably, the at least one sheet 02, preferably without further processing, is conducted into the at least one delivery unit 600 and/or into the at least one offcut piece delivery unit 800.

Preferably, the at least one sensor of the at least one measuring system detects and/or evaluates the at least one information mark 28. Preferably, as an alternative or in addition, the at least one sensor device 251, preferably the at least one sensor 252 of the at least one sensor device 251, detects the at least one information mark 28 and/or reads out the information of the at least one information mark 28. For example, the at least one sensor of the at least one measuring system and/or the at least one sensor 252 of the at least one sensor device 251 conducts the read-out information to the at least one control system 1100. Preferably, at least one component of the processing machine 01, for example at least one unit 100; 200; 300; 400; 500; 600; 650; 700; 800; 900 of the processing machine 01 or at least one system 1000; 1100; 1200 of the processing machine 01 is controlled by closed-loop control in accordance with the read-out information. Preferably, the information of the at least one information mark 28 is saved, preferably by the at least one sensor device 251 or by the at least one control system 1100. Preferably, in addition or as an alternative, the information of the at least one information mark 28 is compared to stored job data and/or to stored arrangement rules. For example, the at least one control system 1100 compares the information of the at least one information mark 28 with respect to the job data, for example the type of processing that is to be carried out, to the job data stored for the at least one sheet 02 in the at least one control system 1100. For example, the at least one control system 1100 compares the information of the at least one information mark 28 with respect to the arrangement rules to the measured values, for example the arrangement of the at least one print control strip 21 on the at least one sheet 02, of the at least one sensor 252 of the sensor device 251. In the event of a deviation of the information from the stored data, the at least one control system 1100 preferably generates at least one signal, in particular at least one warning signal and/or at least one control signal, and/or prompts a channeling-out of the at least one sheet 02 out of the processing machine 01 and/or stops at least one processing operation or working operation of the at least one sheet 02 by the processing machine 01. For example, the information of the at least one information mark 28 of a first sheet 02 of at least one pile of sheets 02, for example in the case of a job change, is detected by the at least one sensor of the at least one measuring system and/or by the at least one sensor 252 of the at least one sensor device 251 and/or is preferably saved in the at least one control system 1100 and/or used to modify the processing machine 01 in accordance with a new job. For example, components of the processing machine 01, for example at least one unit 100; 200; 300; 400; 500; 600; 650; 700; 800; 900 of the processing machine 01 or at least one system 1000; 1100; 1200 of the processing machine 01, are controlled by closed-loop control and/or modified as a function of the detected information. Advantageously, this allows the processing process and/or the job-specific specifications to be monitored easily and quickly. This preferably offers relief to an operator and/or shortens the duration of a monitoring process.

The at least one sensor device 251, preferably the at least one sensor 252 of the at least one sensor device 251, for example at least one sensor 252 of the at least two sensors 252, preferably detects the at least one reference patch 29. The at least one sensor device 251 and/or the at least one control system 1100 preferably evaluate the at least one reference patch 29. The at least one sensor device 251 preferably measures the color density and/or at least one spectral value and/or the area coverage of printing ink of the reference patch 29. In particular, the at least one sensor device 251 and/or the at least one control system 1100 define the ascertained measured value as the zero point. Preferably, the measured value ascertained by the at least one reference patch 29 is saved and/or stored as a reference value, in particular as a zero point. Preferably, the at least one ascertained measured value of the at least one reference patch 29 is compared to at least one value saved in the at least one sensor device 251. Preferably, in addition or as an alternative, the at least one sensor 252 of the at least one sensor device 251, for example alternatively the at least one sensor of the at least one measuring system, is adjusted, preferably reset, by the detection of the at least one reference patch 29. In particular, the adjustment, in particular the establishment of the zero point, takes place with respect to the measurement scale of the zonal color measurement, preferably the color density and/or the spectral value and/or the area coverage of printing ink. In particular, a color density of 0% (zero percent) and/or a tonal value of 0% (zero percent), as a result of the detection and/or evaluation of the at least one reference patch 29, is specified to the at least one sensor of the at least one measuring system and/or the at least one sensor 252 of the at least one sensor device 251, in particular for the evaluation of the at least one element for color management 23. Preferably, the zero point with respect to the measurement scale of the zonal color measurement, preferably a color density of 0% (zero percent) and/or a tonal value of 0% (zero percent), in particular for the evaluation of the at least one element for color management 23, is determined by detecting and/or evaluating the at least one reference patch 29.

For example, the at least one control signal is conducted to at least one application mechanism, in particular the application mechanism that printed the at least one detected and evaluated control patch 22. Preferably, the at least one application mechanism is monitored with respect to the ink application that is carried out and/or is adapted and/or stopped in accordance with the control signal. For example, in addition or as an alternative, the at least one control signal is conducted to the at least one shaping unit 300 and/or to the at least one stripping unit 400 and/or to the at least one multiple-up separating unit 500 and/or to the at least one delivery unit 600. For example, a processing operation of the at least one sheet 02 in the at least one shaping unit 300 and/or the at least one stripping unit 400 and/or the at least one multiple-up separating unit 500 is suspended. Preferably, the at least one sheet 02, preferably without further processing, is conducted into the at least one delivery unit 600 and/or into the at least one offcut piece delivery unit 800.

Preferably, sheets 02 are fed to the at least one sheet-working unit 300, in particular to the at least one die-cutting unit 300, by feeding sheets 02 from the at least one feeder 100 via the at least one infeed unit 200.

The feeder unit 100 preferably comprises at least one feeder pile 101, which preferably comprises a multiplicity of sheets 02, wherein the multiplicity of sheets 02 are preferably present at least temporarily in a stacked manner, on top of one another in the vertical direction V. The spatial area of the at least one feeder pile 101 is preferably delimited by at least one front stop in the transport direction T. The feeder unit 100 preferably comprises at least one suction device 102, which is preferably arranged above, i.e., in the vertical direction V above the at least one feeder pile 101. The feeder unit 100 preferably comprises at least one transport means 103; 104. Preferably, the at least one suction device 102 comprises the at least one transport means 103; 104 of the feeder unit 100 for transporting sheets 02, preferably the respective uppermost sheet 02 of the feeder pile 101, from the feeder pile 101 to at least one unit 200; 300; 400; 500; 600; 650; 700; 800; 900 arranged downstream from the feeder unit 100 in the transport direction T. The feeder unit 100 preferably comprises the at least one transport means 103 configured as a vertical suction element 103 and/or the at least one transport means 104 configured as a horizontal suction element 104.

The at least one vertical suction element 103 is preferably configured to at least partially lift sheets 02, preferably the respective uppermost sheet 02 of the feeder pile 101, in the vertical direction V. Preferably in addition or as an alternative, the at least one vertical suction element 103 is configured to at least partially position sheets 02, preferably the respective uppermost sheet 02 of the feeder pile 101, within a plane of the transport path for further transport within the processing machine 01.

The plane of the transport path is preferably the plane that is spanned by the transport direction T and the transverse direction A at the relevant location of the transport path.

The at least one horizontal suction element 104 is preferably configured to at least partially, preferably completely, transport the respective sheet 02, which was preferably at least partially lifted by the vertical suction element 103, within the plane of the transport path in the transport direction T. The at least one transport means 103; 104 of the feeder unit 100, preferably the at least one horizontal suction element 104, is preferably configured to feed the respective sheet 02 to at least one feeder table 107 arranged downstream from the feeder pile 101 in the transport direction T.

For example, the at least one feeder unit 100 comprises at least one device, preferably at least one blower device, preferably for supporting the transport of sheets 02 within the at least one feeder unit 100. Preferably, the at least one blower device is configured to generate at least one air current and/or at least one air current can be generated, which was lifted beneath, i.e., to a position located beneath in the vertical direction V, an underside of a respective sheet 02, which was preferably lifted from the at least one feeder pile 101 by the at least one vertical suction element 103. The sheet 02 that was removed from the at least one feeder pile 101 is thus preferably positioned to a large extent, preferably completely, within the plane of the transport path of the processing machine 01 on at least one feeder table 107 of the at least one feeder unit 100.

Preferably in addition or as an alternative, the at least one transport means 103; 104 of the at least one feeder unit 100 is configured to generate at least one preferably imbricated stream of sheets 02.

The at least one feeder unit 100 preferably comprises at least one transport means 108 of the at least one feeder unit 100. The at least one transport means 108 of the at least one feeder unit 100 is preferably configured as at least one conveyor belt 108. Preferably, sheets 02 are transported by means of the at least one transport means 108 of the at least one feeder unit 100 in the transport direction T from the at least one feeder unit 100 to a unit 200; 300; 400; 500; 600; 650; 700; 800; 900 arranged downstream in the transport direction T.

The at least one feeder 100 is preferably connected to the at least one infeed unit 200 via the at least one feeder table 107. Preferably, the at least one transport means 108 of the feeder 100, which is preferably configured as a conveyor belt 108, is arranged in the transport direction T between the at least one feeder pile 101 and the at least one infeed unit 200. The at least one transport means 108 of the feeder 100 is preferably arranged at the at least one feeder table 107. In a preferred embodiment, the at least one transport means 108 is configured as at least one conveyor belt 108 and/or as at least one suction conveyor belt 108. For example, the at least one transport means 108 comprises at least two conveyor belts 108 that are preferably arranged parallel to one another, wherein preferably at least one of the conveyor belts 108 is configured as a suction conveyor belt 108. Sheets 02 are preferably transported on the at least one transport means 108 and/or are located on the at least one transport means 108.

The at least one transport means 108 preferably comprises at least one drive 111. The at least one drive 111 of the at least one transport means 108 is preferably configured as a dedicated drive. For example, the at least one drive 111 is configured as an electric motor. The at least one drive 111 is preferably controlled by closed-loop control and/or open-loop control independently of the at least one drive 1001 of the drive system 1000.

The at least one infeed unit 200 preferably comprises at least one sensor 261 configured as a detection sensor 261, preferably exactly one detection sensor 261, having at least one detection zone 262. The at least one detection sensor 261 is preferably configured as a reflex scanner 261 or as a light barrier. The at least one detection sensor 261 is preferably arranged above or beneath the transport path and oriented thereat. The at least one detection sensor 261 is preferably configured to generate at least one signal, which can be processed and/or is processed by the at least one control system 1100, for example.

The detection zone 262 of the at least one detection sensor 261 is preferably arranged downstream from the at least one transport means 108, which is in particular configured as a conveyor belt 108, in the transport direction T and preferably additionally upstream from the alignment position PA on the transport path of sheets 02. The detection zone 262 is preferably the region of the transport path which is detected by the respective detection sensor 261. Each of the at least one detection sensor 261 preferably detects a sheet 02 in the detection zone 262. The detection zone 262 of the at least one detection sensor 261, on the transport path of sheets 02, orthogonal to the transport direction T along the working width of the sheet processing machine 01, preferably has at least a distance of at least one third of the working width, preferably at least two fifths of the working width, with respect to each delimitation of the working width. More preferably, the detection zone 262 of the at least one detection sensor 261, preferably of the exactly one detection sensor 261, is centrally arranged along the working width.

The at least one detection zone 262 is preferably arranged upstream from the alignment position PA. More preferably, the at least one detection zone 262 is spaced apart from the alignment position PA at a distance L262, in particular at a distance L262 of greater than zero. Preferably, the at least one detection zone 262 is arranged upstream from the gripper shaft 221 in the transport direction T when the at least one holding means 204 is in the alignment position PA. Preferably, the distance L262 between the at least one detection zone 262 and the alignment position PA is at least so large that at least one signal of the relevant detection sensor 261 can be processed and/or is processed by the at least one control system 1100, for example, before the sheet 02 generating the relevant signal reaches the alignment position PA.

The sheet processing machine 01, in particular the infeed unit 200, preferably comprises at least the at least one sensor device 251 comprising the at least two sensors 252, and additionally the at least one detection sensor 261. The at least two sensors 252 of the at least one sensor device 251 are preferably arranged next to one another in the transport direction T at the alignment position PA. Preferably, the at least one detection sensor 261 is arranged upstream from the at least two sensors 251 of the at least one sensor device 251 in the transport direction T and/or the at least one detection sensor 261 is arranged spaced apart from the at least two sensors 251 of the at least one sensor device 251 in the transport direction T, in particular at a distance of greater than zero.

Preferably, the at least one detection sensor 261 is at least connected to the at least one transport means 108, which is preferably configured as a conveyor belt 108, via the at least one control system 1100.

Each of the at least one detection sensor 261 preferably detects a sheet 02 that is transported along the transport path in the at least one detection zone 262. Each of the at least one detection sensor 261 preferably detects a sheet 02 prior to its arrival at the alignment position PA. The at least one detection sensor 261 is preferably configured to detect the respective at least one sheet 02 at its leading edge 07 and/or the at least one detection sensor 261 detects the respective at least one sheet 02 at its leading edge 07.

More preferably, the at least one detection sensor 261 detects the respective at least one sheet 02 at a distance of at least one third with respect to the respective side edges 09, preferably centrally, at its leading edge 07. The at least one detection sensor 261 preferably detects at least one sheet 02, preferably exactly one sheet 02, per machine cycle.

In a preferred embodiment, the leading edge 07 of the sheet 02 detected by the at least one detection sensor 261 in the transport direction T is spaced apart from the trailing edge 08 of a respective preceding sheet 02, at least at the position of the transport path at which the at least one detection sensor 261 is configured to detect and/or detects the relevant sheet 02. Preferably, the leading edge 07 of the sheet 02 detected by the at least one detection sensor 261 has a distance L02, in the form of a sheet gap L02, with respect to the trailing edge 08 of the respective preceding sheet 02. The leading edge 07 of a sheet 02 is preferably detected by the at least one detection sensor 261 by way of a sheet gap L02 preceding it.

Preferably in addition or as an alternative, the at least one transport means 103; 104 of the at least one feeder unit 100 is configured to generate at least one preferably imbricated stream of sheets 02. As an alternative, at least the at least one transport means 103; 104 of the at least one feeder unit 100 is configured to generate at least one stream of separated sheets 02.

Above and below, a machine cycle preferably describes a sum of those process steps and/or procedures that take place within the processing machine 01, preferably within a unit 100; 200; 300; 400; 500; 600; 650; 700; 800; 900, in a consistent order. The relevant process steps and/or procedures are preferably only repeated during the next machine cycle in the same order. For example, a preferably clock-generating drive shaft 1002 carries out a complete rotation about its axis of rotation D within a machine cycle. For example, a machine cycle in each case comprises a processing step of a sheet 02 within a unit 300; 400; 500; 650 as well as the transport of the sheet 02 toward a respective processing point and/or the transport from the respective processing point to a downstream unit 400; 500; 600; 700; 800; 900. For example, die cutting, stripping and/or separating multiple-ups 03 are preferably carried out simultaneously during a machine cycle in different units 300; 400; 500; 650 on different sheets 02.

A machine cycle preferably comprises at least one machine phase, in particular at least a plurality of machine phases. Above and below, a machine phase preferably describes a respective process step and/or procedure that takes place at a time of the machine cycle. A machine phase preferably corresponds to at least one angular position, preferably exactly one angular position, of the drive 1001 of the drive system 1000. The sheet processing machine 01 preferably comprises at least one clock-generating element 113, which is configured to move at the machine phase and/or is moved at the machine phase. Preferably, the at least one clock-generating element 113 is moved at least once, preferably exactly once, per machine cycle from its starting position and/or starting location into a position and/or location different therefrom, and back into its starting position and/or starting location.

Preferably, in particular in the case of single sheet feeding along the at least one transport means 108 preferably configured as a conveyor belt 108, the sheets 02 are in each case arranged spaced apart from one another at the sheet gap L02 on the transport means 108. The respective sheet gap L02 is preferably generated upstream from the leading edge 07 of a relevant sheet 02, in particular in the case of single sheet feeding at least by an acceleration of the at least one transport means 108 and/or at least one transport cylinder 112, at least when preferably a machine cycle is present which differs from a transfer of a sheet 02 from the at least one suction device 102 preferably configured as a separating device 102 to the at least one transport means 108, preferably when the clock-generating element 113 is situated in the plane of the transport path and/or at the plane of the transport path and/or at its lowest position, viewed in the vertical direction V. Preferably in addition or as an alternative, in particular in the case of imbricated feeding of sheets 02, the respective sheet gap L02 is generated upstream from the leading edge 07 of a relevant sheet 02 at least by the at least partial further transport of the immediately preceding sheet 02 to the unit 300 arranged directly downstream from the infeed unit 200. In the case of imbricated feeding of sheets 02, sheets 02 are preferably arranged to at least partially overlap on the at least one transport means 108.

The control system 1100 is preferably configured to control by open-loop control and/or closed-loop control an arrival time of a sheet 02 that is at least temporarily detected by the at least one detection sensor 261 at the alignment position PA by an open-loop control and/or a closed-loop control of the at least one transport means 108, as a function of the detection of the relevant sheet 02 by the at least one detection sensor 261. Preferably, the arrival time of the sheet 02 detected by the at least one detection sensor 261 at the alignment position PA is controlled by open-loop control and/or by closed-loop control by the open-loop control and/or closed-loop control of the at least one transport means 108. More preferably, the arrival time of the sheet 02 detected by the at least one detection sensor 261 at the alignment position PA is controlled by open-loop control and/or by closed-loop control as a function of the machine cycle time and/or as a function of the detection of the relevant sheet 02 by the at least one detection sensor 261.

Preferably, a target value of the arrival time of the relevant sheet 02 at the alignment position PA, in particular the target value of the machine phase, is compared to an actual value of the arrival time of the relevant sheet 02, in particular the actual value of the machine phase. The at least one control system 1100 is preferably configured to compare the target value of the arrival time of the relevant sheet 02 at the alignment position PA to the actual value of the arrival time of the relevant sheet 02.

The actual value is preferably determined by the detection of the relevant sheet 02 by means of the at least one detection sensor 261. The actual value of the arrival time of the relevant sheet 02 at the alignment position PA is preferably established by the detection of relevant the sheet 02 by means of the at least one detection sensor 261, in particular wherein the at least one detection sensor 261 is spaced apart from the alignment position PA in the transport direction T and/or is arranged upstream from the alignment position PA in the transport direction T. More preferably, the actual value corresponds to the preferably calculated arrival time of the sheet 02, in particular the machine phase, at the alignment position PA, at which preferably calculated arrival time the respective sheet 02 would arrive at the alignment position PA at the time this sheet 02 is detected by the at least one detection sensor 261.

The target value of the arrival time of the relevant sheet 02 at the alignment position PA is preferably assigned to an, in particular technologically predefined, machine phase of the machine cycle. The target value of the arrival time of the relevant sheet 02 at the alignment position PA is preferably determined and/or can be determined at least by the distance L262 between the at least one detection zone 262 of the at least one detection sensor 261 and the alignment position PA and/or at least by at least one movement profile of the at least one drive 111 of the at least one transport means 108. The target value of the arrival time of the relevant sheet 02 at the alignment position PA is preferably calculated from at least the distance L262 between the at least one detection zone 262 of the at least one detection sensor 261 and the alignment position PA and/or from at least the at least one movement profile of the at least one drive 111 of the at least one transport means 108, in particular by the at least one control system 1100.

The at least one transport means 108 is preferably at least partially controlled by open-loop control and/or by closed-loop control by the at least one detection sensor 261. The at least one drive 111 of the at least one transport means 108 is preferably controlled by closed-loop control and/or open-loop control as a function of the comparison of the target value of the arrival time of the relevant sheet 02 at the alignment position PA and the actual value of the relevant sheet 02. Preferably, the at least one control system 1100 is configured to control by closed-loop control and/or open-loop control the at least one drive 111 of the at least one transport means 108 as a function of the comparison of the target value of the arrival time of the relevant sheet 02 at the alignment position PA and the actual value of the relevant sheet 02. Preferably in addition or as an alternative, the at least one drive 111 of the at least one transport means 108 is controlled by closed-loop control and/or by open-loop control, and/or is configured to be controllable by closed-loop control and/or by open-loop control, as a function of a detection of a sheet 02 by the at least one detection sensor 261.

Preferably, the relevant sheet 02, which is detected by the at least one detection sensor 261, is accelerated along the transport path between the at least one detection zone 262 of the at least one detection 261 and the alignment position PA, as a function of the comparison of the target value of the arrival time of the relevant sheet 02 at the alignment position PA and the actual value of the relevant sheet 02. The at least one transport means 108 is preferably configured to accelerate at least one respective sheet 02, the at least one detection sensor 261 being configured to detect this sheet 02, along the transport path between the at least one detection zone 262 of the at least one detection sensor 261 and the alignment position PA, as a function of the comparison of the target value of the arrival time of the relevant sheet 02 at the alignment position PA and the actual value of the relevant sheet 02. The acceleration is either positive, so that at least the respective sheet 02 is transported at a higher speed, or negative, so that at least the respective sheet 02 is transported at a lower speed, or equal to zero, so that at least the respective sheet 02 is transported at a preferably unchanged speed. Preferably, all sheets 02 are accelerated as a function of the comparison of the target value of the arrival time of the sheet 02, which is detected at this time by the at least one detection sensor 261, at the alignment position PA and the actual value of the sheet 02 detected at this time by the at least one detection sensor 261, each of the sheets 02 at this time being in direct or indirect contact with the at least one transport means 108, in particular being at least partially located on the at least one transport means 108 and/or being transported by the at least one transport means 108. Preferably, at least the relevant sheet 02 is accelerated in such a way that its actual arrival time at the alignment position PA agrees with the target value, in particular the technologically predefined machine phase.

The feeder 100 preferably comprises the at least one clock-generating element 113. The at least one clock-generating element 113 is preferably configured as at least one timing roller 113. The clock-generating element 113 is preferably configured to be at least partially movable in the vertical direction V. Preferably, the clock-generating element 113 is at least partially moved in the vertical direction V according to the angular position of the drive 1001 of the drive system 1000. Preferably, the clock-generating element 113 is moved at least once per machine cycle in the vertical direction V outside the plane of the transport path of sheets 02. Preferably in addition or as an alternative, the clock-generating element 113 is moved at least once per machine cycle in the vertical direction V in and/or at the plane of the transport path of sheets 02.

Preferably, the at least one detection sensor 261 detects the respective sheet 02 that is arranged at least partially in the detection zone 262, as soon as the at least one clock-generating element 113, configured in particular as a timing roller 113, is in and/or at the plane of the transport path of sheets 02, in particular at its lowest position, viewed in the vertical direction V. Preferably, the at least one clock-generating element 113, at its lowest position in the vertical direction V, is in contact with the transport path of sheets 02 and/or of a sheet 02 and/or at least the transport cylinder 112 preferably arranged beneath the transport path of sheets 02 and/or the at least one transport means 108 arranged, in particular, beneath the transport path of sheets 02.

Preferably, at least one transport cylinder 112 is arranged between the at least one feeder pile 101 and the at least one transport means 108. The at least one transport cylinder 112 is preferably driven via the at least one drive 111 of the at least one transport means 108. In addition or as an alternative, the at least one transport cylinder 112 is preferably arranged separately from the at least one clock-generating element 113 at the same position in the transport direction T of sheets 02, separated by the transport path of sheets 02. The at least one clock-generating element 113 is preferably arranged above the transport path in the vertical direction V, and the at least one transport cylinder 112 is arranged beneath the transport path. Preferably, the at least one transport cylinder 112 is arranged upstream from the at least one transport element 108 in the transport direction T.

Preferably, the at least one transport means 108 has a speed that is identical to the movement of the at least one clock-generating element 113, at least at the time at which a sheet 02 is transferred from the at least one transport means 104, which is preferably configured as a transport element 104, preferably as a horizontal suction element 104, of the at least one separating device 102 of the feeder 100 to the at least one transport means 108. Preferably, the at least one transport means 108 is driven at a speed that is synchronized with, preferably identical to, the movement of the at least one clock-generating element 113, at least at the time at which a sheet 02 is transferred from the at least one transport element 104 of the at least one separating device 102 of the feeder 100 to the at least one transport means 108. Preferably in addition or as an alternative, at least at the time at which a sheet 02 is transferred from the at least one transport element 104 to the at least one transport means 108, at least this one transport element 104 of the at least one separating device 102 of the feeder 100 has a speed that is synchronized with, preferably identical to, the movement of the at least one clock-generating element 113. Preferably in addition or as an alternative, at least at the time at which a sheet 02 is transferred from the at least one transport element 104 to the at least one transport means 108, at least this one transport element 104 of the at least one separating device 102 of the feeder 100 is moved at a speed that is synchronized with the movement of the at least one clock-generating element 113. More preferably, upon arrival of the sheet 02 detected by the at least one detection sensor 261 at the alignment position PA, an adjustment that was possibly made to the at least one transport means 108, from a speed that is matched to the machine phase to a speed deviating therefrom, is reset to a preferably at least partial vertical movement of the at least one clock-generating element 113, in particular a lifting of the clock-generating element 113 out of the plane of the transport path at this position. In a preferred embodiment, a succeeding sheet 02, which is conveyed from the at least one separating device 102 in the transport direction T toward the at least one transport means 108, configured in particular as a conveyor belt 108, at a time at which this sheet 02 makes contact with the at least one transport means 108, has a distance L02 with respect to a directly preceding sheet 02 that is preferably identical to that of two sheets 02 directly succeeding one another, which at this time are already being conveyed by the at least one transport means 108 and/or which at this time are situated on the at least one feeder table 107. Preferably, sheets 02, in particular all sheets 02 that are being conveyed by the at least one transport means 108, have a preferably identical distance L02 with respect to one another, in particular at least with respect to a directly preceding and/or direct succeeding sheet 02, at least at the time at which these sheets 02 are conveyed by the at least one transport means 108.

In a preferred embodiment, the at least one transport means 108 is configured to roughly align at least the sheet 02 detected by the at least one detection sensor 261, at least corresponding to the transport direction T. Preferably, the sheet 02 detected by the at least one detection sensor 261 is roughly aligned at least by the at least one transport means 108, at least corresponding to the transport direction T. Preferably in addition or as an alternative, the sheet 02 detected by the at least one detection sensor 261 is roughly aligned at the alignment position PA at least by at least two front lay marks 203.

Preferably in addition or as an alternative, the infeed system 202 comprises the at least one servo drive 218, which at least partially moves and/or is configured to move the at least one holding means 204, wherein the at least one holding means 204 finely aligns and/or is configured to finely align the at least one sheet 02.

A sheet 02 is preferably at least temporarily transported within the sheet processing machine 01. The sheet processing machine 01 preferably comprises at least the at least one infeed system 202, comprising the at least one transport means 204, preferably configured as a gripper 204, and the at least one transport system 1200, comprising the at least one holding element 1202, preferably configured as a gripper 1202.

Preferably, a method for at least temporarily transporting sheets 02, preferably the at least one sheet 02, comprises at least the following steps.

Positioning a sheet 02, preferably the at least one sheet 02 of the sheets 02, in the at least one infeed system 202 at the alignment position PA, by the sheet 02 striking against the at least two front lay marks 203 arranged orthogonally to the transport direction T of sheets 02 and horizontally next to one another; holding the, preferably at least one, sheet 02 by way of the at least one transport means 204 in the alignment position PA in the maximally closed state of the at least one transport means 204; detecting the, preferably at least one, sheet 02 by the at least two sensors 252 of the at least one sensor device 251 in the alignment position PA in the maximally closed state of the at least one transport means 204; transporting the, preferably at least one, sheet 02 from the alignment position PA to the transfer position PU arranged downstream from the alignment position PA in the transport direction T; transferring the, preferably at least one, sheet 02 from the at least one transport means 204 to the at least one holding element 1202 in the transfer position PU; and returning the at least one transport means 204 to the alignment position PA.

Preferably, a sheet 02, preferably the at least one sheet 02, is at least temporarily positioned in the alignment position PA. Preferably, the sheet 02, preferably the at least one sheet 02, is roughly aligned by the positioning in the alignment position PA. Preferably, the respective sheet 02 is roughly aligned by the positioning in the alignment position PA. Preferably, the at least one transport means 204, in particular the at least one holding means 204, is in the at least one mean state while the sheet 02 is being positioned in the alignment position PA, which differs both from the maximally closed state and from the minimally closed state of the at least one transport means 204, in particular of the at least one holding means 204. Preferably, the at least one transport means 204 has the at least one mean state while the at least one sheet 02 is being positioned in the alignment position PA, preferably at least during the rough alignment of the at least one sheet 02. For an at least temporary transport, preferably at least one sheet 02, preferably the at least one sheet 02, is positioned in the alignment position PA by the sheet 02 striking against the at least two front lay marks 203 that are arranged orthogonally to the transport direction T of sheets 02 and horizontally next to one another, preferably a multiplicity of front lay marks 203. Preferably, the respective, preferably at least one, sheet 02 is roughly aligned by the positioning in the alignment position PA.

The, preferably at least one, sheet 02 is preferably held by way of the at least one transport means 204 in the alignment position PA in the maximally closed state of the at least one transport means 204. The, preferably at least one, sheet 02, after having been positioned in the alignment position PA, is preferably held by the at least one transport means 204 in at least one edge region and/or outside the at least one print image of the sheet 02 in the maximally closed state of the at least one transport means 204. While it is being held in the alignment position PA, the respective, preferably the at least one, sheet 02, in particular the leading edge 07 of the sheet 02, is preferably at least partially, preferably completely, fixed in its position with respect to the transport direction T and/or transverse direction A and/or vertical direction V.

Preferably, the distance between the at least one upper holder 206 and the at least lower holder 207 of the at least one transport means 204, in particular the respective distance between the at least one upper holding surface 233 and the at least one lower holding surface 234, is set via the at least one cam mechanism of the infeed system 202, wherein the relevant cam mechanism is preferably provided for setting the respective state of the at least one transport means 204. Preferably, the at least one cam mechanism sets the state of the at least one transport means 204, preferably the distance of the holders 206; 207 with respect to one another, during an ongoing operation of the processing machine 01, preferably corresponding to the present machine phase.

Preferably, the at least one mean distance between the at least one upper holding surface 233 of the at least one respective upper holder 206 and the at least one lower holding surface 234 of the lower holder 207 assigned to the respective upper holder 206, is set corresponding to a maximum thickness of sheets 02 to be transported, in particular at least once for each processing job involving sheets 02 of the same type. At least one holding surface 233; 234 of the at least one holder 206; 207 preferably pivots and/or is pivotable, at least temporarily, about the pivot axis 221 of the relevant holder 206; 207. The maximally closed state preferably corresponds to the minimal distance, and the minimally closed state preferably corresponds to the maximal distance, and the at least one mean state preferably corresponds to the at least one mean distance, between the at least one upper holding surface 233 of the at least one respective upper holder 206 and the at least one lower holding surface 234 of the lower holder 207 assigned to the respective upper holder 206. Preferably, the at least one pivotable holding surface 233; 234 is functionally connected to at least one cam disk 223 via the at least one scanning lever 226. Preferably, the at least one infeed system 202 additionally comprises the at least one servo drive 231, which at least temporarily intervenes in the functional connection between the at least one cam disk 223 and the at least one pivotable holding surface 233; 234. Preferably, the at least one servo drive 231 sets, preferably adjusts, the at least one mean state of the at least one transport means 204. Preferably, the at least one servo drive 231 sets the at least one mean state of the at least one transport means 204 while an operating situation of the processing machine 01 is being maintained. Preferably, the at least one mean state is set during operation of the processing machine 01. Preferably, this allows sheets 02 having different thicknesses to be processed while an operating situation of the processing machine 01 is being maintained, preferably without interrupting production, more preferably for two consecutive sheets 02.

The at least one servo drive 231 preferably adjust the axis of rotation U of the at least one transmission shaft 227 and the axis of rotation E of the at least one adjusting shaft 228 relative to one another. Preferably in addition or as an alternative, the axis of rotation U of the at least one transmission shaft 227 and the axis of rotation E of the at least one adjusting shaft 228 can be adjusted and/or are adjusted relative to one another by the at least one servo drive 231. Preferably, the at least one mean distance between the at least one upper holding surface 233 of the at least one respective upper holder 206 and the at least one lower holding surface 234 of the lower holder 207 assigned to the respective upper holder 206, which preferably corresponds to the at least one mean state of the at least one transport means 204, is set as a result of the at least partial pivoting of the at least one adjusting shaft 228 about its axis of rotation E.

The at least one sheet 02 is preferably detected by the at least two sensors 252 of the at least one sensor device 251 in the alignment position PA in the maximally closed state of the at least one transport means 204. The at least one sheet 02 is preferably selectively detected in the alignment position PA by the at least two sensors 252 at the leading edge 07 and/or at the at least one printing mark 11 of the sheet 02 in the maximally closed state of the at least one transport means 204. The at least one sheet 02 is more preferably selectively detected in the alignment position PA by the at least two sensors 252 that are arranged orthogonally to the transport direction T and horizontally next to one another at the leading edge 07 and/or at the at least one printing mark 11 of the sheet 02 in the maximally closed state of the at least one transport means 204. The sheet 02 is more preferably selectively detected in the alignment position PA at idle by at least two sensors 252 that are arranged orthogonally to the transport direction T and horizontally next to one another, without repositioning the relevant sensor 252, at the leading edge 07 and/or at at least one printing mark 11 of the sheet 02 in the maximally closed state of the at least one transport means 204. In addition or as an alternative, the sheet 02 is more preferably selectively detected in the alignment position PA at idle by at least one sensor 252, for example the at least one third sensor 252, without repositioning the relevant sensor 252, at at least one side edge 09 and/or at at least one printing mark 11 of the sheet 02, preferably wherein the at least one printing mark 11 preferably has a smaller distance with respect to the at least one side edge 09 than with respect to the leading edge 07, in the maximally closed state of the at least one transport means 204.

Preferably, the at least one sheet 02 is transported from the alignment position PA to the transfer position PU arranged downstream from the alignment position PA in the transport direction T. Prior to and/or preferably during the transport of the sheet 02 from the alignment position PA to the transfer position PU, the at least two front lay marks 203 are preferably adjusted from their positioning within the transport path of sheets 02 into a positioning outside the transport path of sheets 02. Preferably, the at least two front lay marks 203 are adjusted, preferably pivoted, out of the plane of the transport path in the alignment position PA, in particular completely outside the plane of the transport path in the alignment position PA.

In particular during the transport of the, preferably at least one, sheet 02 from the alignment position PA to the transfer position PU and/or in particular during the return of the at least one transport means 204 from the transfer position PU to the alignment position PA, at least one rotational movement of the at least one cam mechanism of the infeed system 202, in particular at least of the at least one cam mechanism assigned to the transport of sheets 02, is preferably converted into at least one linear movement of the at least one transport means 204 by the at least one drive lever 214. More preferably, in particular during the transport of the sheet 02 from the alignment position PA to the transfer position PU and/or in particular during the return of the at least one transport means 204 from the transfer position PU to the alignment position PA, at least one rotational movement of at least two cam mechanisms arranged horizontally next to one another in the transport direction T, in particular of at least two cam mechanisms at least assigned to the transport of sheets 02, is converted into at least one linear movement of the at least one transport means 204 by the at least one drive lever 214.

Preferably, the at least one cam mechanism, preferably the at least two cam mechanisms, more preferably all cam mechanisms of the infeed system 202 are preferably continuously driven by the at least one drive shaft 1002, by way of the at least one drive 1001 of the sheet processing machine 01. Preferably, each of the at least one cam disk 212; 223 is connected to the at least one drive shaft 1002 and/or is arranged at the at least one drive shaft 1002. The movement of the at least one cam disk 212; 223 preferably corresponds to the movement of the at least one drive shaft 1002. Preferably, at least one cam mechanism of the infeed system 202, in particular at least the at least one cam mechanism assigned to the transport of sheets 02, is configured as a dual cam mechanism comprising at least two cam disks 212 in each case.

The at least one cam disk 212; 223 of the infeed system 202, in particular each cam disk 212; 223 of each relevant cam mechanism of the infeed system 202, preferably during a machine cycle, carries out exactly one complete rotation about its axis of rotation D, wherein a machine cycle at least comprises the steps of positioning the sheet 02 in the alignment position PA, holding the sheet 02 in the alignment position PA by way of the at least one transport means 204, detecting the sheet 02 by at least two sensors 252 of the at least one sensor device 251, transporting the sheet 02 from the alignment position PA to the transfer position PU, transferring the sheet 02 from the at least one transport means 204 to the at least one holding element 1202, and returning the at least one transport means 204 to the alignment position PA.

The sheet 02, preferably the at least one sheet 02, is preferably finely aligned by the at least one infeed system 202 during the transport from the alignment position PA to the transfer position PU. The respective sheet 02 is preferably finely aligned by the at least one infeed system 202 during the transport from the alignment position PA to the transfer position PU. The sheet 02 is preferably finely aligned during the transport of the sheet 02 from the alignment position PA to the transfer position PU, as a function of the detection of the sheet 02, in particular the preferably selective detection of at least one printing mark 11 and/or at least one edge 07; 08; 09 of the sheet 02, preferably the preferably selective detection of at least two printing marks 11 and/or of the leading edge 07 of the sheet 02 and/or of at least one side edge 09 of the sheet 02, by the at least one sensor device 251, in particular by means of the at least one infeed system 202. Preferably, the at least one transport means 204, more preferably the at least one sheet 02, is adjusted as a function of the detection by the at least one sensor device 251, preferably the at least one sensor 252, more preferably the at least two sensors 252, in the transport direction T and/or transverse direction A, preferably for compensating for at least one position error of the at least one sheet 02. This means, preferably, that the at least one substrate 02, which is preferably configured as a sheet 02, is aligned as a function of the detection of the at least one printing mark 11, preferably the at least two printing marks 11, in the transport direction T and/or in the transverse direction A by a movement of the substrate 02 that is preferably configured as a sheet 02.

In the case of a lateral fine alignment of the sheet 02 orthogonal to the transport direction T, at least the at least one transport means 204 of the infeed system 202 is preferably adjusted horizontally and orthogonally to the transport direction T via at least one servo drive 237 of the lateral alignment.

The infeed system 202 preferably comprises the at least one cam mechanism, each comprising the at least one cam disk 212 and the axis of rotation D of the at least one cam disk 212. The at least one scanning element 213 preferably rests against the at least one cam disk 212. The at least one scanning element 213 is preferably connected to the at least one transport means 204 via the at least one drive lever 214. The at least one drive lever 214 preferably comprises the mounting point S. The mounting point S and the axis of rotation D are preferably configured to be adjustable and/or adjusted relative to one another and/or are adjusted relative to one another.

The alignment in the transport direction T preferably includes at least one position displacement of the mounting point S of the at least one drive lever 214 and of the axis of rotation D of the at least one relevant cam disk 212. A position error of the at least one sheet 02 is preferably compensated for by the position displacement of the mounting point S relative to the axis of rotation D, more preferably the at least one sheet 02 is finely aligned, preferably at least in the transport direction T. The relevant sheet 02 is preferably finely aligned, in particular in the transport direction T, by the at least one position displacement of the mounting point S of the at least one drive lever 214 and of the axis of rotation D of the at least one cam disk 212 relative to one another, in addition to the deflection of the at least one drive lever 214 as a result of an at least partial rotation of the at least one cam disk 212. Preferably, the at least one servo drive 218 is configured to be activatable and/or activated and/or controllable by closed-loop control and/or controlled by closed-loop control during a compensation of at least one skewed position of the sheet 02. Preferably in addition, at least two servo drives 218 are configured to be activatable and/or activated and/or controllable by closed-loop control and/or controlled by closed-loop control during a compensation of at least one position error in the transport direction T. During the fine alignment of the sheet 02 in the transport direction T, the at least one servo drive 218 is preferably at least activated and/or controlled by closed-loop for a compensation for a skewed position of the sheet 02. Preferably in addition, the at least two servo drives 218 are at least activated and/or controlled by closed-loop for a compensation for a position error in the transport direction T during the fine alignment of the sheet 02 in the transport direction T.

During the fine alignment of the sheet 02 in the transport direction T, the open-loop control and/or closed-loop control of the at least one servo drive 218 preferably compensates for at least one skewed position of the sheet 02. Preferably in addition, the preferably simultaneous open-loop control and/or closed-loop control of the at least two servo drives 218 compensates for at least one position error in the transport direction T during the fine alignment of the sheet 02 in the transport direction T.

The respective sheet 02 is preferably simultaneously finely aligned during the transport from the alignment position PA to the transfer position PU, both in the transport direction T and also laterally, i.e., in the transverse direction A. Preferably, at least one signal is transmitted to the respective required servo drive 218; 237 by the at least one control system 1100, in particular as a function of the detection of the sheet 02 by the at least one sensor 252 of the at least one sensor device 251. The respective required servo drives 218; 237 are preferably controlled by open-loop control and/or by closed-loop control so as to be synchronized during the fine alignment of sheets 02. The respective other alignment of the sheet 02 is preferably taken into consideration in the calculation of the at least one signal, so that the respective required servo drives 218; 237 are preferably controlled by open-loop control and/or by closed-loop control so as to be synchronized during the fine alignment of sheets 02.

The respective at least two, preferably three, sensors 252 preferably detect and/or ascertain a deviation of the sheet 02, in particular of the leading edge 07 and/or of the side edge 09 and/or of the at least one printing mark 11, from a respective reference value stored in the control unit 1100. Preferably, first a deviation from the reference value is ascertained from the measurement values of the leading edge 07 and/or printing marks 11 provided at the leading edge 07. A deviation of the position of the side edge 09 as a result of the format of the sheet 02 is preferably subtracted from the skewed position of the sheet 02 ascertained therefrom. This is preferably followed by a shortening of the path that the sheet 02 has to cover between the alignment position PA and the transfer position PU. This shortening is preferably subtracted and/or taken into consideration in the signal for the respective servo drives 218, which control by closed-loop control and/or open-loop control the transport of the sheet 02 in the transport direction T.

The at least one sheet 02 is preferably transferred from the at least one transport means 204 to the at least one holding element 1202 in the transfer position PU. The at least one holding element 1202, which is in particular configured as a gripper 1202, preferably transports the sheet 02 at least within the at least one die-cutting unit 300 arranged downstream from the infeed unit 200.

During the transfer of the sheet 02, the at least one holding element 1202 of the transport system 1200 preferably remains at the transfer position PU in idle. First, preferably the at least one holding element 1202 of the transport system 1200, which is positioned at the transfer position PU, is closed, preferably before the at least one transport means 204 of the infeed system 202 releases the sheet 02 in the transfer position PU. During the transfer from the at least one transport means 204 to the at least one holding element 1202, the sheet 02 is preferably permanently held by at least one component of the sheet processing machine 01, preferably at least either by the at least one transport means 204 or by the at least one holding element 1202 and/or by both the at least one transport means 204 and/or the at least one holding element 1202, preferably at at least one edge 07; 08; 09, more preferably at least at the leading edge 07.

The at least one holding element 1202, preferably the at least one gripper carriage 1201 assigned to the relevant at least one holding element 1202, is arranged so as to be aligned at the transfer position PU. The at least one holding element 1202 is preferably aligned by at least one positioning element, preferably by at least one register unit for aligning the at least one holding element 1202 at the transfer position PU, and/or is fixed in its position at the transfer position PU. In this way, a transfer to the at least one holding element 1202 and/or continued transport, in the correct position, of the aligned sheet 02 by way of the at least one holding element 1202, at least in the at least one die-cutting unit 300 arranged downstream from the infeed unit 200, is ensured.

The at least one transport means 204 is preferably returned to the alignment position PA, in particular after the respective sheet 02 has been transferred to the at least one holding element 1202 of the transport system 1200. The at least one transport means 204, in particular the at least one holding means 204, preferably has the minimally closed state while the at least one transport means 204 is returned to the alignment position PA. Preferably, while the at least one transport means 204 is returned to the alignment position PA, the at least two front lay marks 203 are pivoted at least partially into the plane of the transport path, in particular as soon as the at least one transport means 204 is arranged upstream from the at least two front lay marks 203 in the transport direction T. Preferably, the respective sheet 02 is further transported by the at least one holding element 1202 of the transport system 1200 while the at least one transport means 204 is returned to the alignment position PA.

Preferably, an option is provided for locking the infeed system 202, preferably for locking the at least one transport means 204 in the minimally closed state. The control system 1100 is preferably configured to activate the lock. The control system 1100 is preferably configured to at least temporarily, preferably in the event of a lock, immobilize the at least one transport means 204 in the minimally closed state. The at least one servo drive 231 is preferably configured to set, preferably immobilize, the minimally closed state in the event of a lock. During a lock of the infeed system 202, preferably the immobilization of the at least one transport means 204 in the minimally closed state, the at least one transport means 204 is moved to the transfer position PU in the minimally closed state, preferably without a sheet 02. Preferably, the processing machine 01 is stopped or reduced to idle, whereupon the sheet 02 that is not transported is guided out of and/or removed from the infeed system 202, preferably removed manually. The lock, preferably the immobilization of the at least one transport means 204 in the minimally closed state, is preferably carried out when the at least one sheet 02 has a position error which exceeds the alignment possibilities of the infeed system 202. Preferably, the position error exceeds the alignment possibilities of the infeed system 202 when the measured value, preferably the detected position, in the transverse direction A deviates by at least 10 mm (ten millimeters), preferably at least 15 mm (fifteen millimeters), from its reference and/or when the measured value, preferably the detected position, in the transport direction T deviates by at least 3 mm (three millimeters), preferably at least 4 mm (four millimeters), more preferably at least 8 mm (eight millimeters), from its reference, preferably after the rough alignment has been carried out by the at least two front lay marks 203.

Although the disclosure herein has been described in language specific to examples of structural features and/or methodological acts, it is to be understood that the subject matter defined in the appended claims is not necessarily limited to the specific features or acts described in the examples. Rather, the specific features and acts are disclosed merely as example forms of implementing the claims.

The invention claimed is:

1. A print control strip comprising:

at least eight control patches arranged in a row and abutting one another in at least one print control strip, the at least eight control patches in the at least one print control strip having a same height and a same width, the at least one print control strip including at least one of the control patches configured as an element for color management, each at least one element for color management including a single printing ink embodied as a solid color patch or as a screen dot patch of the single printing ink, the at least one element for color management being configured to enable measurement of a color density and/or at least one spectral value and/or an area coverage of individual printed printing colors of printing inks, the at least one print control strip including at least two of the control patches configured as at least two printing marks, respectively, wherein at least one control patch having a different function is arranged between the at least two printing marks, the at least two printing marks being configured to enable alignment of at least one substrate in a transport direction and/or in a transverse direction, each of the at least two printing marks being configured as at least one of a bar, a cross, a rectangle, or a polygon, and having at least one straight edge, wherein at least one of the printing marks is surrounded by at least one of an unprinted region or unicolor region, the at least one print control strip including at least one of the control patches configured as a plate recognition patch, the at least one plate recognition patch including at least two elements for plate recognition, wherein each element of the at least two elements for plate recognition is assigned to one printing color of at least two different printing colors, respectively, and each element for plate recognition is printed by the one printing color assigned thereto, wherein the printing color assigned to a respective element for plate recognition of the at least two elements for plate recognition is assigned to a respective printing plate that generated the respective element for plate recognition, wherein the at least two elements for plate recognition are configured as forms that differ from one another, the forms including digits that differ from one another, letters that differ from one another, or a mixture of digits and letters that differ from one another, and wherein the at least one print control strip includes as many of the elements for plate recognition as there are printing inks used for printing the at least one substrate, and the at least one print control strip including at least one of the control patches configured as a side recognition mark, the at least one side recognition mark configured to indicate a surface of the at least one substrate on which the at least one print control strip is situated or is to be situated, wherein the at least one side recognition mark has an optical pattern that differs from optical patterns of other control patches having different functions and is configured to include at least one geometric figure.

2. The print control strip according to claim 1, wherein at least one of:

the at least one print control strip includes at least one of the control patches configured as a print register element, the at least one print control strip includes at least one of the control patches configured as an information mark, or the at least one print control strip includes at least one of the control patches configured as a reference patch.

3. The print control strip according to claim 1, wherein:

the at least one printing mark has a geometry that can be generated by at least one of a digital printing method and/or cold foil method and/or hot foil method and/or flexographic printing method and/or gravure printing method and/or offset printing method, and/or the at least one printing mark is configured such that the position of the at least one substrate including the at least one print control strip in the transport direction and/or in the transverse direction is determined by the at least one printing mark.

4. The print control strip according to claim 1 wherein the at least two printing marks are arranged symmetrically with respect to an axis of symmetry of the at least one print control strip.

5. The print control strip according to claim 2, wherein at least one of:

the at least one information mark is configured as a code, the at least one information mark includes job data, the at least one information mark includes reference values of the control patches of the at least one print control strip, the at least one information mark includes information regarding arrangement rules, the at least one print register element is configured to monitor a color register and/or a perfecting register, the at least one print register element comprises at least two register elements, the at least one reference patch has a color density of zero percent and/or a tonal value of zero percent, the at least one reference patch is unprinted, or the at least one reference patch is configured to enable setting and/or adjustment of at least one sensor of at least one sensor device.

6. A substrate, characterized in that the substrate includes the at least one print control strip according to claim 1.

7. The substrate according to claim 6, wherein at least one of:

the at least one print control strip is positioned in a region outside at least one print image of the substrate, the at least one print control strip is integrated into at least one print image of the substrate, or the substrate comprises at least one multiple-up and at least one offcut piece, and the at least one print control strip is positioned and/or is to be positioned on the at least one offcut piece.

8. A method comprising:

controlling by open-loop control and/or closed-loop control at least one component of a processing machine, at least one infeed unit of the processing machine comprising at least one sensor device, the at least one sensor device comprising at least two sensors, the at least one sensor device detecting at least one printing mark integrated into at least one print control strip of at least one substrate, the at least one substrate being adjusted in a transport direction and/or transverse direction as a function of the detecting by the at least one sensor device, wherein:

the at least one print control strip includes at least one control patch configured as a plate recognition patch, the at least one plate recognition patch includes at least two elements for plate recognition, wherein each element of the at least two elements for plate recognition is assigned to one printing color of at least two different printing colors, respectively, and each element for plate recognition is printed by the one printing color assigned thereto, the printing color assigned to a respective element for plate recognition of the at least two elements for plate recognition is assigned to a respective printing plate that generated the respective element for plate recognition, the at least two elements for plate recognition are configured as forms that differ from one another, the forms including digits that differ from one another, letters that differ from one another, or a mixture of digits and letters that differ from one another, the at least one print control strip includes as many of the elements for plate recognition as there are printing inks used for printing the at least one substrate, and the at least one print control strip includes at least eight control patches arranged in the at least one print control strip in a row and abutting one another.

9. The method according to claim 8, wherein:

the at least one print control strip includes at least one control patch configured as a side recognition mark, the at least one sensor device determining a side of the at least one substrate at which the at least one sensor of the at least two sensors is directed by detecting and/or evaluating the at least one side recognition mark, and/or a position of the at least one print control strip on the at least one substrate is determined based on the at least one side recognition mark, and/or a height and/or skewed position and/or scaling of the at least one print control strip is determined based on the at least one side recognition mark.

10. The method according to claim 8, wherein at least one of:

the at least one print control strip includes at least one control patch configured as an element for color management, the at least one print control strip includes at least one control patch configured as a print register element, the at least one print control strip includes at least one control patch configured as a printing mark, the at least one print control strip includes at least one control patch configured as an information mark, or the at least one print control strip includes at least one control patch configured as a reference patch.

11. The method according to claim 10, wherein at least one of:

the at least one sensor device carries out a measurement of color density and/or a measurement of at least one spectral value and/or a measurement of an area coverage of individual printed printing colors by detecting and evaluating the at least one element for color management, the at least one sensor device detects and/or evaluates the at least one print register element, and wherein a circumferential register and/or a lateral register and/or a diagonal register of at least one application mechanism are controlled by closed-loop control for printing the at least one substrate in accordance with evaluation of the at least one print register element, the at least one sensor device detects the at least one information mark and/or reads out information of the at least one information mark, and/or that the at least one sensor device detects and/or evaluates the at least one reference patch, or at least one sensor of the at least two sensors of the at least one sensor device is set by detecting the at least one reference patch.

12. The method according to claim 8, wherein at least one of:

the at least one plate recognition patch is detected and/or evaluated by the at least one sensor device, at least one sensor of the at least two sensors detects a position in the transport direction of the at least one substrate and/or a position in the transverse direction of the at least one substrate, or the at least two sensors detect a skewed position of the at least one substrate.

* * * * *